US007364824B2

(12) United States Patent
Kikuchi et al.

(10) Patent No.: US 7,364,824 B2
(45) Date of Patent: Apr. 29, 2008

(54) ELECTROPHOTOGRAPHIC PHOTOSENSITIVE MEMBER, PROCESS CARTRIDGE, AND ELECTROPHOTOGRAPHIC APPARATUS

(75) Inventors: Toshihiro Kikuchi, Yokohama (JP); Atsushi Ochi, Numazu (JP); Harumi Sako, Yokohama (JP); Kimihiro Yoshimura, Yokohama (JP); Hideaki Tamai, Newport News, VA (US); Nobuo Kosaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/617,347

(22) Filed: Dec. 28, 2006

(65) Prior Publication Data

US 2007/0111121 A1 May 17, 2007

Related U.S. Application Data

(63) Continuation of application No. PCT/JP2006/311464, filed on Jun. 1, 2006.

(30) Foreign Application Priority Data

Jun. 2, 2005 (JP) ..... 2005-162730
Jun. 2, 2005 (JP) ..... 2005-162732

(51) Int. Cl.
*G03G 15/02* (2006.01)

(52) U.S. Cl. ..... 430/58.7; 430/56; 430/59.6; 430/66; 399/159

(58) Field of Classification Search ..... 430/56, 430/58.7, 59.6, 66; 399/159
See application file for complete search history.

(56) References Cited

U.S. PATENT DOCUMENTS 4,461,819 A 7/1984 Nakagawa et al. ..... 430/59

(Continued)

FOREIGN PATENT DOCUMENTS

JP 54-143645 11/1979

(Continued)

*Primary Examiner*—Mark F. Huff
*Assistant Examiner*—Peter Vajda
(74) *Attorney, Agent, or Firm*—Fitzpatrick, Cella, Harper & Scinto

(57) ABSTRACT

An electrophotographic photosensitive member, a process cartridge and an electrophotographic apparatus are provided which not only secure mechanical strength sufficiently but also bring a vast improvement in charge transport performance and which can well satisfy electrical properties. An electrophotographic photosensitive member is provided an outermost surface layer of which contains at least a charge transporting compound having chain polymerizable functional groups which is represented by the following general formula (1-1) or (1-2); the charge transporting compound having been polymerized or cross-linked and cured. Also provided are a process cartridge and an electrophotographic apparatus which have such a photosensitive member.

(1-1)

(1-2)

16 Claims, 2 Drawing Sheets

U.S. PATENT DOCUMENTS

| | | | | |
|---|---|---|---|---|
| 4,551,405 | A | 11/1985 | Nakagawa et al. | 430/64 |
| 4,557,990 | A | 12/1985 | Nakagawa et al. | 430/84 |
| 4,613,558 | A | 9/1986 | Nakagawa et al. | 430/84 |
| 4,670,369 | A | 6/1987 | Nakagawa et al. | 430/128 |
| 4,985,330 | A | 1/1991 | Tsuchiya et al. | 430/130 |
| 5,411,827 | A | 5/1995 | Tamura et al. | 430/58 |
| 5,427,880 | A * | 6/1995 | Tamura et al. | 430/58.7 |
| 5,496,671 | A | 3/1996 | Tamura et al. | 430/58 |
| RE35,198 | E | 4/1996 | Nakagawa et al. | 430/59 |
| 5,747,204 | A | 5/1998 | Anzai et al. | 430/59 |
| 5,830,980 | A | 11/1998 | Anzai et al. | 528/272 |
| 6,180,303 | B1 | 1/2001 | Uematsu et al. | 430/59.6 |
| 6,416,915 | B1 * | 7/2002 | Kikuchi et al. | 430/56 |
| 7,175,957 | B2 | 2/2007 | Suzuki et al. | 430/66 |
| 7,179,573 | B2 | 2/2007 | Suzuki et al. | 430/66 |
| 2002/0018953 | A1 | 2/2002 | Maruyama et al. | 430/130 |
| 2004/0043312 | A1 | 3/2004 | Kikuchi et al. | 430/56 |
| 2007/0122724 | A1 | 5/2007 | Suzuki et al. | 430/58.7 |
| 2007/0178400 | A1 | 8/2007 | Kikuchi et al. | 430/133 |

FOREIGN PATENT DOCUMENTS

| | | |
|---|---|---|
| JP | 02-127652 | 5/1990 |
| JP | 05-216249 | 8/1993 |
| JP | 07-072640 | 3/1995 |
| JP | 08-248649 | 9/1996 |
| JP | 11-265085 | 9/1999 |
| JP | 2000-066424 | 3/2000 |
| JP | 2000-066425 | 3/2000 |
| JP | 2000-206715 | 7/2000 |
| JP | 2000-206716 | 7/2000 |
| JP | 2001-166519 | 6/2001 |
| JP | 2001-166520 | 6/2001 |
| JP | 2001-175016 | 6/2001 |
| JP | 2004-302451 | 10/2004 |

* cited by examiner

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2006/311464, filed Jun. 1, 2006, which claims the benefit of Japanese Patent Application No. 2005-162730, filed Jun. 2, 2005 and Japanese Patent Application No. 2005-162732, filed Jun. 2, 2005.

BACKGROUND OF THE INVENTION

1. Field of the Invention

This invention relates to an electrophotographic photosensitive member which contains in its outermost surface layer a compound obtained by polymerizing or cross-linking and curing a charge transporting compound having chain polymerizable functional groups, and a process cartridge and an electrophotographic apparatus which have the electrophotographic photosensitive member.

2. Description of the Related Art

In the past, as photoconductive materials used in electrophotographic photosensitive members, inorganic electrophotographic photosensitive members making use of inorganic materials such as selenium, cadmium sulfide and zinc oxide have chiefly been in use. Meanwhile, organic electrophotographic photosensitive members making use of organic materials have energetically been on research and development because their advantages such as high productivity and freeness from environmental pollution have attracted notice, and those having photoconductive properties comparable to those of the inorganic electrophotographic photosensitive members have been discovered in a large number and in recent years have come into main use in place of the inorganic electrophotographic photosensitive members.

These electrophotographic photosensitive members are often used as functionally separated electrophotographic photosensitive members in which a charge generation layer and a charge transport layer are superposed in order to satisfy both electrical and mechanical properties. Here, in order to bring out electrical properties always stably and at high sensitivity at the initial stage of course and also when used for a long time, what are very important are the structure and purity of a charge transporting compound. Meanwhile, as a matter of course, in electrophotographic photosensitive members used repeatedly, electrical and mechanical external forces due to charging, imagewise exposure, development with toner, transfer to paper, cleaning and so forth are directly applied to the surfaces of the electrophotographic photosensitive members, and hence they are required to have durability to such external forces. Stated specifically, they are required to have durability to surface wear and scratches caused by rubbing, durability to surface deterioration due to charging (e.g., a lowering of transfer efficiency and slipperiness), and also durability to the deterioration of electrical properties, such as a lowering of sensitivity and a lowering of potential.

The surfaces of electrophotographic photosensitive members are commonly formed by thin resin layers, and properties of resins are very important. As resins that fulfill the above various conditions to a certain extent, acrylic resins, polycarbonate resins and the like are put into practical use in recent years, but it is not the case that all the properties as stated above are satisfied by these resins. In particular, in order to achieve a high durability of the electrophotographic photosensitive members, it is difficult to say that such resins can have a sufficiently high film hardness. Even where these resins are used as resins for forming surface layers, there has been a problem that the surface layers come to wear when used repeatedly and further come scratched.

Further, because of a demand made in recent years for the achievement of high sensitivity of organic electrophotographic photosensitive members, a low-molecular weight compound such as a charge transporting compound is often added in a relatively large quantity. In such a case, the film strength may greatly lower because of the action of such a low-molecular weight substance that is similar to that of a plasticizer, to bring about the problem that the surface layer comes to wear and comes scratched when used further repeatedly. A problem may also arise such that the above low-molecular weight component charge transporting compound comes unwantedly deposited when electrophotographic photosensitive members are stored over a long period of time, to cause layer separation.

As a measure for solving these problems, an attempt to use a curable resin as a resin for charge transport layer is disclosed in, e.g., Japanese Patent Application Laid-open No. H02-127652. The curable resin is thus used as a resin for charge transport layer and the charge transport layer formed is cured or cross-linked. This brings an enhancement of mechanical strength, and a great improvement in wear resistance and scratch resistance in repeated used. However, even if such a curable resin is used, the low-molecular weight component acts as a plasticizer in the binder resin to the last, and hence the problems of deposition and layer separation as stated above are not fundamentally solved. Also, in the charge transport layer constituted of the charge transporting compound and a binder resin, the dependence of charge transport performance on the resin is so great that, e.g., a curable resin promising a sufficiently high hardness may have no sufficient charge transport performance and the residual potential may be seen to increase when used repeatedly. Thus, this measure has not come up with satisfaction of the both.

In, e.g., Japanese Patent Applications Laid-open No. H05-216249, No. H07-072640 and No. 2004-302451, an electrophotographic photosensitive member is disclosed in which a charge transport layer is incorporated with a charge transporting compound monomer having a carbon-carbon double bond and the carbon-carbon double bond of the charge transporting compound is allowed to react by the energy of heat or light to form a cured film as the charge transport layer. This charge transporting compound is set pendantwise stationary to the polymer backbone skeleton as in the present invention. However, the charge transporting compound has only one polymerizable group and also is blended with a commercially available polyfunctional monomer, followed by curing to form the film. Hence, firstly the charge transporting compound having one carbon-carbon double bond must be used in a certain level of concentration in order to bring out a sufficient charge transport performance. Because of the relation of compatibility with the commercially available polyfunctional monomer, it is also difficult to configure charge transporting materials in the film in a uniform and optimum state. Thus, in the actual circumstances, it is unable to sufficiently secure both the mechanical strength and the charge transport performance. Further, it is concerned that initiators required at the time of polymerization may affect electrophotographic performance, and in practice they affect it to cause an increase in residual potential and potential variations at the time of running to bring about a problem.

As another measure for solution, in, e.g., Japanese Patent Application Laid-open No. H08-248649, an electrophotographic photosensitive member is also disclosed in which a group capable of transporting electric charges is introduced into the backbone chain of a thermoplastic high polymer to form a charge transport layer. This charge transport layer is more effective against the deposition and layer separation than conventional molecule-dispersed type charge transport layers and brings an improvement in mechanical strength as well. However, the high polymer used is a thermoplastic resin to the last. There is a limit to its mechanical strength, and it is difficult to say that such a polymer is satisfactory in respect of handling and productivity, inclusive of solubility and so forth of the resin.

As discussed above, any systems hitherto available have not achieved both the high mechanical strength and the high charge transport performance. Under such circumstances, in various publications, the present inventors have proposed that a charge transporting compound having chain polymerizable functional groups may be cross-linked and cured by irradiation with electron rays or ultraviolet rays or by heat, whereby the above problems can vastly be remedied (see, e.g., Japanese Patent Applications Laid-open No. H11-265085. No. 2000-066424, No. 2000-066425, No. 2000-206715, No. 2000-206716 and No. 2001-166519).

SUMMARY OF THE INVENTION

As stated above, a film formed by polymerizing or cross-linking and curing the charge transporting compound having chain polymerizable functional groups, by irradiation with electron rays or ultraviolet rays or by heat is used in the outermost surface layer. Such an electrophotographic photosensitive member has not only secured electrical properties sufficiently but also achieved a vast improvement in mechanical strength, compared with conventional ones. However, in the actual circumstances, such an electrophotographic photosensitive member can not still be well satisfactory in some way in respect of electrical properties. In particular, a charge transporting film formed by polymerizing or cross-linking and curing a charge transporting compound having two or more chain polymerizable functional groups has had no sufficient mobility of electric charges, or has had poor tail cut-off of the movement of electric charges because of non-uniform movement of electric charges in the film. For this reason, where such a film is used in a large layer thickness or where it is used at a high process speed, it is difficult to attain sufficient electrical properties, bringing about a great difference depending on use environment in some cases. Further, such insufficiency in the movement of electric charges may have not a little an influence on various electrophotographic photosensitive member memories. In particular, it tends to cause on images the phenomenon of electrophotographic photosensitive member memory that is what is called "ghost". Thus, in the actual circumstances, the electrophotographic photosensitive member in which the film formed by polymerizing or cross-linking and curing a charge transporting compound having two or more chain polymerizable functional groups is used in the outermost surface layer still has insufficient electrical properties, and needs to be improved.

An object of the present invention is to provide an electrophotographic photosensitive member containing in its surface layer a charge transporting compound having two or more chain polymerizable functional groups, the electrophotographic photosensitive member not only securing mechanical strength sufficiently but also bringing a vast improvement in charge transport performance and well satisfying electrical properties.

Another object of the present invention is to provide a process cartridge and an electrophotographic apparatus which have the above electrophotographic photosensitive member.

The present inventors have made extensive studies taking account of the above problems. As the result, they have discovered the following, and have accomplished the present invention. As clearly seen from exemplary compounds and working examples of charge transporting compounds having two or more chain polymerizable functional groups as disclosed in, e.g., the above publications Japanese Patent Applications Laid-open No. H11-265085. No. 2000-66424, No. 2000-66425, No. 2000-206715, No. 2000-206716 and No. 2001-166519, almost all of films formed by polymerizing or cross-linking and curing the charge transporting compound having two or more chain polymerizable functional groups, by irradiation with electron rays or ultraviolet rays or by heat are so formed that a charge transporting material is directly incorporated into the backbone chain in a three-dimensional network structure film. Where the film is such a three-dimensional network structure film in which the charge transporting material is thus incorporated into the backbone chain, it is difficult to configure charge transporting materials in the state they are uniform and alike in the film. That is, the charge transporting material phases come twisted when polymerized or cross-linked and cured, where they are fairly strongly fastened and do not assume any similar steric conformations, so that charge transporting materials having energy levels different from each other may come present in the film. This causes a decrease in movement speed of electric charges, which further causes the electric charges to come trapped in some cases to make the movement of electric charges non-uniform throughout the film to cause a partial delay in the movement of electric charges, so that the tail cut-off of the movement of electric charges stands poor, as so considered.

To solve such a problem, the present inventors have considered it important that chain polymerizable functional groups are not incorporated in the charge transporting material as far as possible so as to make them freely movable to a certain extent even after curing so that closely thermodynamically stable conformations a usual low-molecular charge transporting material can assume can uniformly be assumed in the film. In particular, it influences charge transport performance greatly and is important that the chain polymerizable functional groups are not incorporated at least in two or more aryl groups among three aryl groups of a triarylamine compound having a superior charge transport performance. Further, in order to not only secure mechanical strength sufficiently but also bring out the above effect, it is very preferable to use a charge transporting compound having two or more chain polymerizable functional groups having certain specific structures. The present inventors have discovered these facts, and have accomplished the present invention.

According to the present invention, an electrophotographic photosensitive member is provided which is an electrophotographic photosensitive member having a conductive support and a photosensitive layer provided on the conductive support, wherein an outermost surface layer of the electrophotographic photosensitive member contains at least a charge transporting compound having chain polymerizable functional groups which is represented by the following general formula (1-1) or (1-2); the charge transporting compound having been polymerized or cross-linked and cured.

(1-1)

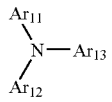

(1-2)

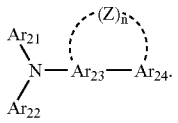

In the formula (1-1), $Ar_{11}$ and $Ar_{12}$ each represent an aryl group which may have a substituent, and $Ar_{13}$ represents a phenyl group which may have a substituent; the substituent of $Ar_{11}$ and $Ar_{12}$ each is selected from an alkyl group, an alkoxyl group, an aryloxyl group, an aralkyl group, an aryl group and a halogen atom; and the substituent of $Ar_{13}$ is selected from an alkyl group, an alkoxyl group and a halogen atom; provided that only $Ar_{13}$ has directly or through an organic residual group at least two of chain polymerizable functional groups represented by the following general formulas (2) to (6), and $Ar_{11}$ and $Ar_{12}$ may be the same or different.

In the formula (1-2), $Ar_{21}$, $Ar_{22}$ and $Ar_{24}$ each represent an aryl group which may have a substituent, and $Ar_{21}$, $Ar_{22}$ and $Ar_{24}$ may be the same or different; the substituent of $Ar_{21}$, $Ar_{22}$ and $Ar_{24}$ each is selected from an alkyl group, an alkoxyl group, an aryloxyl group, an aralkyl group, an aryl group and a halogen atom; $Ar_{23}$ represents a phenylene group which may have a substituent, which substituent is selected from an alkyl group, an alkoxyl group, an aryl group and a halogen atom; Z represents a divalent organic residual group; and n represents an integer of 0 or 1; provided that only $Ar_{24}$ has directly or through an organic residual group at least two of chain polymerizable functional groups represented by the following general formulas (2) to (6).

(2)

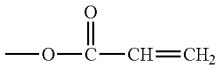

(3)

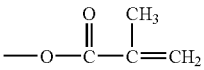

(4)

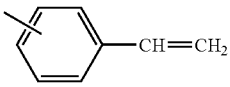

(5)

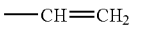

(6)

According to the present invention, a process cartridge and an electrophotographic apparatus are provided which have the above electrophotographic photosensitive member.

The use of the specific charge transporting compound of the present invention, having two or more chain polymerizable functional groups has enabled vast improvement in charge transport performance of a film formed by polymerizing or cross-linking and curing such a compound, compared with conventional ones. In virtue of this feature, the electrophotographic photosensitive member in which such a cured film is used in the outermost surface layer not only can maintain mechanical durabilities such as wear resistance and scratch resistance hitherto achievable, but also can vastly bring out initial-stage electrical properties of course and stable performance even when used repeatedly, and further can keep its properties less undergoing environmental changes, and vastly remedy memories such as ghost compared with conventional ones. Thus, this has enabled an electrophotographic photosensitive member to be provided which can provide very highly durable, very highly stable and very high-quality images. This further has enabled an electrophotographic photosensitive member to be provided which has less dependence of process speed.

The effect to be brought by this electrophotographic photosensitive member is of course likewise brought out also in the process cartridge and the electrophotographic apparatus which have this electrophotographic photosensitive member, and high-quality images can be maintained at a high durability and a high stability.

Further features of the present invention will become apparent from the following description of exemplary embodiments with reference to the attached drawings.

DESCRIPTION OF THE EMBODIMENTS

Figure 1:
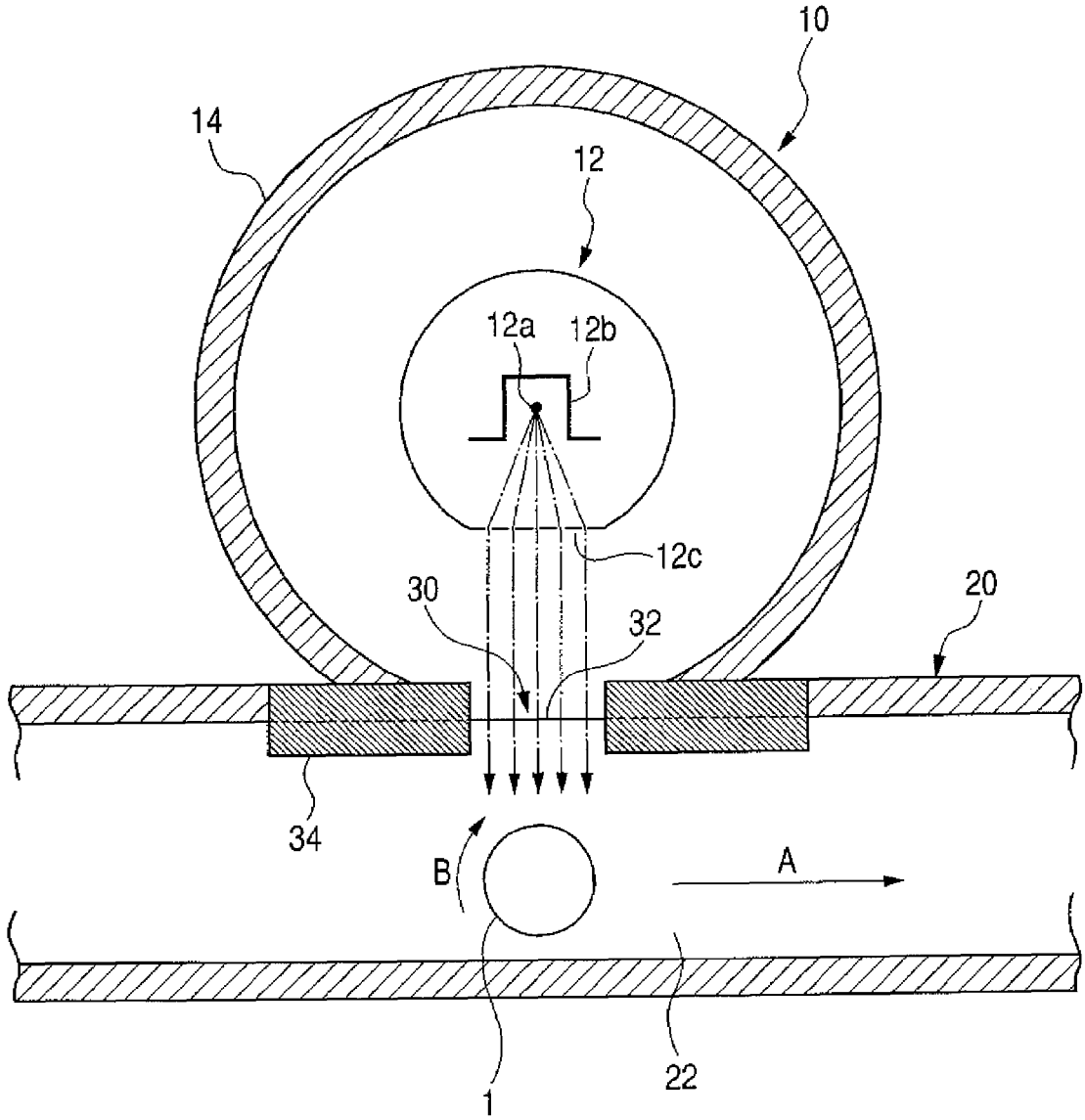
FIG. 1 is a schematic structural view showing an example of an electron ray irradiator used to produce the electrophotographic photosensitive member of the present invention.

Embodiments in practicing the present invention are described below in greater detail.

The electrophotographic photosensitive member of the present invention, having a photosensitive layer which is provided on a conductive support is characterized in that its outermost surface layer contains at least a charge transporting compound having chain polymerizable functional groups which is represented by the following general formula (1-1) or (1-2); the charge transporting compound having been polymerized or cross-linked and cured.

(1-1)

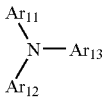

(1-2)

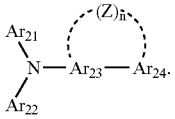

In the formula (1-1), $Ar_{11}$ and $Ar_{12}$ each represent an aryl group which may have a substituent, and $Ar_{13}$ represents a phenyl group which may have a substituent. The aryl group represented by $Ar_{11}$ and $Ar_{12}$ each may include a phenyl group, a naphthyl group, an anthryl group, a phenanthryl group, a pyrenyl group, a biphenyl group, a fluorenyl group, a carbazolyl group, a benzofuryl group, a benzothiophenyl group, a dibenzofuryl group and a dibenzothiophenyl group. The substituent the $Ar_{11}$ and $Ar_{12}$ may each have is selected from alkyl groups such as a methyl group, an ethyl group, a n-propyl group, an iso-propyl group, a n-butyl group, a t-butyl group, a n-hexyl group and a cyclohexyl group, preferably an alkyl group having 1 to 8 carbon atoms; alkoxyl groups such as a methoxyl group, an ethoxyl group and a propoxyl group; aryloxyl groups such as a phenoxyl group and a naphthoxyl group; aralkyl groups such as a benzyl group, a phenethyl group, a naphthylmethyl group, a furfuryl group and a thienyl group; aryl groups such as a phenyl group, a naphthyl group, an anthryl group and a pyrenyl group; and halogen atoms such as a fluorine atom, a chlorine atom, a bromine atom and an iodine atom. The substituent the $Ar_{13}$ may have is selected from the alkyl group, alkoxyl group and halogen atom the above $Ar_{11}$ and $Ar_{12}$ may each have. $Ar_{11}$ and $Ar_{12}$ may be the same or different. The foregoing applies provided that only $Ar_{13}$ has directly or through an organic residual group at least two of chain polymerizable functional groups represented by the following general formulas (2) to (6).

In the formula (1-2), $Ar_{21}$, $Ar_{22}$ and $Ar_{24}$ each represent an aryl group which may have a substituent, and $Ar_{21}$, $Ar_{22}$ and $Ar_{24}$ may be the same or different. The aryl group represented by $Ar_{21}$, $Ar_{22}$ and $Ar_{24}$ may each include a phenyl group, a naphthyl group, an anthryl group, a phenanthryl group, a pyrenyl group, a biphenyl group, a fluorenyl group, a carbazolyl group, a benzofuryl group, a benzothiophenyl group, a dibenzofuryl group and a dibenzothiophenyl group.

The substituent of $Ar_{21}$, $Ar_{22}$ and $Ar_{24}$ each is selected from alkyl groups such as a methyl group, an ethyl group, a n-propyl group, an iso-propyl group, a n-butyl group, a t-butyl group, a n-hexyl group and a cyclohexyl group, preferably an alkyl group having 1 to 8 carbon atoms; alkoxyl groups such as a methoxyl group, an ethoxyl group and a propoxyl group; aryloxyl groups such as a phenoxyl group and a naphthoxyl group; aralkyl groups such as a benzyl group, a phenethyl group, a naphthylmethyl group, a furfuryl group and a thienyl group; aryl groups such as a phenyl group, a naphthyl group, an anthryl group and a pyrenyl group; and halogen atoms such as a fluorine atom, a chlorine atom, a bromine atom and an iodine atom.

$Ar_{23}$ represents a phenylene group which may have a substituent, which substituent is selected from alkyl groups such as a methyl group, an ethyl group, a n-propyl group, an iso-propyl group, a n-butyl group, a t-butyl group, a n-hexyl group and a cyclohexyl group, preferably an alkyl group having 1 to 8 carbon atoms; alkoxyl groups such as a methoxyl group, an ethoxyl group and a propoxyl group; aryl groups such as a phenyl group, a naphthyl group, an anthryl group and a pyrenyl group; and halogen atoms such as a fluorine atom, a chlorine atom, a bromine atom and an iodine atom.

Z represents a divalent organic residual group, and represents, e.g., an oxygen atom, a carbonyl group, a sulfur atom, —CH═CH—, —$CH_2$—$CH_2$— or a group represented by the following general formula (11), and preferably —CH═CH—, —$CH_2$—$CH_2$— or a group represented by the following general formula (11). Letter symbol n represents an integer of 0 or 1.

(11)

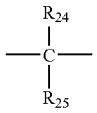

$R_{24}$ and $R_{25}$ each represent an alkyl group which may have a substituent, an aralkyl group which may have a substituent, an aryl group which may have a substituent, or a hydrogen atom, and $R_{24}$ and $R_{25}$ may be the same or different. The substituents are each selected from an alkyl group, an aralkyl group, an aryl group and a halogen atom.

The foregoing applies provided that only $Ar_{24}$ has directly or through an organic residual group at least two of chain polymerizable functional groups represented by the following general formulas (2) to (6).

(2)

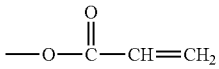

(3)

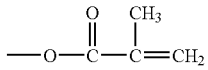

(4)

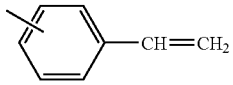

(5)

(6)

In the charge transporting compound having chain polymerizable functional groups which is represented by the general formula (1-1), having the above specific structure, a compound represented by the following general formula (7) or (9) is more preferred in order to solve the problems discussed above.

(7)

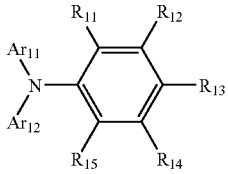

In the formula, $Ar_{11}$ and $Ar_{12}$ each represent an aryl group such as a phenyl group, a naphthyl group, an anthryl group, a phenanthryl group, a pyrenyl group and a biphenyl group, which may have a substituent, which substituent is selected from alkyl groups such as a methyl group, an ethyl group, a n-propyl group, an iso-propyl group, a n-butyl group, a t-butyl group, a n-hexyl group and a cyclohexyl group, preferably an alkyl group having 1 to 8 carbon atoms; alkoxyl groups such as a methoxyl group, an ethoxyl group and a propoxyl group; and aryl groups such as a phenyl group, a naphthyl group and an anthryl group. $Ar_{11}$ and $Ar_{12}$ may be the same or different.

$R_{11}$ to $R_{15}$ are selected from a hydrogen atom, alkyl groups such as a methyl group, an ethyl group, a n-propyl group, an iso-propyl group, a n-butyl group, a t-butyl group, a n-hexyl group and a cyclohexyl group, preferably an alkyl group having 1 to 8 carbon atoms, alkoxyl groups such as a methoxyl group, an ethoxyl group and a propoxyl group, and a group represented by the following general formula (8); and $R_{11}$ to $R_{15}$ may be the same or different, provided that at least two of $R_{11}$ to $R_{15}$ are each a group represented by the following general formula (8).

$$-(X_{11})_a-P_{11} \quad (8)$$

In the formula, $X_{11}$ represents a divalent organic residual group which may have a substituent, which substituent is selected from an alkyl group, an aralkyl group, an aryl group and a halogen atom; and a represents an integer of 0 or 1. $P_{11}$ represents any of the chain polymerizable functional groups represented by the above general formulas (2) to (6). As the organic residual group the $X_{11}$ represents, more preferred is especially a case in which it is an oxygen atom, —O-$Z_{11}$- ($Z_{11}$ is a divalent alkylene group), or a divalent alkylene group.

(9)

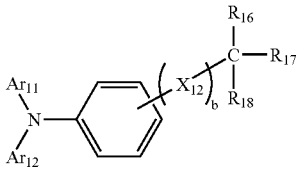

In the formula, $Ar_{11}$ and $Ar_{12}$ are each as defined in the above general formula (7); $X_{12}$ represents a divalent alkylene group which may have a substituent, an oxygen atom or —O-$Z_{12}$- ($Z_{12}$ is a divalent alkylene group); and b is an integer of 0 or 1. $R_{16}$ to $R_{18}$ each represent an aryl group such as a phenyl group, a naphthyl group, an anthryl group, a phenanthryl group, a pyrenyl group or a biphenyl group, which may have a substituent; an alkyl group such as a methyl group, an ethyl group, a n-propyl group, an isopropyl group, a n-butyl group, a t-butyl group, a n-hexyl group or a cyclohexyl group, preferably an alkyl group having 1 to 8 carbon atoms, which may have a substituent; an aralkyl group such as a benzyl group, a phenethyl group, a naphthylmethyl group, a furfuryl group or a thienyl group, which may have a substituent; an aryloxyl group such as a phenoxyl group or a naphthoxyl group, which may have a substituent; a hydrogen atom; or a group represented by the above general formula (8). $R_{16}$ to $R_{18}$ may be the same or different. The substituent the $R_{16}$ to $R_{18}$ each may have is selected from an alkyl group, an aralkyl group, an aryl group, a halogen atom and a group represented by the above general formula (8). The foregoing applies provided that any of $R_{16}$ to $R_{18}$ has at least two of the chain polymerizable functional groups represented by the above general formulas (2) to (6). Incidentally, preferred is a case in which $R_{16}$ and $R_{17}$ in the above general formula (9) are each a group represented by the above general formula (8) and, further, more preferred is a case in which, in the general formula (8), a is 1 and $X_{11}$ is an alkylene group.

Still further, particularly preferred is a case in which $Ar_{11}$ and $Ar_{12}$ of the charge transporting compound having chain polymerizable functional groups which is represented by the above general formula (1-1), (7) or (9) are each a phenyl group which may have a substituent, a biphenyl group which may have a substituent or a fluorenyl group which may have a substituent. In this case, $Ar_{11}$ and $Ar_{12}$ may be the same or different, and the substituents of $Ar_{11}$ and $Ar_{12}$ are each an alkyl group or an alkoxyl group.

As the chain polymerizable functional groups, what are particularly preferred are those represented by the general formulas (2) and (3) in view of the achievement of both the curing rate and mechanical strength and the electrical properties.

Meanwhile, in the charge transporting compound having chain polymerizable functional groups which is represented by the general formula (1-2), having the above specific structure, a compound represented by the following general formula (10) or (13) is more preferred in order to solve the problems discussed above.

(10)

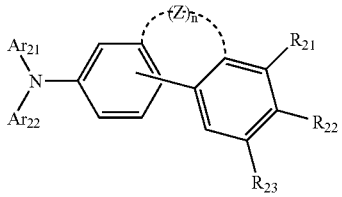

In the formula, $Ar_{21}$ and $Ar_{22}$ are each as defined in the above general formula (1-2); z represents —CH═CH—, —$CH_2$—$CH_2$— or a group represented by the above general formula (11), and n represents an integer of 0 or 1. $R_{21}$ to $R_{23}$ each represent a hydrogen atom, an alkyl group such as a methyl group, an ethyl group, a n-propyl group, an isopropyl group, a n-butyl group, a t-butyl group, a n-hexyl group or a cyclohexyl group, preferably an alkyl group having 1 to 8 carbon atoms, an alkoxyl group such as a methoxyl group, an ethoxyl group or a propoxyl group, or a group represented by the following general formula (12); and $R_{21}$ to $R_{23}$ may be the same or different, provided that at least two of $R_{21}$ to $R_{23}$ are each a group represented by the following general formula (12). In the general formula (11), $R_{24}$ and $R_{25}$ each represent an alkyl group which may have a substituent, an aralkyl group which may have a substituent, an aryl group which may have a substituent, or a hydrogen atom, and $R_{24}$ and $R_{25}$ may be the same or different. The substituents are each selected from an alkyl group, an aralkyl group, an aryl group and a halogen atom.

$$-(X_{21})_a-P_{21} \quad (12)$$

In the formula, $X_{21}$ represents a divalent organic residual group which may have a substituent, which substituent is selected from an alkyl group, an aralkyl group, an aryl group and a halogen atom; and a represents an integer of 0 or 1. As the organic residual group the $X_{21}$ represents, more preferred is especially a case in which it is an oxygen atom, a divalent alkylene group or —O-$Z_{21}$- ($Z_{21}$ is a divalent alkylene group). $P_{21}$ represents any one of the chain polymerizable functional groups represented by the above general formulas (2) to (6).

(13)

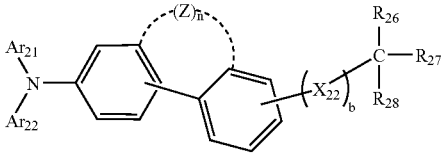

In the formula, Z, $Ar_{21}$, $Ar_{22}$ and n are each as defined in the above general formula (1-2); $X_{22}$ represents a divalent organic residual group, and, in particular, a case is preferred in which it is a divalent alkylene group which may have a substituent, an oxygen atom or —O-$Z_{22}$- ($Z_{22}$ is a divalent alkylene group); and b is an integer of 0 or 1. $R_{26}$ to $R_{28}$ each represent an aryl group such as a phenyl group, a naphthyl group, an anthryl group, a phenanthryl group, a pyrenyl group or a biphenyl group, which may have a substituent; an alkyl group such as a methyl group, an ethyl group, a n-propyl group, an iso-propyl group, a n-butyl group, a t-butyl group, a n-hexyl group or a cyclohexyl group, preferably an alkyl group having 1 to 8 carbon atoms, which may have a substituent; an aralkyl group such as a benzyl group, a phenethyl group, a naphthylmethyl group, a furfuryl group or a thienyl group, which may have a substituent; an aryloxyl group such as a phenoxyl group or a naphthoxyl group, which may have a substituent; a hydrogen atom; or a group represented by the above general formula (12). $R_{26}$ to $R_{28}$ may be the same or different. The substituent the $R_{26}$ to $R_{28}$ each may have is selected from an alkyl group, an aralkyl group, an aryl group, a halogen atom and a group represented by the above general formula (12). The foregoing applies provided that any of $R_{26}$ to $R_{28}$ has at least two of the chain polymerizable functional groups represented by the above general formulas (2) to (6). Incidentally, preferred is a case in which $R_{26}$ and $R_{27}$ in the above general formula (13) are each a group represented by the above general formula (12) and, further, more preferred is a case in which, in the general formula (12), a is 1 and $X_{21}$ is an alkylene group.

Still further, particularly preferred is a case in which $Ar_{21}$ and $Ar_{22}$ of the charge transporting compound having chain polymerizable functional groups which is represented by the above general formula (1-2), (10) or (13) are each a phenyl group which may have a substituent, a biphenyl group which may have a substituent or a fluorenyl group which may have a substituent. In this case, $Ar_{21}$ and $Ar_{22}$ may be the same or different, and the substituents of $Ar_{21}$ and $Ar_{22}$ are each an alkyl group or an alkoxyl group.

As the chain polymerizable functional groups, what are particularly preferred are those represented by the general formulas (2) and (3) in view of the achievement of both the curing rate and mechanical strength and the electrical properties.

The outermost surface layer of the electrophotographic photosensitive member of the present invention may preferably be cured by electron rays.

The present invention provides a process cartridge which comprises the electrophotographic photosensitive member described herein, and at least one means selected from the group consisting of a charging means which charges the electrophotographic photosensitive member electrostatically, a developing means which develops with a toner an electrostatic latent image formed on the electrophotographic photosensitive member, and a cleaning means which collects the toner remaining on the electrophotographic photosensitive member after the step of transfer; the process cartridge being detachably mountable to the main body of an electrophotographic apparatus.

The present invention further provides an electrophotographic apparatus which comprises the electrophotographic photosensitive member described herein; a charging means which charges the electrophotographic photosensitive member electrostatically; an exposure means which performs exposure on the electrophotographic photosensitive member thus charged, to form an electrostatic latent image; a developing means which develops with a toner the electrostatic latent image formed on the electrophotographic photosensitive member, to form a toner image; and a transfer means which transfers to a transfer material the toner image formed on the electrophotographic photosensitive member.

Specific examples of the charge transporting compound represented by the general formula (1-1), having specific chain polymerizable functional groups, as used in the present invention are shown in Table 1. Note, however, that the compound is by no means limited to these and also the present invention is by no means limited by these.

TABLE 1

| Exemplary Compound | |
|---|---|
| No. | Exemplary Compound |
| 1 | 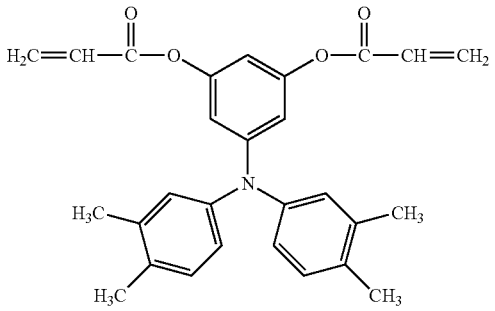 |

TABLE 1-continued
| No. | Exemplary Compound |
|---|---|
| 2 | 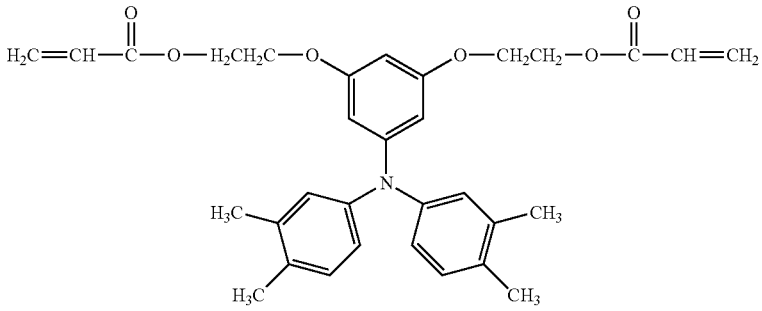 |
| 3 | 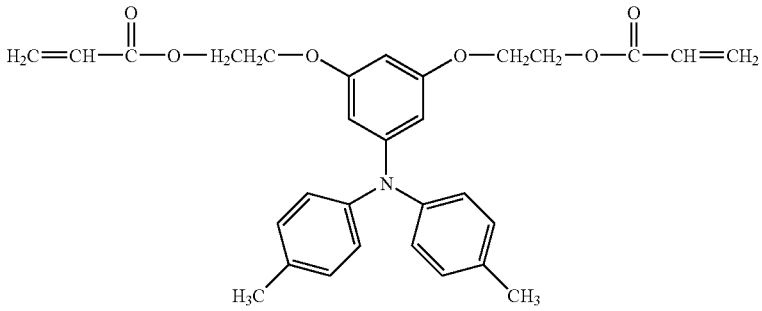 |
| 4 | 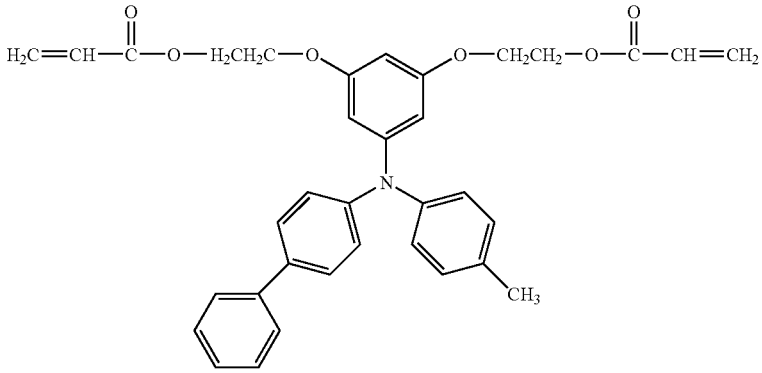 |
| 5 | 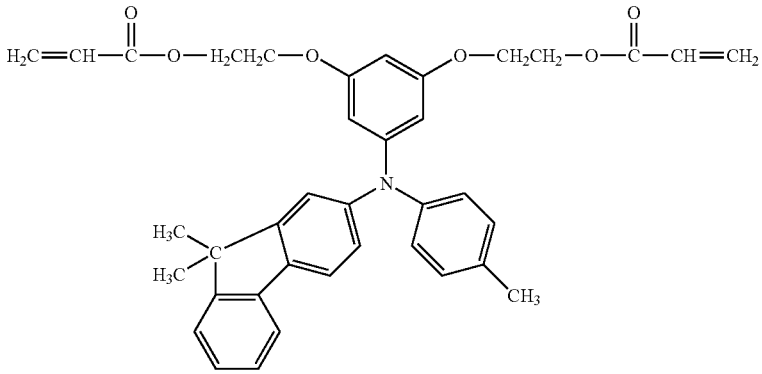 |

TABLE 1-continued
| No. | Exemplary Compound<br>Exemplary Compound |
|---|---|
| 6 | 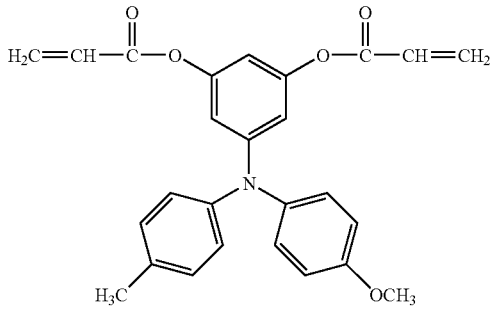 |
| 7 | 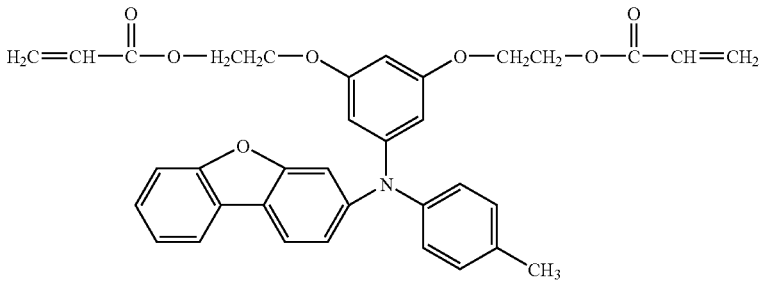 |
| 8 | 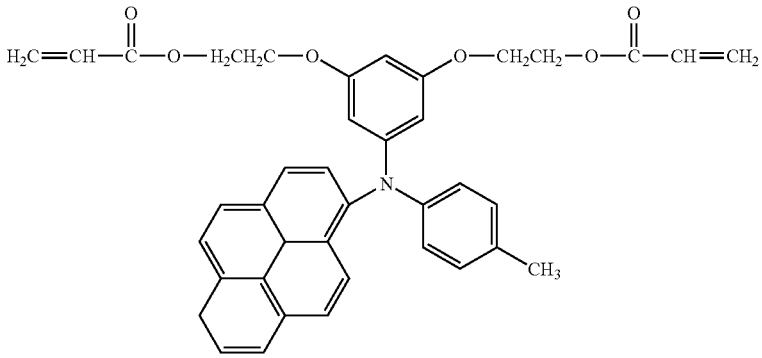 |
| 9 | get,1813 |
| 10 | get,1814 |
| 11 | get,1815 |
| 12 | get,1816 |
| 13 | 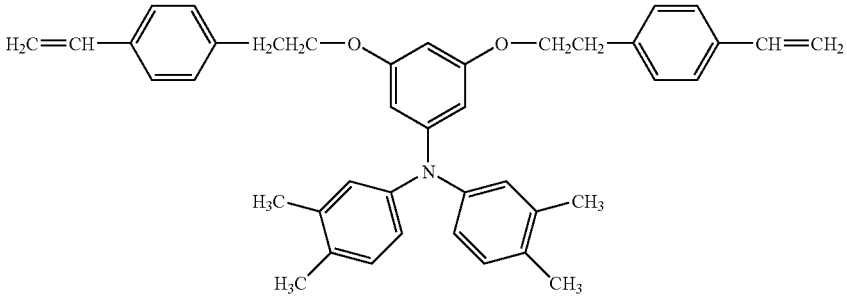 |

TABLE 1-continued
| No. | Exemplary Compound<br>Exemplary Compound |
|---|---|
| 14 | 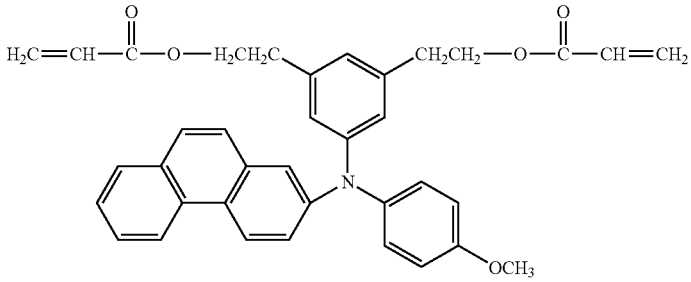 |
| 15 | 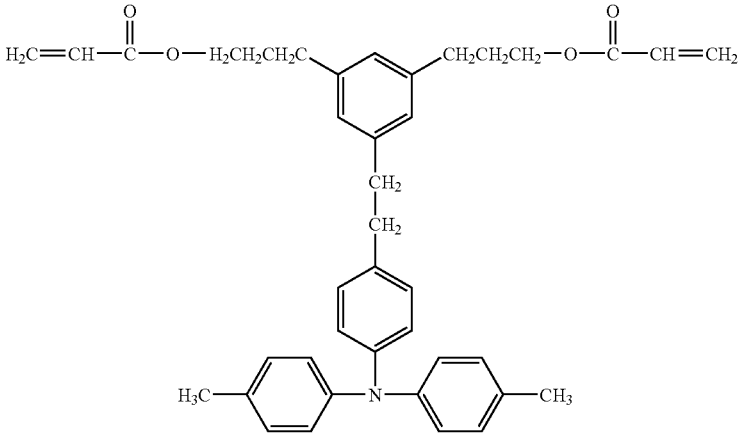 |
| 16 | 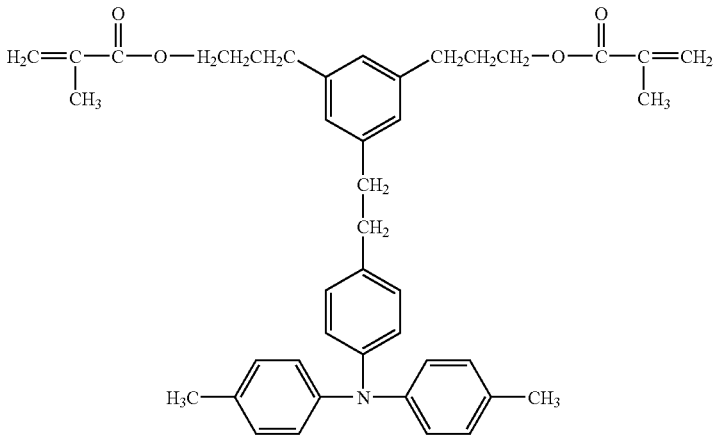 |

TABLE 1-continued
| No. | Exemplary Compound<br>Exemplary Compound |
|---|---|
| 17 | 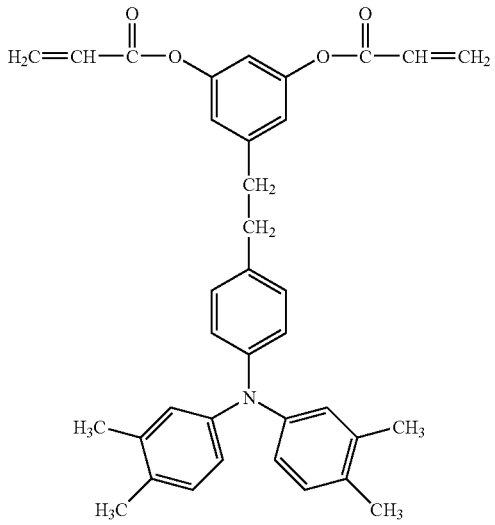 |
| 18 | 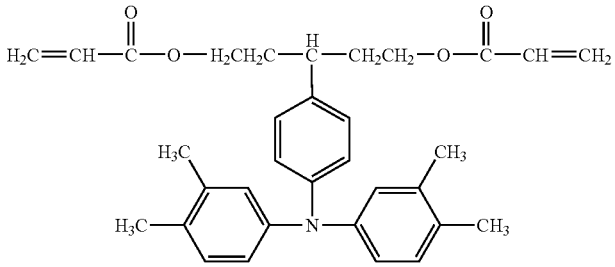 |
| 19 | 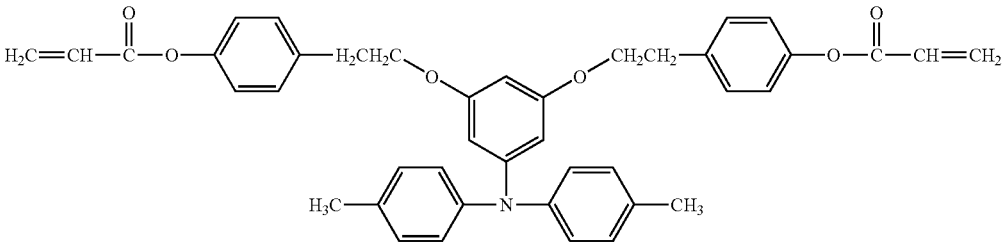 |
| 20 | 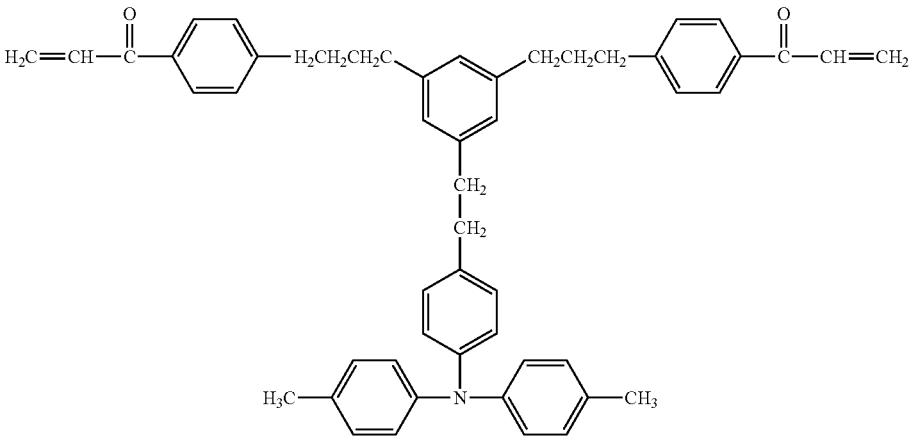 |

TABLE 1-continued
| No. | Exemplary Compound<br>Exemplary Compound |
|---|---|
| 21 | 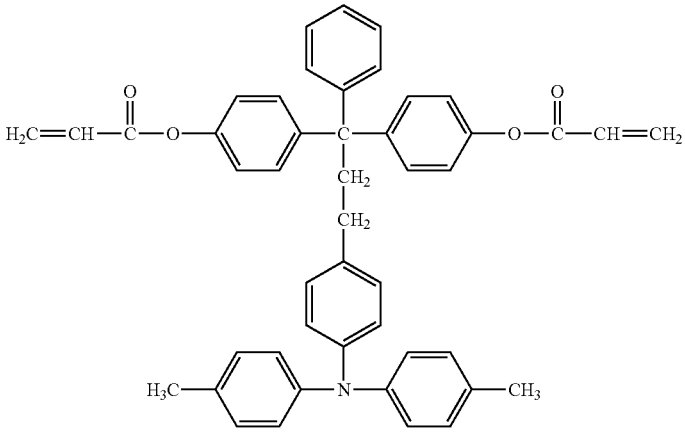 |
| 22 | 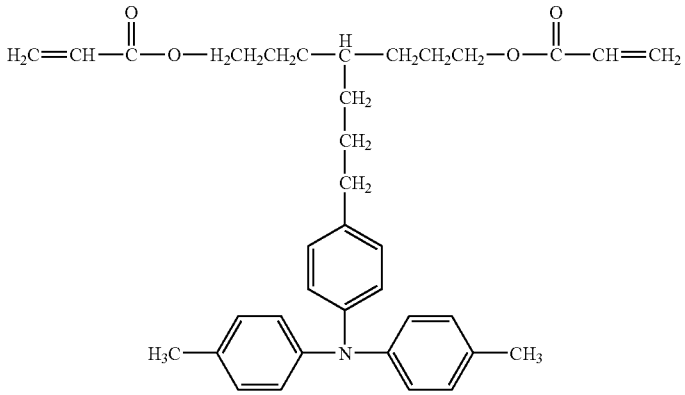 |
| 23 | 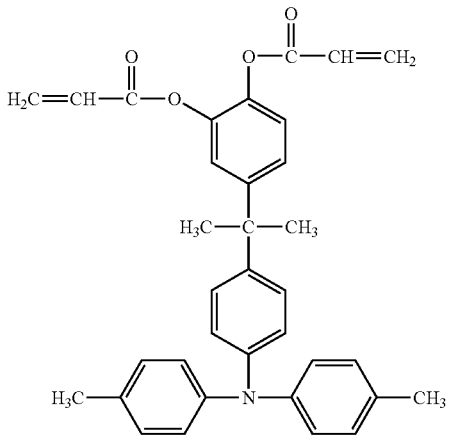 |

TABLE 1-continued
| No. | Exemplary Compound<br>Exemplary Compound |
|---|---|
| 24 | 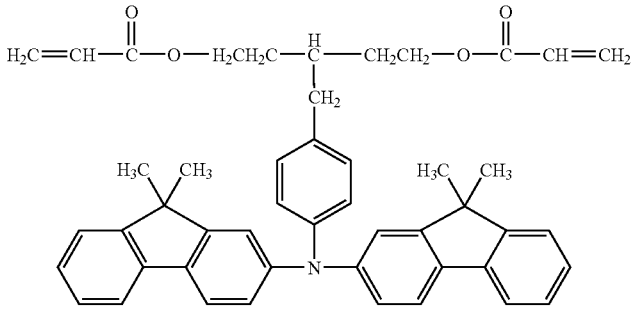 |
| 25 | 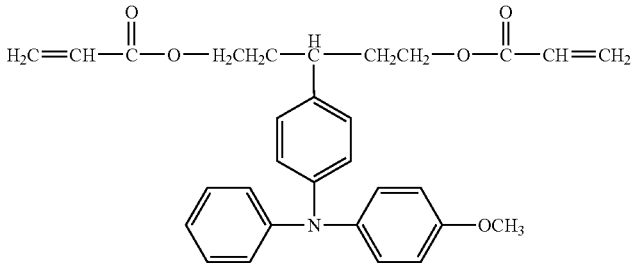 |
| 26 | 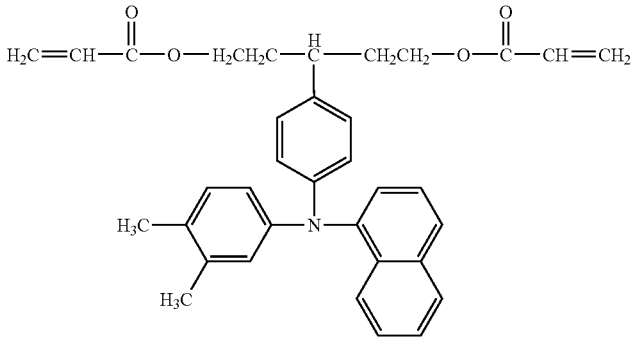 |
| 27 | 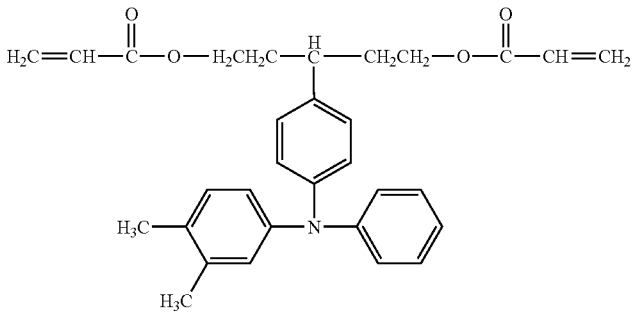 |

TABLE 1-continued
| No. | Exemplary Compound |
|---|---|
| 28 | 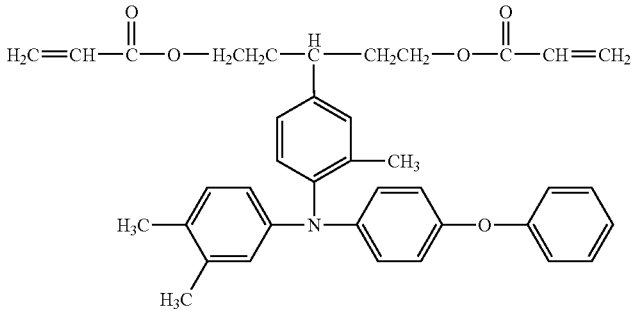 |
| 29 | 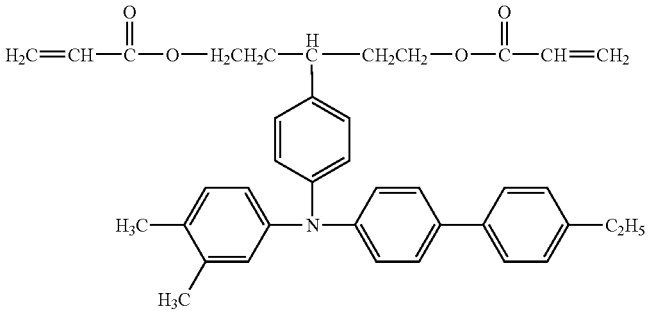 |
| 30 | 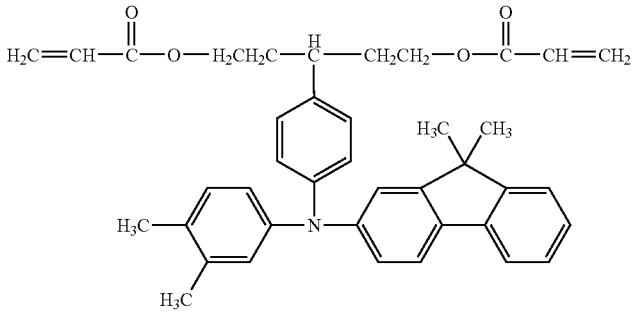 |
| 31 | 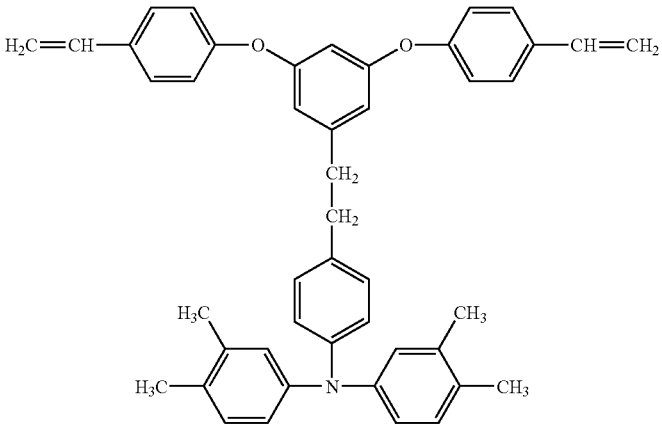 |

TABLE 1-continued
| Exemplary Compound | |
|---|---|
| No. | Exemplary Compound |
| 32 | 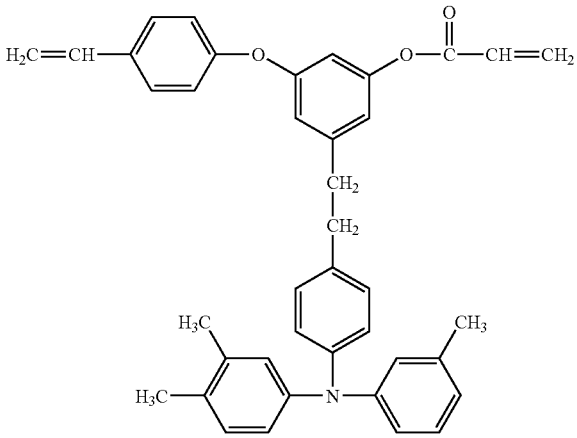 |
| 33 | 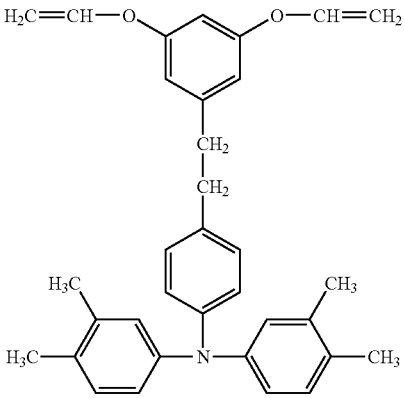 |
| 34 | 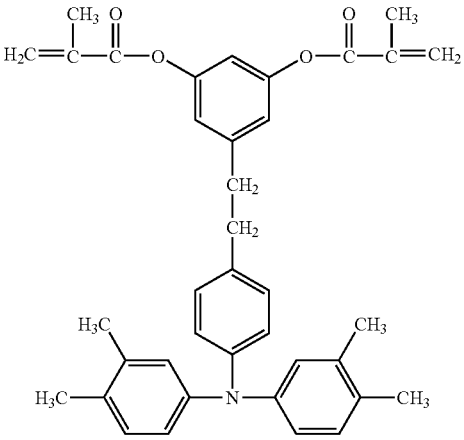 |

TABLE 1-continued
| Exemplary Compound | |
|---|---|
| No. | Exemplary Compound |
| 35 | 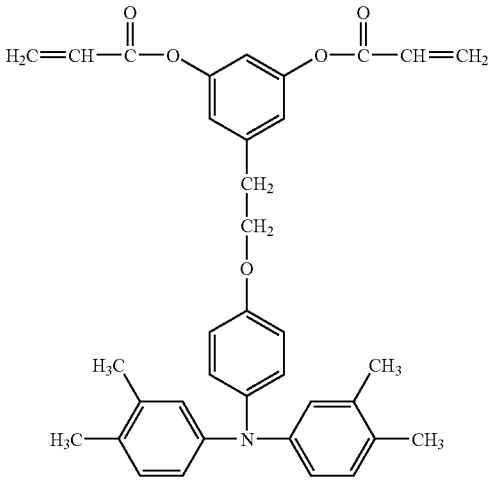 |
| 36 | 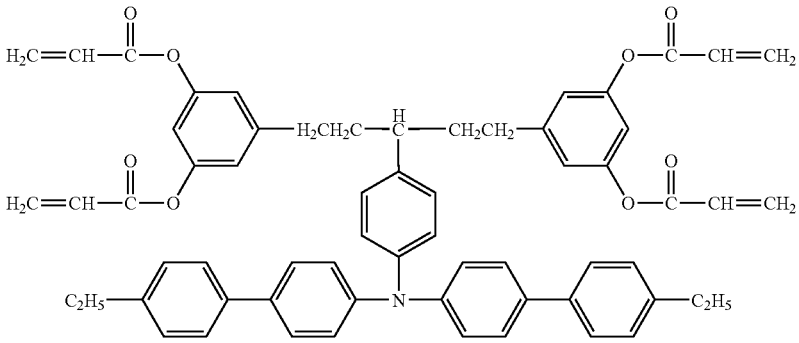 |
| 37 | 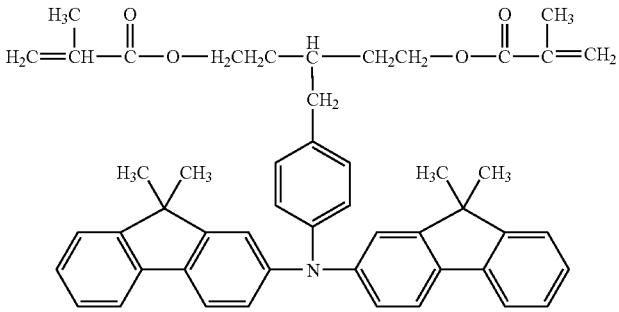 |

TABLE 1-continued
| No. | Exemplary Compound<br>Exemplary Compound |
|---|---|
| 38 | 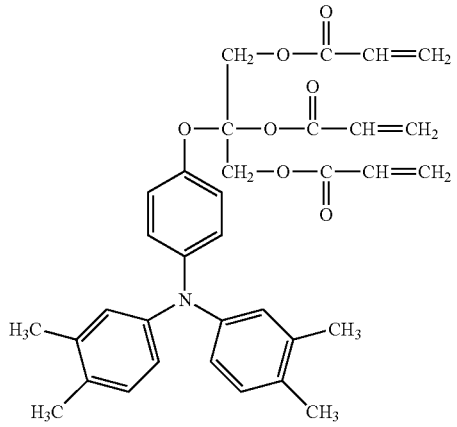 |
| 39 | 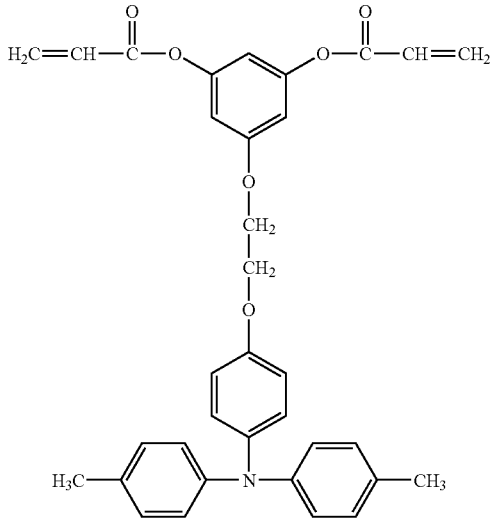 |
| 40 | 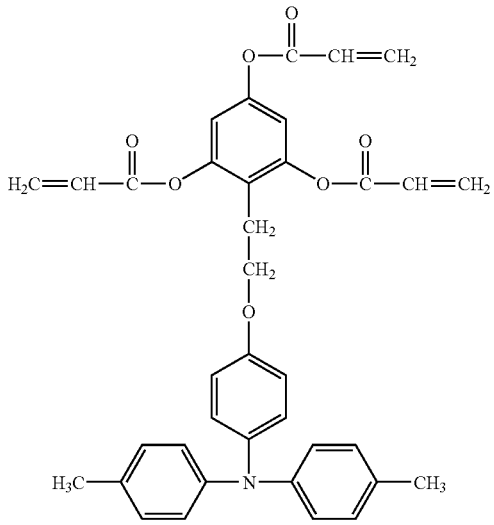 |

Specific examples of the charge transporting compound represented by the general formula (1-2), having specific chain polymerizable functional groups, as used in the present invention are shown in Table 2. Note, however, that the compound is by no means limited to these and also the present invention is by no means limited by these.

TABLE 2

| | Exemplary Compound |
|---|---|
| No. | Exemplary Compound |
| 41 | get,1817 |
| 42 | get,1818 |
| 43 | get,1819 |
| 44 | get,1820 |
| 45 | get,1821 |
| 46 | 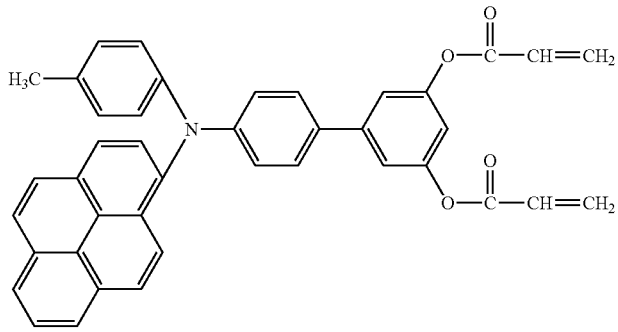 |
| 47 | 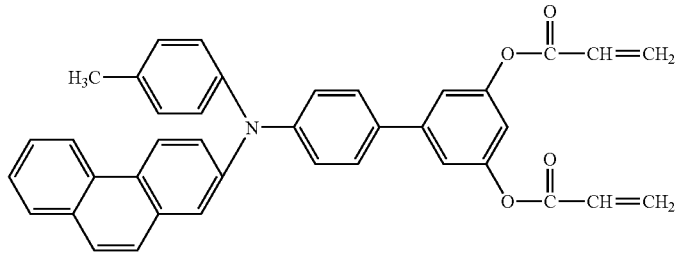 |
| 48 | 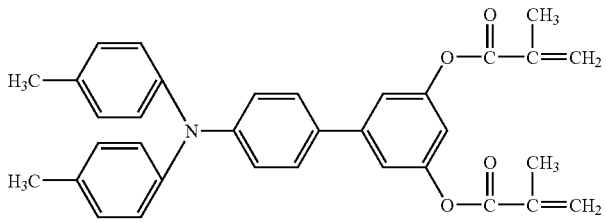 |
| 49 | 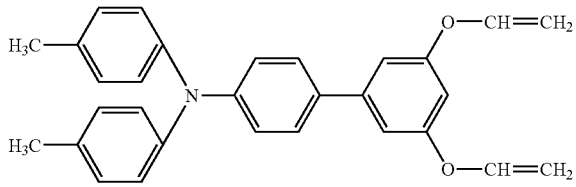 |

TABLE 2-continued
| No. | Exemplary Compound<br>Exemplary Compound |
|---|---|
| 50 | 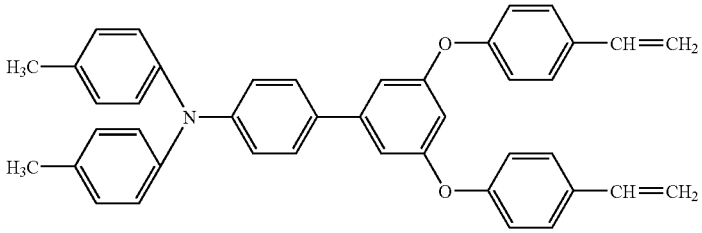 |
| 51 | 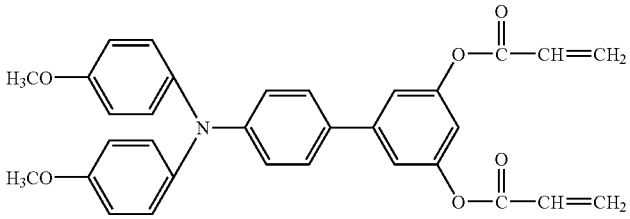 |
| 52 | 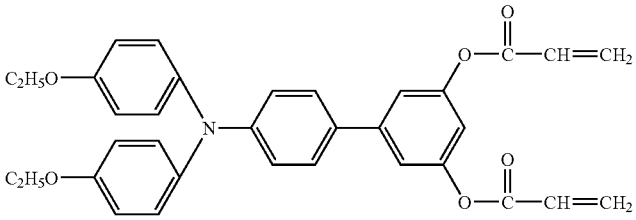 |
| 53 | 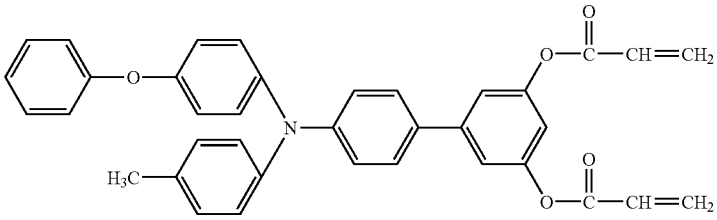 |
| 54 | 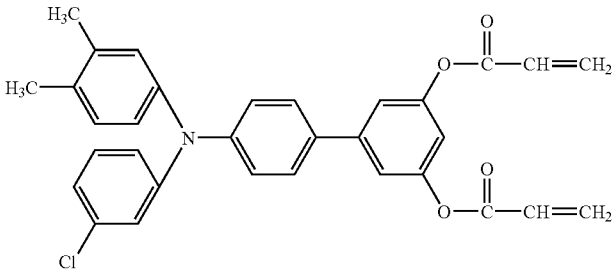 |
| 55 | 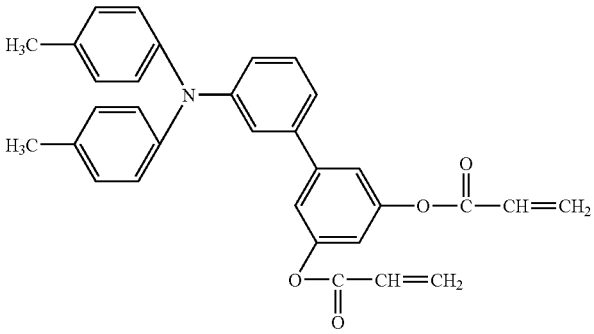 |

TABLE 2-continued
| No. | Exemplary Compound |
|---|---|
| 56 | 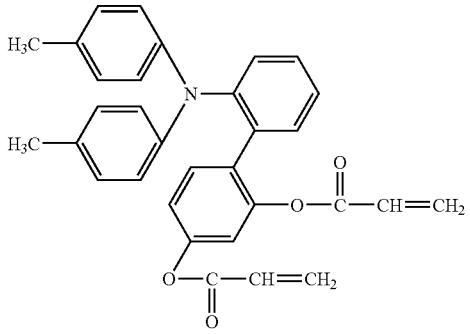 |
| 57 | 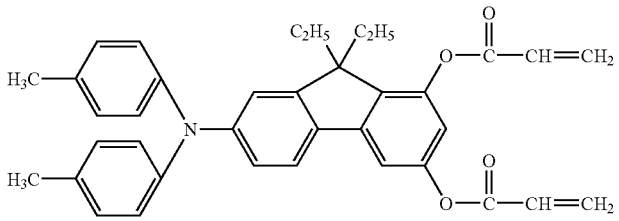 |
| 58 | 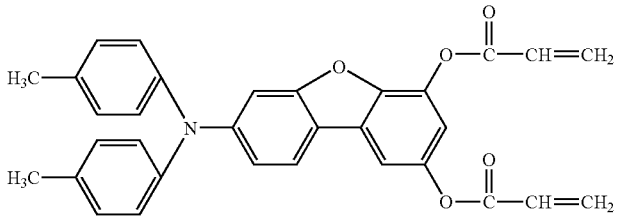 |
| 59 | 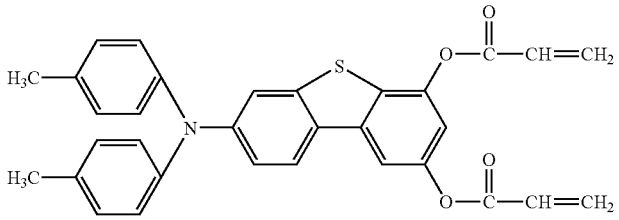 |
| 60 | 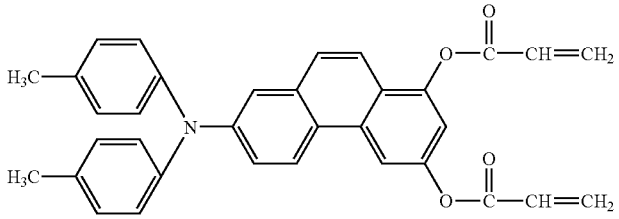 |

TABLE 2-continued
| No. | Exemplary Compound |
|---|---|
| 61 | 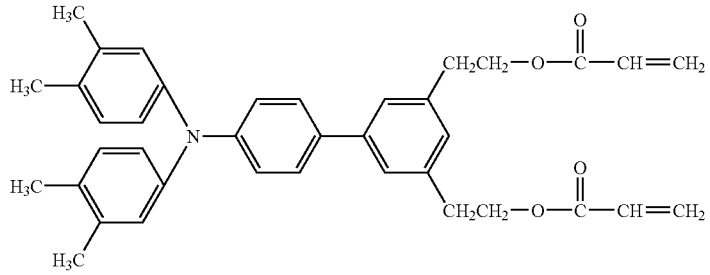 |
| 62 | 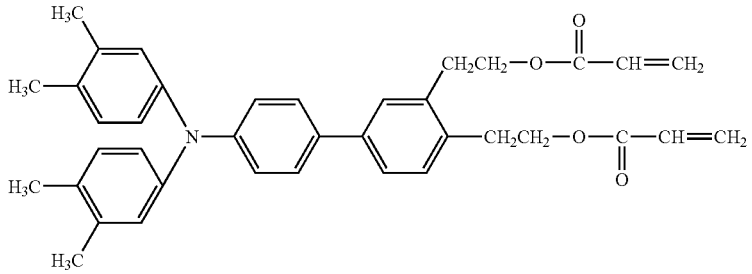 |
| 63 | 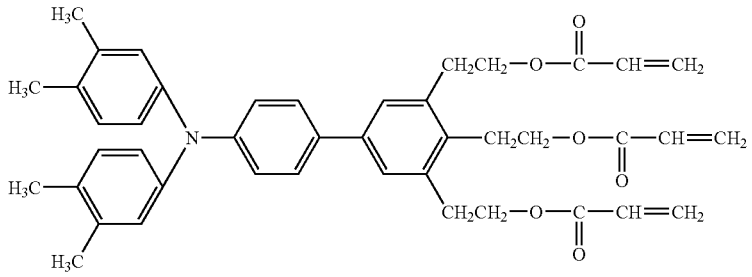 |
| 64 | 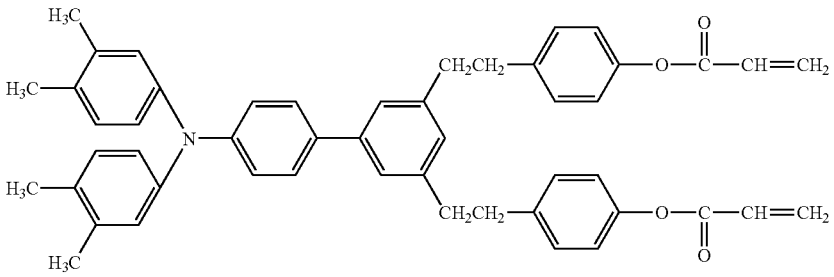 |
| 65 | 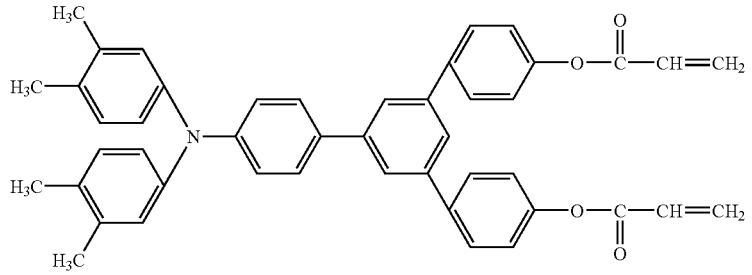 |

TABLE 2-continued
| No. | Exemplary Compound |
|---|---|
| 66 | 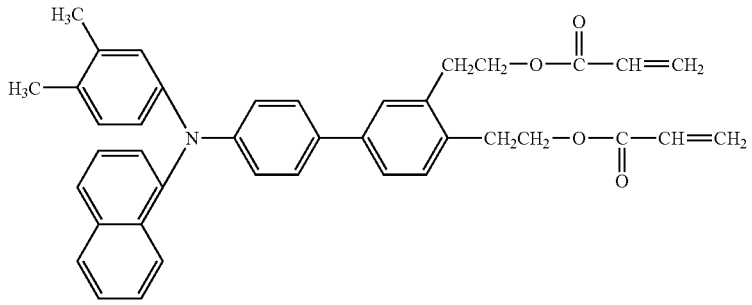 |
| 67 | 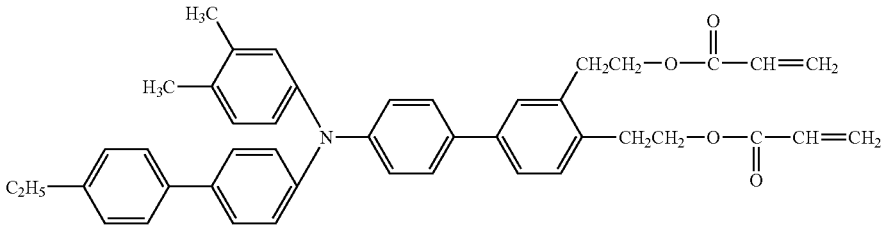 |
| 68 | 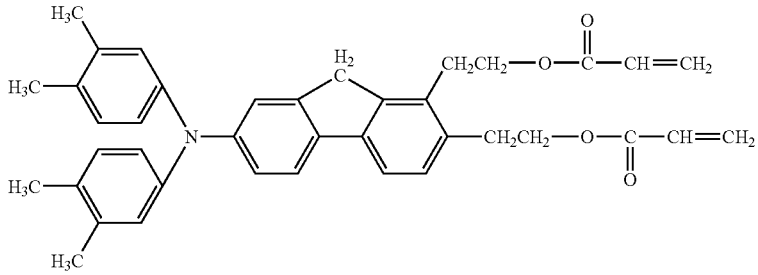 |
| 69 | 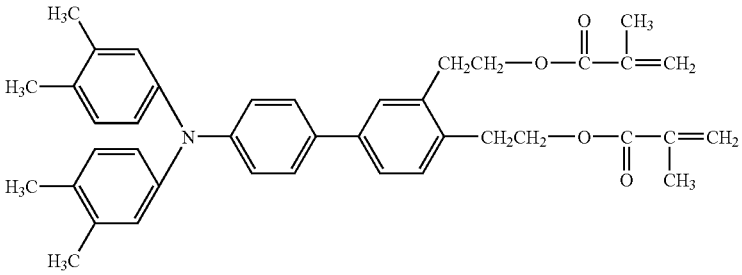 |
| 70 | 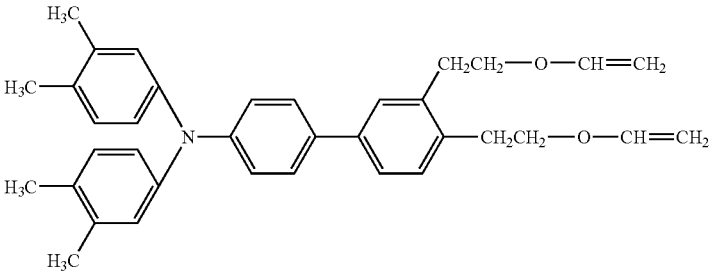 |

TABLE 2-continued
| No. | Exemplary Compound |
|---|---|
| 71 | 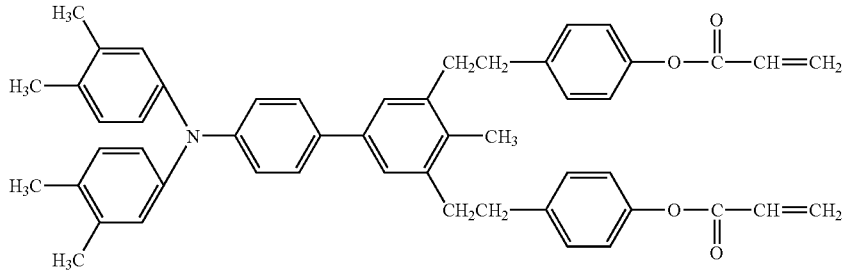 |
| 72 | 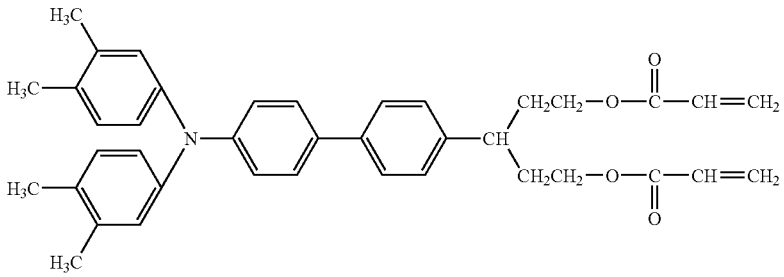 |
| 73 | 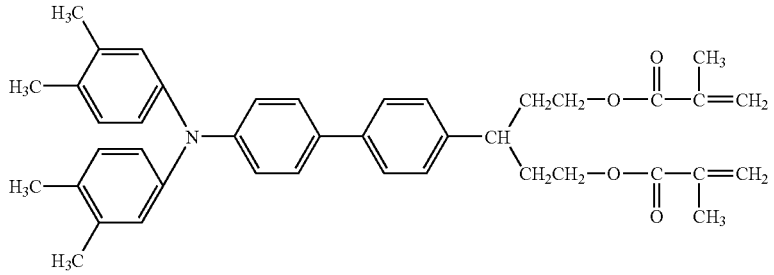 |
| 74 | 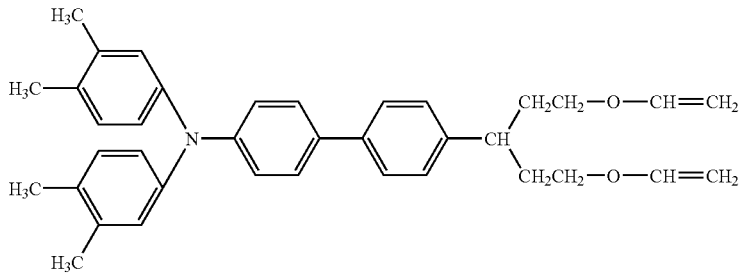 |
| 75 | 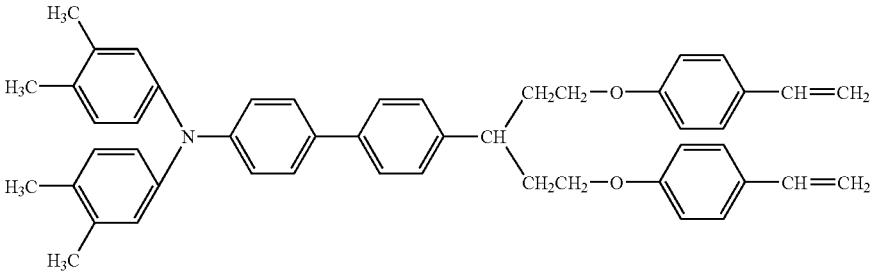 |

TABLE 2-continued
| No. | Exemplary Compound<br>Exemplary Compound |
|---|---|
| 76 | 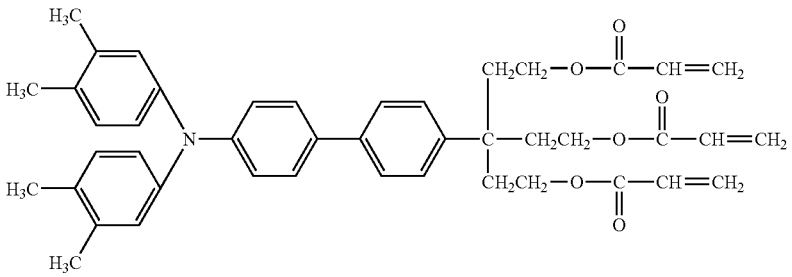 |
| 77 | 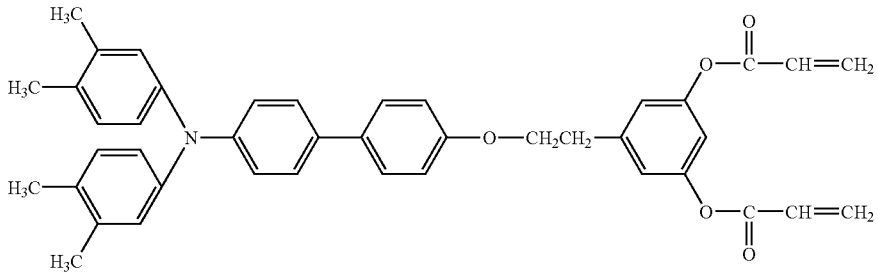 |
| 78 | 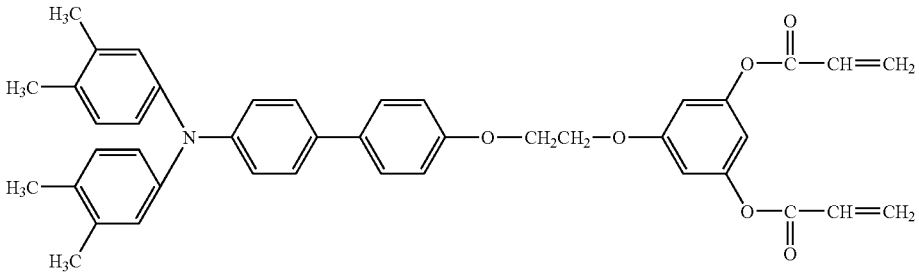 |
| 79 | 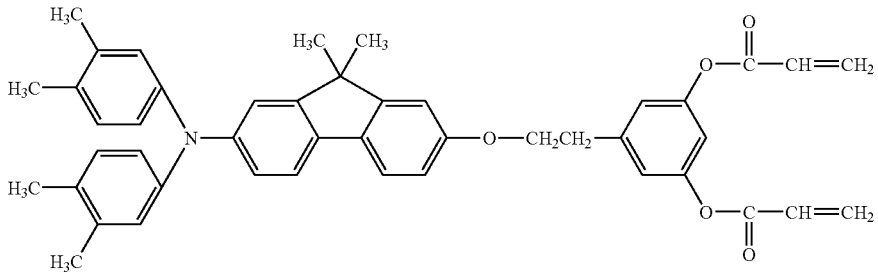 |
| 80 | 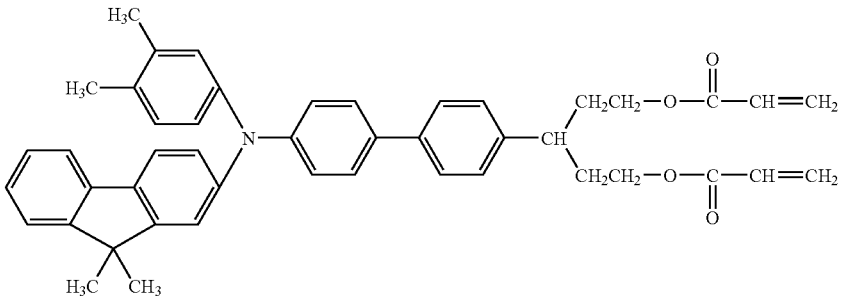 |

TABLE 2-continued
| No. | Exemplary Compound |
|---|---|
| 81 | 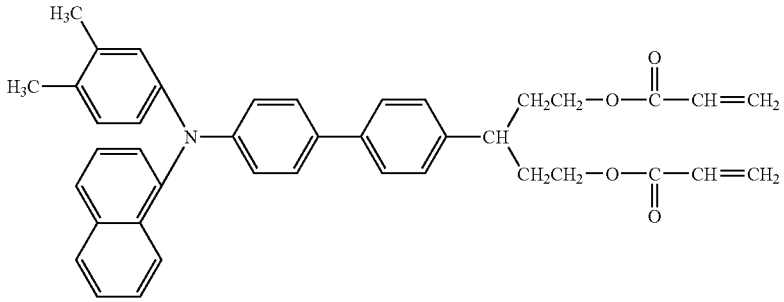 |
| 82 | 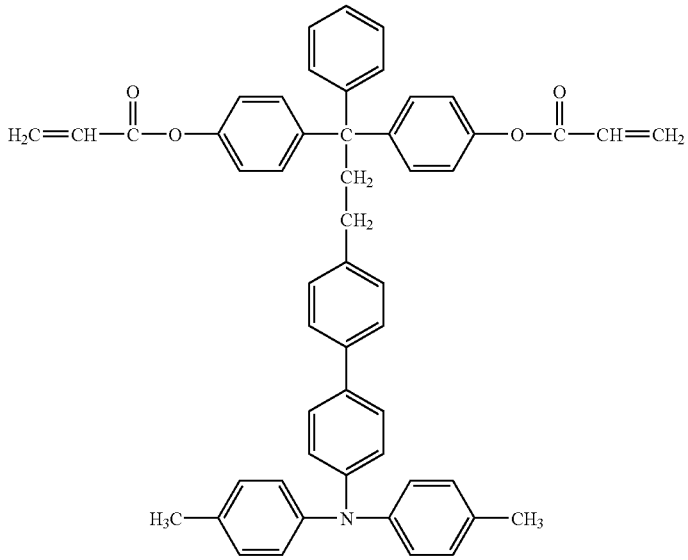 |
| 83 | 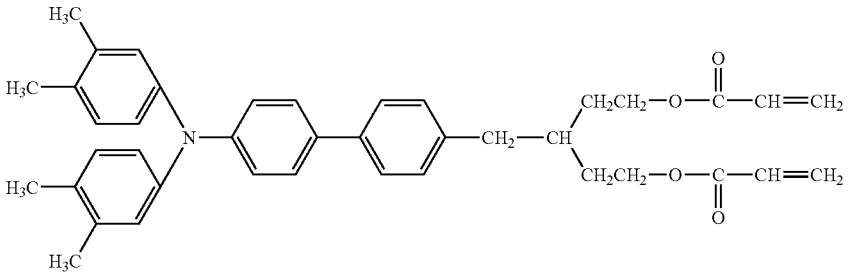 |
| 84 | 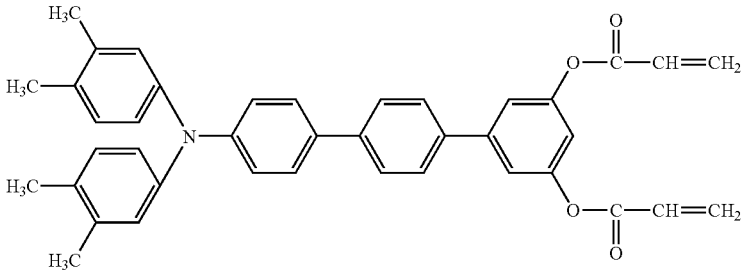 |

TABLE 2-continued
| No. | Exemplary Compound |
|---|---|
| 85 | 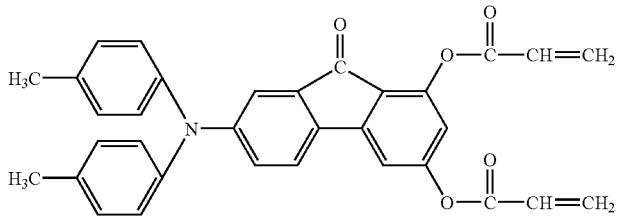 |
| 86 | 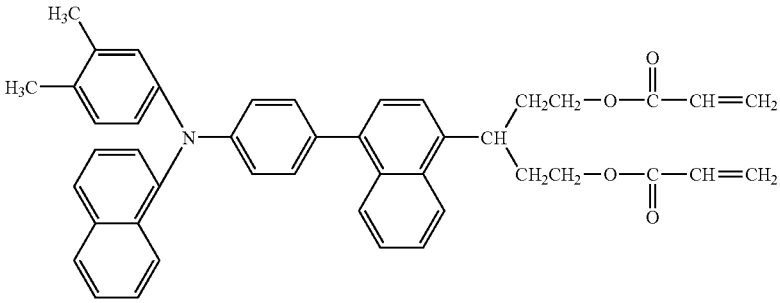 |
| 87 | 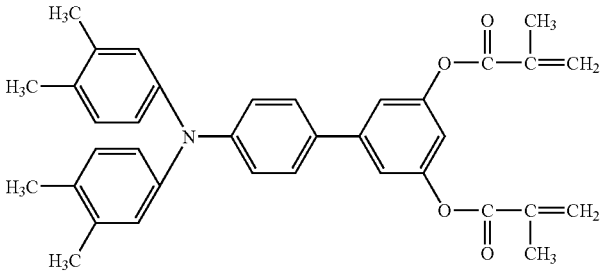 |
| 88 | 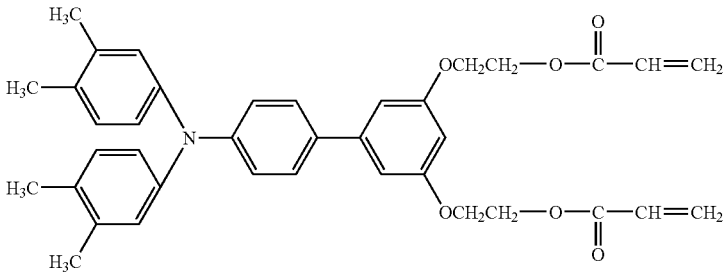 |
| 89 | 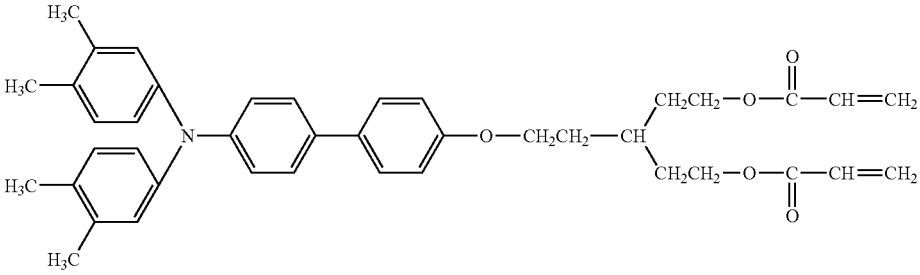 |

TABLE 2-continued
| No. | Exemplary Compound |
|---|---|
| 90 | 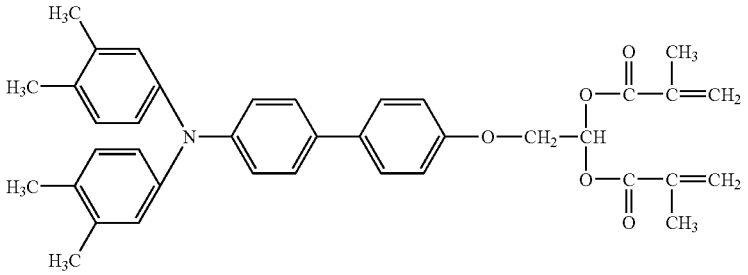 |
| 91 | 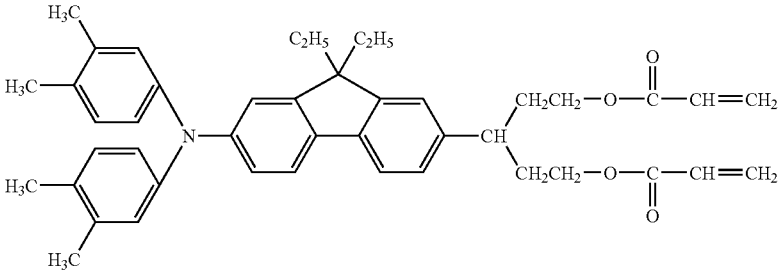 |
| 92 | 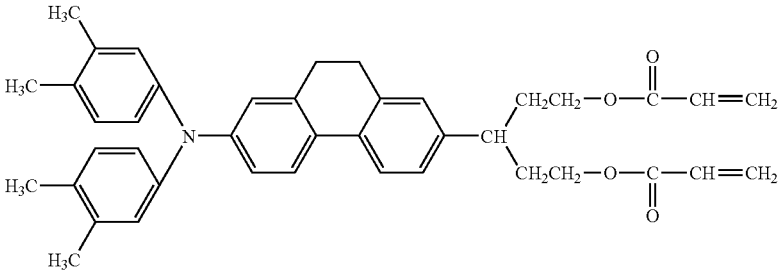 |
| 93 | 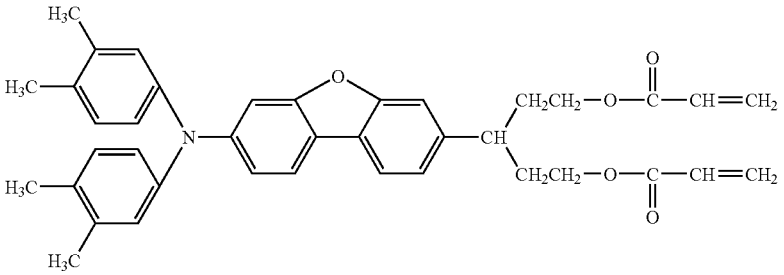 |
| 94 | 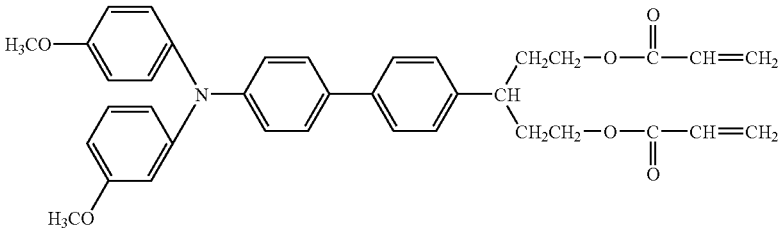 |

TABLE 2-continued
| No. | Exemplary Compound |
|---|---|
| 95 | 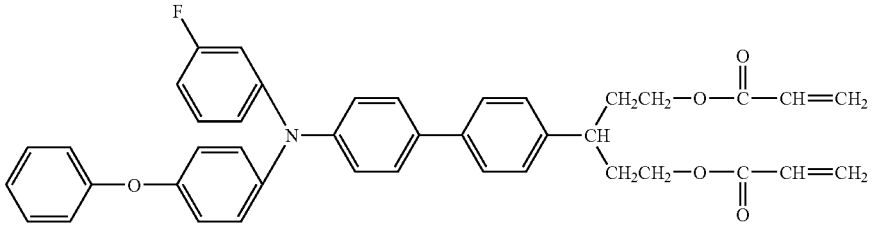 |
| 96 | 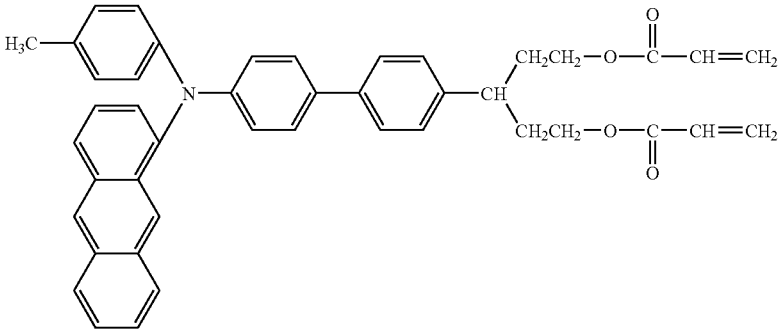 |
| 97 | 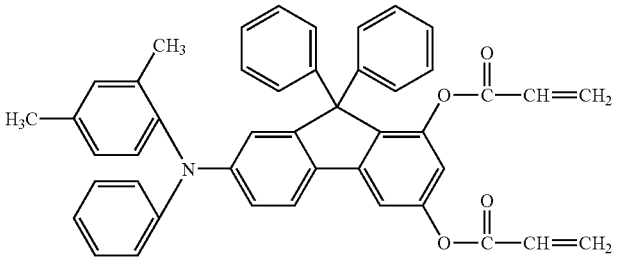 |
| 98 | 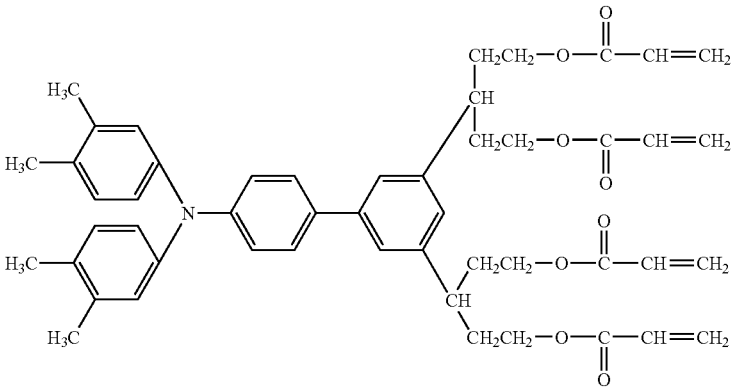 |
| 99 | 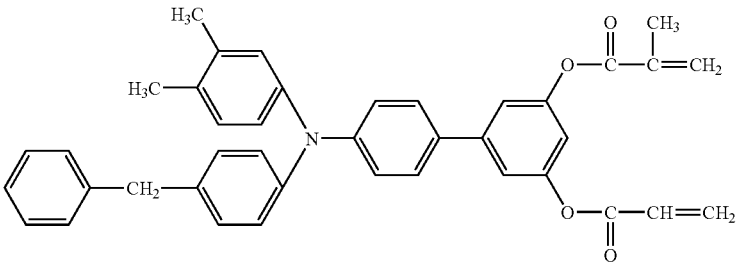 |

TABLE 2-continued
| No. | Exemplary Compound |
|---|---|
| 100 | 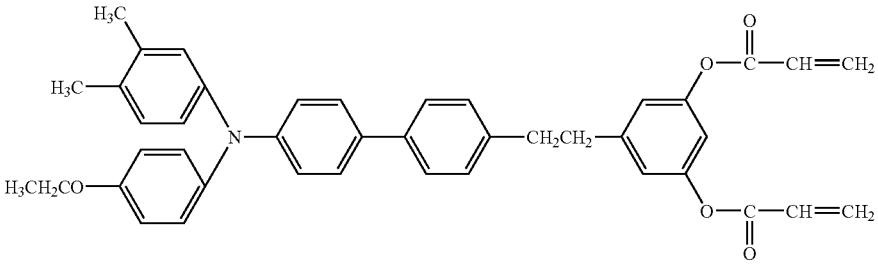 |
Typical processes for producing the charge transporting compound having chain polymerizable functional groups as used in the present invention are show below.
SYNTHESIS EXAMPLE 1
Synthesis of Exemplary Compound No. 18: Exemplary Compound No. 18 was synthesized according to the following route.
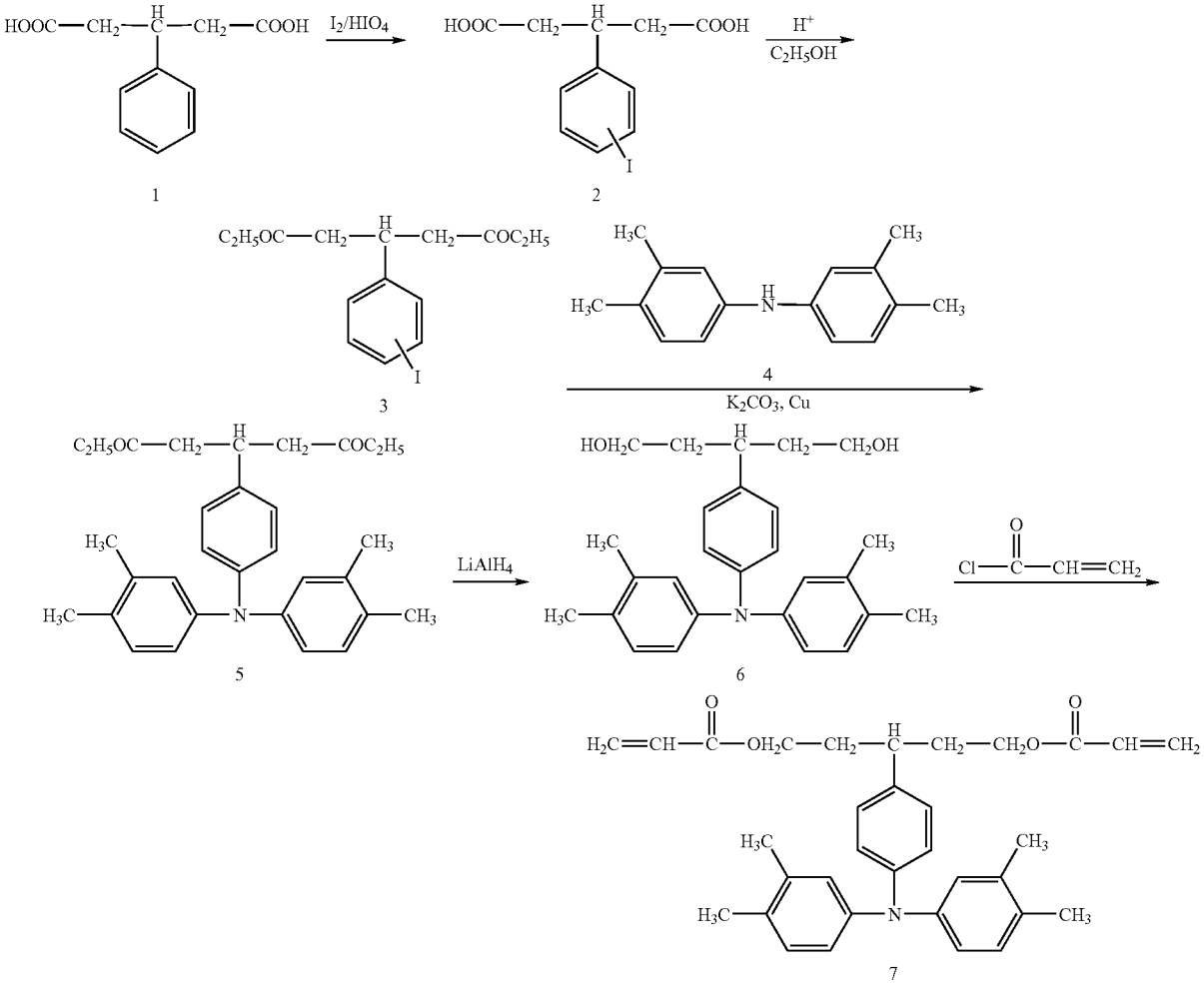

To a mixture solution composed of glacial acetic acid (480 parts by mass; hereinafter "parts"), 62.5% sulfuric acid (24 parts) and water (20 parts), a compound 1 (100 parts), an aqueous 50% periodic acid dihydrate solution (50 parts) and iodine (55 parts) were added, and these were heated to about 70° C. with thorough stirring to carry out reaction for 24 hours. After the reaction mixture was left to cool, it was poured into ice water, and the crystals precipitated were collected by filtration and washed with water. Thereafter, the crude crystals formed were recrystallized with hexane to obtain a compound 2 (100 parts). The compound 2 (100 parts) was added to ethanol, and dilute sulfuric acid was further added in a catalytic quantity to effect esterification by a conventional method to obtain a compound 3 (98 parts). Next, the compound 3 (67 parts), a compound 4 (39 parts), copper powder (23 parts) and anhydrous potassium carbonate (36 parts) were added to o-dichlorobenzene (60 parts), and these were stirred with heating at 200 to 210° C. for 16 hours. The reaction mixture formed was cooled, and thereafter toluene (50 parts) was added, followed by stirring, where the solid matter was removed by filtration. The filtrate obtained was evaporated under reduced pressure, and thereafter the residue formed was purified with a silica gel column (developing solvent: hexane/toluene mixed solvent) to obtain a compound 5 (30 parts). The compound 5 (30 parts) obtained was dissolved in 300 parts of methyl t-butyl ether, and then $LiAlH_4$ (4 parts) was slowly added at room temperature. After its addition was completed, the reaction was carried out at 50° C. for 5 hours. After the reaction was completed, the reaction mixture was neutralized with 6N hydrochloric acid, followed by extraction with ethyl acetate. The organic layer extracted was dried with anhydrous sodium sulfate, and thereafter the solvent was removed under reduced pressure. To the residue formed, 18 parts of THF was added to effect dissolution, and thereafter 70 parts of hexane was added to precipitate crystals to obtain a compound 6 (16 parts). Next, the compound 6 (15 parts) and triethylamine (15 parts) were added to 150 parts of dry THF. These were cooled to 0 to 5° C., and thereafter acryloyl chloride (10 parts) was slowly dropwise added. After its dropwise addition was completed, the reaction mixture was slowly returned to room temperature, and was stirred as it was, at room temperature for 4 hours. The resultant reaction mixture was poured into water and neutralized, followed by extraction with ethyl acetate. The organic layer formed was dried with anhydrous sodium sulfate, and thereafter the solvent was removed. The residue obtained was purified with a silica gel column (developing solvent: toluene) to obtain 15 parts of the desired compound 7 (Exemplary Compound No. 18).

SYNTHESIS EXAMPLE 2

Synthesis of Exemplary Compound No. 1: Exemplary Compound No. 1 was synthesized according to the following route.

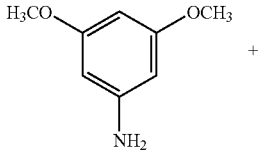

1

-continued

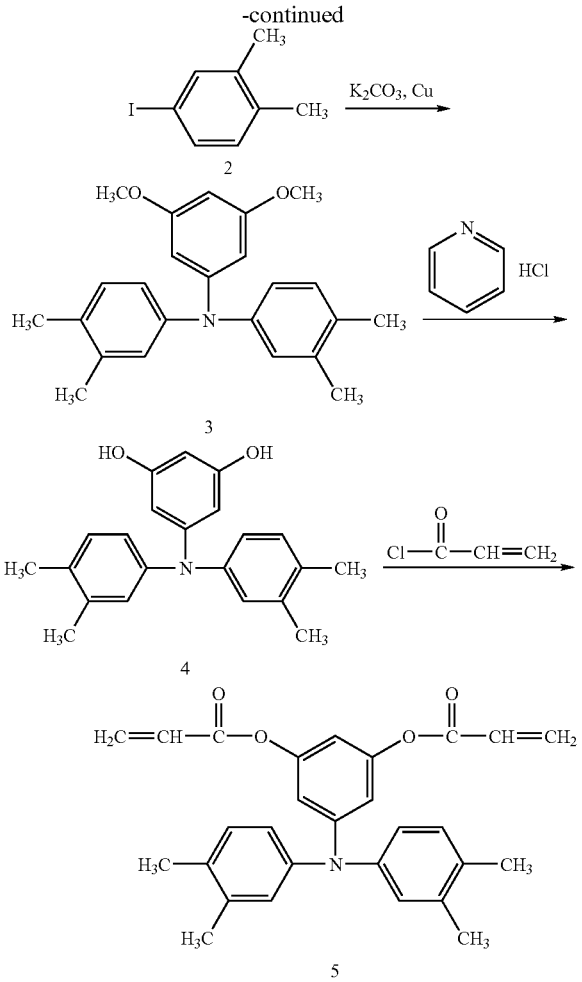

A compound 1 (100 parts), a compound 2 (380 parts), copper powder (150 parts) and anhydrous potassium carbonate (135 parts) were added to o-dichlorobenzene (100 parts), and these were stirred with heating at 200 to 210° C. for 24 hours. The reaction mixture formed was cooled, and thereafter toluene (100 parts) was added, followed by stirring, where the solid matter was removed by filtration. The filtrate obtained was evaporated under reduced pressure, and thereafter the residue formed was purified with a silica gel column (developing solvent: hexane/toluene mixed solvent) to obtain a compound 3 (130 parts). The compound 3 (100 parts) and pyridinium chloride (640 parts) were mixed, and the resultant mixture was stirred with heating at 200 to 210° C. for 4 hours. The reaction mixture formed was cooled to about 145° C., and thereafter 600 parts of water was slowly added to cool. The resultant reaction mixture was acidified with 6N hydrochloric acid, followed by extraction with toluene. The organic layer extracted was dried with anhydrous sodium sulfate, and thereafter the solvent was removed under reduced pressure. The residue formed was purified with a silica gel column (developing solvent: toluene/THF mixed solvent) to obtain a compound 4 (90 parts). Next, the compound 4 (80 parts) and triethylamine (42 parts) were added to 400 parts of dry THF. These were cooled to 0 to 5° C., and thereafter acryloyl chloride (60 parts) was slowly dropwise added. After its dropwise addition was completed, the reaction mixture was slowly returned to room temperature, and was stirred as it was, at room temperature for 4 hours. The resultant reaction mixture was poured into water and neutralized, followed by extraction with ethyl acetate. The organic layer formed was dried with anhydrous sodium sulfate, and thereafter the solvent was removed. The residue obtained was purified with a silica gel column to obtain 75 parts of the desired compound 5 (Exemplary Compound No. 1).

SYNTHESIS EXAMPLE 3

Synthesis of Exemplary Compound No. 41: Exemplary Compound No. 41 was synthesized according to the following route.

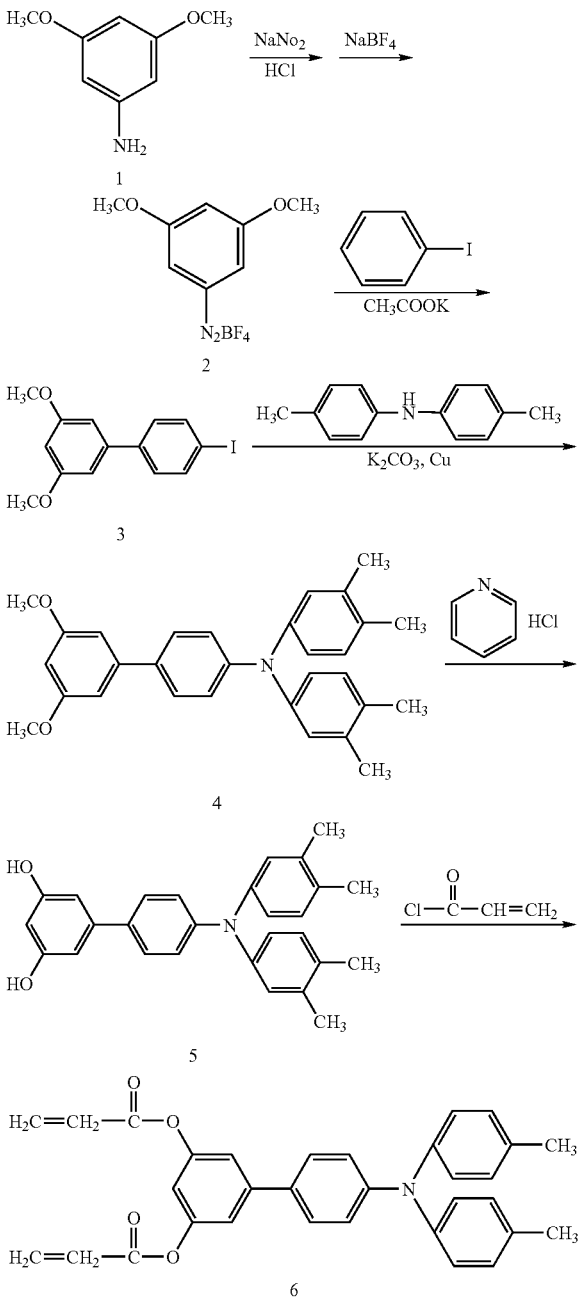

To an aqueous hydrochloric acid solution of concentrated hydrochloric acid (35%) (680 parts by mass; hereinafter "parts") and water (210 parts), a compound 1 (100 parts) was added. Thereafter, the mixture obtained was so cooled with ice water as to have an internal temperature of 5° C. or less. To the resultant mixture, a cooled solution of sodium nitrate (47 parts) and water (200 parts) was slowly submergedly dropwise added so that the internal temperature did not become higher than 5° C. After its dropwise addition was completed, the reaction mixture was stirred for 30 minutes as it was. The resultant reaction mixture was filtered, and the filtrate obtained was again cooled with ice water to 5° C. or less. To this liquid, an aqueous solution of sodium tetrafluoroborate (106 parts) and water (180 parts) was dropwise added. The mixture obtained was stirred for 30 minutes as it was, and was thereafter filtered by suction to obtain 142 parts of a compound 2 as a crude product. This compound 2 as a crude product was further dissolved in acetonitrile, and isopropyl ether was added thereto to effect reprecipitation, followed by purification to obtain 115 parts of a compound 2. To a solution prepared by adding the compound 2 (100 parts) obtained and 18-crown-6-ether (5.3 parts) to iodobenzene (9,000 parts), potassium acetate (80 parts) was added at room temperature, and these were stirred for 3 hours as it was. The reaction mixture obtained was filtered, and the filtrate formed was washed with brine, where the organic layer formed was dried with anhydrous magnesium sulfate. Thereafter, the iodobenzene was removed by distillation. To the residue obtained, methanol was added to precipitate crystals, and these crystals obtained were collected by filtration. The crystals obtained were recrystallized with a methanol/acetone mixed solvent to obtain 46 parts of a compound 3.

The compound 3 (40 parts) thus obtained, p-ditolylamino (30 parts), copper powder (22 parts) and anhydrous potassium carbonate (25 parts) were added to o-dichlorobenzene (120 parts), and these were stirred with heating at 200 to 210° C. for 16 hours. The reaction mixture formed was cooled, and thereafter toluene (100 parts) was added, followed by stirring, where the solid matter was removed by filtration. The filtrate obtained was evaporated under reduced pressure, and thereafter the residue formed was purified with a silica gel column (developing solvent: toluene) to obtain a compound 4 (130 parts). Next, the compound 4 (30 parts) and pyridinium chloride (210 parts) were mixed, and the resultant mixture was stirred with heating at 200 to 210° C. for 4 hours. The reaction mixture formed was cooled to about 145° C., and thereafter 350 parts of water was slowly added to cool. The resultant reaction mixture was acidified with 6N hydrochloric acid, followed by extraction with toluene. The organic layer extracted was dried with anhydrous sodium sulfate, and thereafter the solvent was removed under reduced pressure. The residue formed was purified with a silica gel column (developing solvent: toluene/THF mixed solvent) to obtain a compound 5 (23 parts). Next, the compound 5 (20 parts) and triethylamine (6.8 parts) were added to 100 parts of dry THF. These were cooled to 0 to 5° C., and thereafter acryloyl chloride (9.7 parts) was slowly dropwise added. After its dropwise addition was completed, the reaction mixture was slowly returned to room temperature, and was stirred as it was, at room temperature for 4 hours. The resultant reaction mixture was poured into water and neutralized, followed by extraction with ethyl acetate. The organic layer formed was dried with anhydrous sodium sulfate, and thereafter the solvent was removed. The residue obtained was purified with a silica gel column to obtain 16 parts of the desired compound 6 (Exemplary Compound No. 41).
SYNTHESIS EXAMPLE 4
Synthesis of Exemplary Compound No. 72: Exemplary Compound No. 72 was synthesized according to the following route.
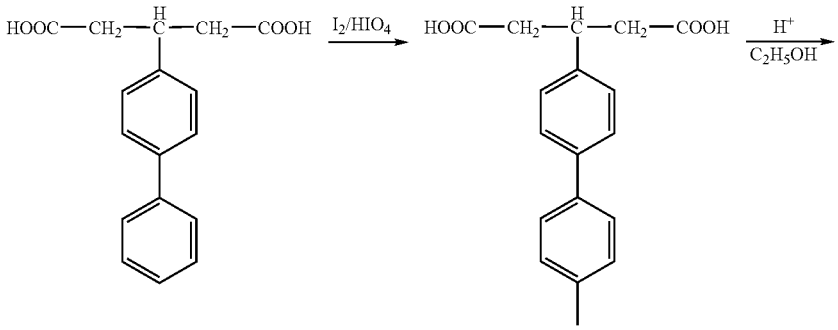
1 2
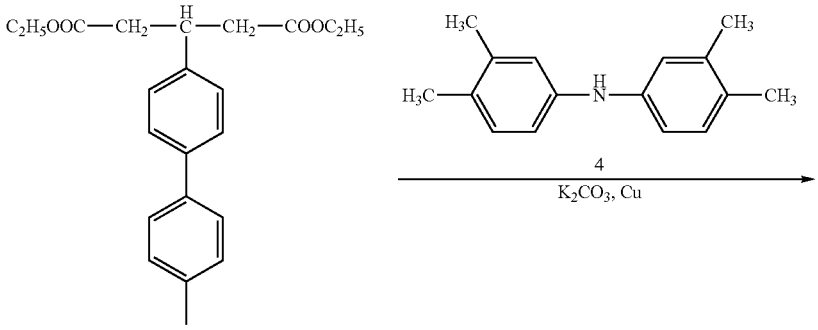
3
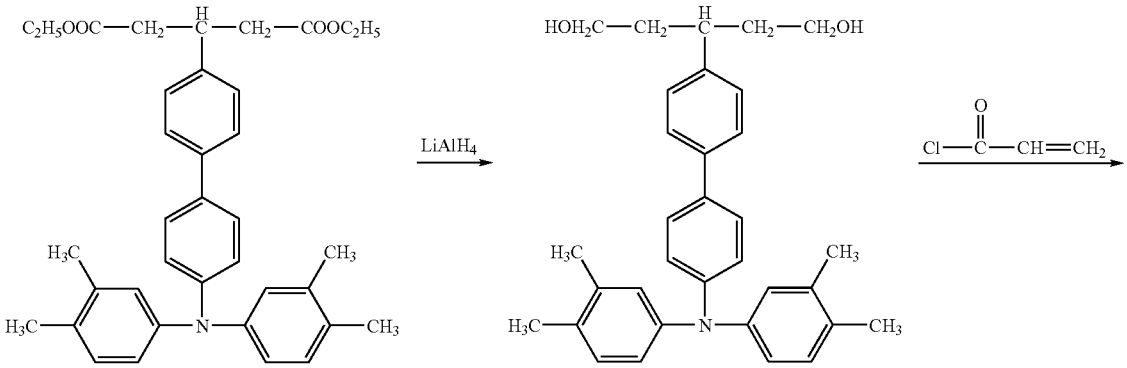
5 6

-continued

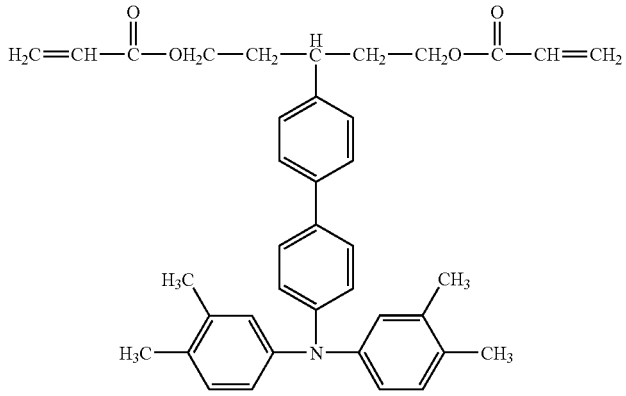

7

To a mixture solution composed of glacial acetic acid (600 parts), 62.5% sulfuric acid (24 parts) and water (20 parts), a compound 1 (140 parts), an aqueous 50% periodic acid dihydrate solution (50 parts) and iodine (55 parts) were added, and these were heated to about 70° C. with thorough stirring to carry out reaction for 24 hours. After the reaction mixture was left to cool, it was poured into ice water, and the crystals precipitated were collected by filtration and washed with water. Thereafter, the crude crystals formed were recrystallized with a hexane/acetone mixed solvent to obtain a compound 2 (120 parts). The compound 2 (100 parts) was added to ethanol, and dilute sulfuric acid was further added in a catalytic quantity to effect esterification by a conventional method to obtain a compound 3 (95 parts). Next, the compound 3 (80 parts), a compound 4 (46 parts), copper powder (13 parts) and anhydrous potassium carbonate (35 parts) were added to o-dichlorobenzene (100 parts), and these were stirred with heating at 200 to 210° C. for 16 hours. The reaction mixture formed was cooled, and thereafter toluene (80 parts) was added, followed by stirring, where the solid matter was removed by filtration. The filtrate obtained was evaporated under reduced pressure, and thereafter the residue formed was purified with a silica gel column (developing solvent: hexane/toluene mixed solvent) to obtain a compound 5 (55 parts). The compound 5 (50 parts) obtained was dissolved in 500 parts of methyl t-butyl ether, and then $LiAlH_4$ (7 parts) was slowly added at room temperature. After its addition was completed, the reaction was carried out at 50° C. for 5 hours. After the reaction was completed, the reaction mixture was neutralized with 6N hydrochloric acid, followed by extraction with ethyl acetate. The organic layer extracted was dried with anhydrous sodium sulfate, and thereafter the solvent was removed under reduced pressure. In the residue formed, an acetone/n-hexane mixed solvent was used to precipitate crystals to obtain a compound 6 (28 parts). Next, the compound 6 (20 parts) and triethylamine (15 parts) were added to 150 parts of dry THF. These were cooled to 0 to 5° C., and thereafter acryloyl chloride (8.3 parts) was slowly dropwise added. After its dropwise addition was completed, the reaction mixture was slowly returned to room temperature, and was stirred as it was, at room temperature for 4 hours. The resultant reaction mixture was poured into water and neutralized, followed by extraction with ethyl acetate. The organic layer formed was dried with anhydrous sodium sulfate, and thereafter the solvent was removed. The residue obtained was purified with a silica gel column (developing solvent: toluene) to obtain 14 parts of the desired compound 7 (Exemplary Compound No. 72).

In the present invention, the specific charge transporting compound having two or more chain polymerizable functional groups in the same molecule as described above is polymerized or cross-linked and cured, so that the compound having charge transport performance in the photosensitive layer is incorporated into a three-dimensional cross-linked structure through covalent bonds at two or more cross-linked points. However, where the charge transporting material in the present invention has three-dimensionally been cured, the charge transporting material phases come less twisted and can assume closely thermodynamically stable configurations a usual low-molecular charge transporting material can assume, as being different from the conventional case in which the charge transporting material is incorporated into the backbone chain. Thus, the present system can achieve a sufficient charge transport performance, compared with conventional ones, and has enabled not only securement of electrical properties but also vast improvement in mechanical durability.

The above charge transporting compound may be polymerized or cross-linked and cured alone, or may be mixed with a compound having other chain polymerizable group(s), either of which is possible. The latter's types and proportion may all be as desired. The compound having other chain polymerizable group(s) as herein referred includes all of monomers, oligomers and polymers having other chain polymerizable group(s) Where the functional groups of the present charge transporting compound and the functional group(s) of such other chain polymerizable compound are the same groups or groups polymerizable with each other, the both can assume a copolymerized three-dimensional cross-linked structure through covalent bonds. Where the functional groups of the both are functional groups not polymerizable with each other, the photosensitive layer is made up as a mixture of two or more three-dimensional cross-linked products or one which contains other chain polymerizable functional compound monomer or a cured product thereof in a chief-component three-dimensional cross-linked product. Its mixing proportion and how to form the film may successfully be controlled, whereby IPN, i.e., inter-penetrating network can also be formed.

The photosensitive layer may also be formed from the above charge transporting compound and a monomer, oligomer or polymer having no chain polymerizable group, or a monomer, oligomer or polymer having a polymerizable group other than the chain polymerizable one.

Further, in some cases, the photosensitive layer may also contain a charge transporting compound which is not incorporated in the three-dimensional cross-linked structure through chemical bonds, i.e., which has no chain polymerizable functional group. It may also contain other various additives and other lubricant or the like.

The electrophotographic photosensitive member of the present invention may be so constituted that, as a photosensitive layer, a charge generation layer containing a charge generating material and a charge transport layer containing a charge transporting material are superposed in this order on the conductive support, or these layers are superposed in reverse order, or may be constituted of a single layer in which a charge generating material and a charge transporting material are dispersed in the same layer; in any way of which the photosensitive layer may be constituted. In the former multi-layer type, the charge transport layer may be constituted of two or more layers. In the latter single-layer type, a charge transport layer may further be formed on the photosensitive layer containing a charge generating material and a charge transporting material in the same layer. A protective layer may further be formed on the charge generation layer or on the charge transport layer. In any of these cases, the photosensitive layer may at least contain the aforesaid charge transporting compound having chain polymerizable functional groups and/or the aforesaid other charge transporting compound. However, in view of properties required as the electrophotographic photosensitive member, in particular, electrical properties such as residual potential, and durability, the electrophotographic photosensitive member may preferably be constituted in a function-separated type in which the charge generation layer and the charge transport layer are superposed in this order. The present invention is also advantageous in that it has enabled the surface layer to be made highly durable without lowering the charge transport performance.

How to produce the electrophotographic photosensitive member according to the present invention is specifically described below.

As the support of the electrophotographic photosensitive member, it may at least be one having conductivity. For example, it may include supports obtained by shaping metals or alloys such as aluminum, copper, chromium, nickel, zinc and stainless steel into drums or sheets; supports obtained by laminating metallic foils such as aluminum foil and copper foil to plastic films; supports obtained by vacuum-depositing aluminum, indium oxide and tin oxide on plastic films; and metals, plastic films, or sheets of paper, provided with conductive layers by coating them with a conductive material alone or together with a binder resin.

In the present invention, a subbing layer having the function as a barrier and the function of adhesion may also be provided on the conductive support. The subbing layer is formed for the purposes of improving the adherence of the photosensitive layer, improving coating performance, protecting the support, covering defects of the support surface, improving the injection of electric charges from the support and protecting the photosensitive layer from any electrical breakdown. As a material for the subbing layer, it may include polyvinyl alcohol, poly-N-vinyl imidazole, polyethylene oxide, ethyl cellulose, an ethylene-acrylic acid copolymer, casein, polyamide, N-methoxymethylated nylon 6, copolymer nylons, glue and gelatin. Any of these is dissolved in a correspondingly suitable solvent, and the solution obtained is coated on the support. It may preferably be coated in a layer thickness of from 0.1 to 2 μm.

In the case when the electrophotographic photosensitive member of the present invention is of the function-separated type, the charge generation layer and the charge transport layer are superposingly formed. The charge generating material used in the charge generation layer may include selenium-tellurium, pyrylium or thiapyrilium type dyes, and phthalocyanine compounds having various central metals and various crystal forms specifically as exemplified by α, β, γ, δ, ϵ and X forms; and anthanthrone pigments, dibenzpyrenequinone pigments, pyranthrone pigments, trisazo pigments, disazo pigments, monoazo pigments, indigo pigments, quinacridone pigments, asymmetric quinocyanine pigments, quinocyanine pigments, and amorphous silicon disclosed in Japanese Patent Application Laid-open No. 54-143645.

In the case of the function-separated type electrophotographic photosensitive member, the charge generation layer may be formed by coating a fluid dispersion, followed by drying; the fluid dispersion being prepared by well dispersing the charge generating material together with a binder resin used in a 0.3- to 4-fold quantity, and a solvent by means of a homogenizer, an ultrasonic dispersion machine, a ball mill, a vibration ball mill, a sand mill, an attritor or a roll mill. Alternatively, it may be formed as a film with sole composition, such as a vacuum-deposited film of the charge generating material. It may preferably be in a layer thickness of 5 μm or less, and particularly preferably be in the range of from 0.1 to 2 μm.

The above binder resin may include, e.g., polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenolic resins, melamine resins, silicon resins and epoxy resins.

The charge transporting compound in the present invention, having chain polymerizable functional groups as described above, may be used in the charge transport layer to be formed on the charge generation layer described above, or may be used in a surface protective layer having charge transporting ability, after a charge transport layer composed of a charge transporting material and a binder resin has been formed on the charge generation layer. In either case, it is common for the surface layer to be formed by a method in which a solution containing the charge transporting compound is coated and thereafter made to undergo polymerization and curing reaction. The surface layer may also be formed by using, e.g., one obtained by reacting a solution containing the charge transporting compound, to obtain a cured product and thereafter again dispersing or dissolving the cured product in a solvent.

Methods for coating these solutions or dispersions may include, e.g., dip coating, spray coating, curtain coating and spin coating. From the viewpoint of efficiency and productivity, dip coating is preferred. Vacuum deposition, plasma-assisted CVD or other known film forming processes may also appropriately be selected.

In the present invention, the charge transporting compound having chain polymerizable functional groups may preferably be polymerized and cured by radiations. The polymerization by radiations is most advantageous in that it does not require any polymerization initiator, and in that this enables formation of a very highly pure three-dimensional photosensitive layer matrix to secure good electrophotographic properties. The polymerization by radiations is also advantageous in, e.g., that it promises a high productivity because it is short-time and efficient polymerization reaction, and further that any cure inhibition which may come when films are formed in a large thickness or shielding substances such as additives are present in films may have a very small influence because of good transmissivity of radiations. However, the polymerization reaction may proceed with difficulty depending on the types of chain polymerizable groups and the types of central skeletons. In such an occasion, the polymerization initiator may be added as long as it has no adverse influence. The radiations used here refer to electron rays or γ-rays. When irradiated with electron rays, an accelerator may be of a scanning type, an electron curtain type, a broad beam type, a pulse type or a laminar type, any of which types may be used.

When irradiated with electron rays, irradiation conditions are very important for the electrophotographic photosensitive member of the present invention in order to bring out its electrical properties and running performance. In the present invention, the irradiation may preferably be made at an accelerating voltage of 250 kV or less, and most preferably 150 kV or less. The electron rays may preferably be at an absorbed dose of from $1\times10^3$ to $1\times10^6$ Gy, and more preferably from $5\times10^3$ to $5\times10^5$ Gy. If the electron rays are at an absorbed dose of less than $1\times10^3$ Gy, it is difficult to cure the surface layer sufficiently, and, at an absorbed dose of more than $1\times10^6$ Gy, characteristics such as sensitivity and residual potential tend to deteriorate, making it necessary to take care. An electron ray irradiator used to produce the electrophotographic photosensitive member of the present invention is shown in FIG. 1 as a schematic structural view.

The electron ray irradiator used in the present invention has, as shown in FIG. 1, an electron ray generator 10, an irradiation chamber 20 and an irradiation window 30.

The electron ray generator 10 has a terminal 12 which generates electron rays, and an accelerating tube 14 which accelerates in a vacuum space (acceleration space) the electron rays generated at the terminal 12. The interior of the electron ray generator 10 is kept at a vacuum of from $10^{-4}$ to $10^{-6}$ Pa by means of a diffusion pump (not shown) in order to prevent electrons from colliding with gaseous molecules to loose energy.

The terminal 12 has a filament 12*a* which is linear and emits thermions, a gun structure 12*b* which supports the filament 12*a*, and a grid 12*c* which controls the thermions emitted at the filament 12*a*. The length of the filament 12*a* and the grid 12*c* each in the direction of their depth as viewed in the drawing may be at least larger than the length of an irradiation object in the direction of its cylinder shaft and at its part to be irradiated with electron rays. This enables the irradiation object to be entirely irradiated in its cylinder shaft direction by one-time irradiation with electron rays.

The electron ray generator 10 is also provided with a heating power source (not shown) for heating the filament 12*a* to generate thermions, a controlling direct-current power source (also not shown) which applies a voltage across the filament 12*a* and the grid 12*c*, and an accelerating direct-current power source which applies a voltage across the grid 12*c* and a window foil 32 provided in the irradiation window 30.

The irradiation chamber 20 embraces an irradiation space 22 in which the surface of a cylindrical irradiation object 1 is to be irradiated with electron rays. As in Examples given later, where the surface layer of the electrophotographic photosensitive member is cured, the interior of the irradiation chamber 20 is kept to have an atmosphere of inert gas in order to make the curing stable. Here, the inert gas refers to nitrogen gas, argon gas, helium gas or the like. The cylindrical irradiation object 1 is transported through the interior of the irradiation chamber 20 in the direction of an arrow A by a transport means such as conveyer.

Further, this irradiation object 1 as the conductive support is rotated around its cylinder shaft at least within the time for which the cylindrical irradiation object 1 passes through the electron ray irradiation window 30 and is irradiated with electron rays, whereby the irradiation object 1 is rotated around its cylinder shaft in the direction of an arrow B. The electron ray generator 10 and the irradiation chamber 20 are shielded by lead lining at their surroundings so that X-rays generated secondarily at the time of irradiation with electron rays may not leak outside.

The irradiation window 30 has a window foil 32 made of metal foil, and a window frame structure 34 which cools the window foil 32 and at the same time supports the window foil 32. The window foil 32 partitions the vacuum atmosphere inside the electron ray generator 10 and the air atmosphere inside the irradiation chamber 20, and also draws electron rays into the irradiation chamber 20 through the window foil 32.

The filament 12*a* is heated by its electrification through the heating power source, whereupon the filament 12*a* emits thermions. The thermions are attracted in all directions in virtue of control voltage produced through the controlling direct-current power source and applied across the filament 12*a* and the grid 12*c*. Of these, only those having passed the grid 12*c* are effectively drawn out as electron rays. Then, the electron rays drawn out of this grid 12*c* are accelerated in the acceleration space inside the accelerating tube 14 in virtue of accelerating voltage produced through the accelerating direct-current power source and applied across the grid 12*c* and the window foil 32. Thereafter, the electron rays penetrate through the window foil 32, and are then shed on the cylindrical irradiation object 1 transported through the interior of the irradiation chamber 20 positioned beneath the irradiation window 30. Incidentally, in usual cases, the heating power source and the accelerating power source are set at stated values, and the value of the controlling direct-current power source is set variable. This enables adjustment of beam currents.

In the case when the charge transporting compound having chain polymerizable functional groups is used as a charge transporting material, the charge transporting compound may preferably be contained in an amount of 20% or more, and particularly 40% or more, in terms of molecular weight, based on the total mass of the film of the charge transport layer after polymerization and curing, as the amount of one in which the chain polymerizable groups of the charge transporting compound having chain polymerizable functional groups which is represented by the above general formula (1) have been removed to form a hydrogenated product. If it is in an amount of less than 20%, the charge transport layer may have a low charge transport performance to cause problems such as a decrease in sensitivity and an increase in residual potential. As the charge transport layer in this case, it may preferably have a layer thickness of from 1 to 50 μm, and particularly preferably from 3 to 30 μm.

In the case when the charge transporting compound is used as a surface protective layer formed on the charge transport layer on the charge generation layer, the charge transport layer corresponding to an underlying layer of the surface protective layer may be formed by coating a solution by the known method described previously, followed by drying; the solution being prepared by dispersing or dissolving a high-molecular compound having heterocyclic rings or condensed polycyclic aromatics, such as poly-N-vinyl carbazole or polystyryl anthracene, or a low-molecular compound such as a heterocyclic compound such as pyrazoline, imidazole, oxazole, triazole or carbazole, a triarylalkane derivative such as triphenylmethane, a triarylamine derivative such as triphenylamine, a phenylenediamine derivative, an N-phenylcarbazole derivative, a stilbene derivative or a hydrazone derivative, in a solvent together with a suitable binder resin (which may be selected from among the resins for charge transport layer as described previously). Here, the charge transporting material and the binder resin may preferably be in a proportion selected appropriately within the range of from 30 to 100, and more preferably from 50 to 100, as the mass of the charge transporting material when the total mass of the both is regarded as 100. If the charge transporting material is in an amount smaller than that, a low charge transport performance may result to cause problems such as a decrease in sensitivity and an increase in residual potential. The charge transport layer may have layer thickness which is so determined as to be preferably from 1 to 50 μm, and may more preferably be adjusted within the range of from 5 to 30 μm, as the total layer thickness found by summing up the thickness of the upper-layer surface protective layer.

In the present invention, in any cases described above, the above charge transporting material may be incorporated in a photosensitive layer containing the cured product of the charge transporting compound having chain polymerizable groups.

In the case of the single-layer type photosensitive layer, it follows that the charge generating material is simultaneously contained in a solution containing the charge transporting compound. This avails either of a case in which this solution is coated on the conductive support which may be provided thereon with a suitable subbing layer or intermediate layer, followed by polymerization or cross-linking and curing to form the layer, and a case in which a solution containing the charge transporting compound is coated on the single-layer type photosensitive layer constituted of a charge generating material and a charge transporting material, provided on the conductive support, followed by polymerization or cross-linking and curing.

Various additives may be added to the photosensitive layer of the electrophotographic photosensitive member of the present invention. Such additives refer to deterioration preventive agents such as an antioxidant and an ultraviolet absorbent, a lubricant such as tetrafluoroethylene resin particles or carbon fluoride, and so forth.

Figure 2:
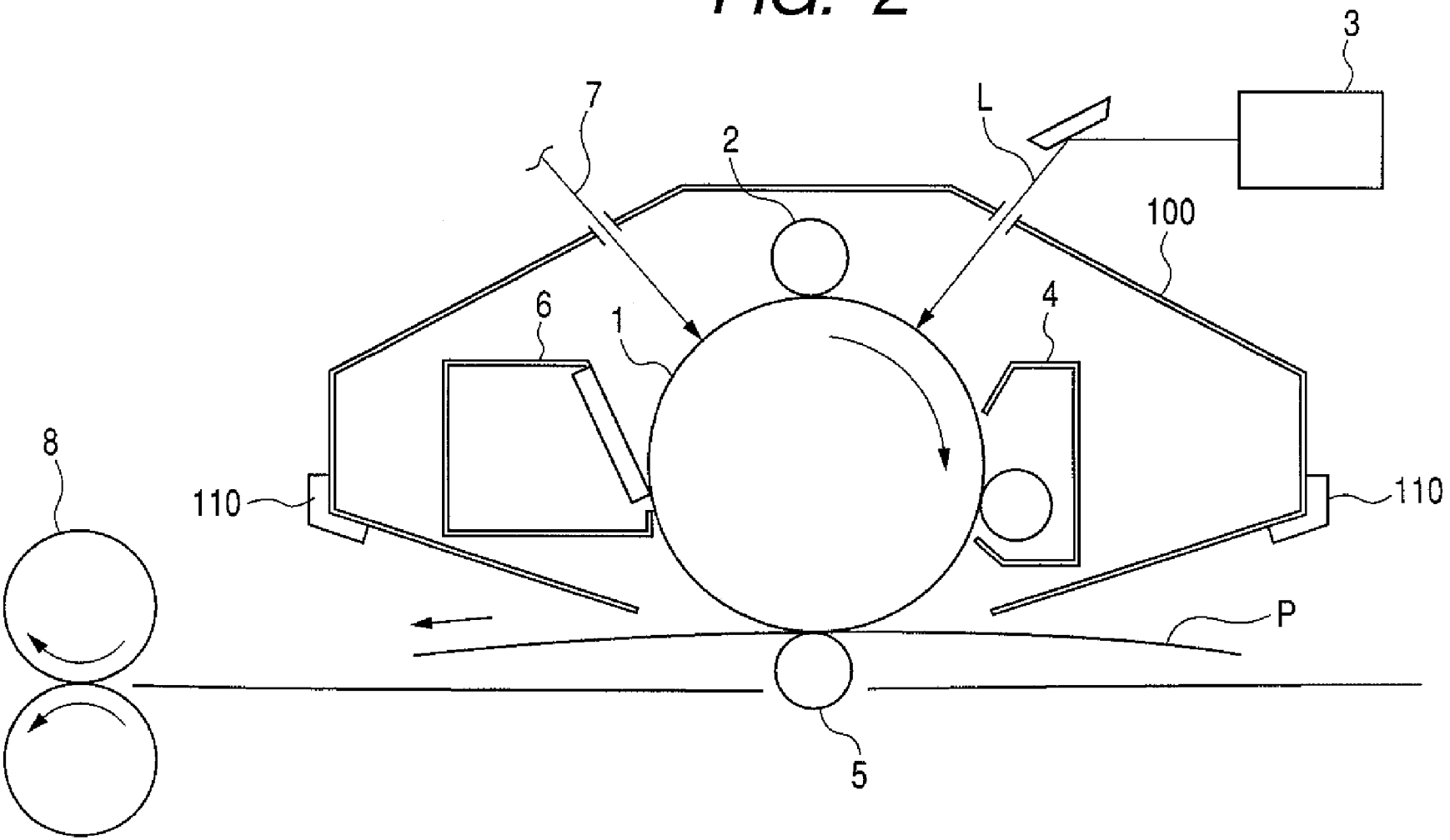
FIG. 2 is a schematic structural view showing an example of an electrophotographic apparatus of the present invention.

The construction of an electrophotographic apparatus having a process cartridge having the electrophotographic photosensitive member of the present invention is schematically shown in FIG. 2.

In FIG. 2, reference numeral 1 denotes a drum-shaped electrophotographic photosensitive member of the present invention, which is rotatingly driven around an axis (not shown) in the direction of an arrow at a stated peripheral speed. The electrophotographic photosensitive member 1 is, in the course of its rotation, uniformly electrostatically charged on its periphery to a positive or negative, given potential through a primary charging means 2. The electrophotographic photosensitive member thus charged is then exposed to exposure light L emitted from an exposure means 3 for slit exposure or laser beam scanning exposure. In this way, electrostatic latent images are successively formed on the periphery of the electrophotographic photosensitive member 1. The electrostatic latent images thus formed are subsequently developed with toner by the operation of a developing means 4. The toner images thus formed by development are then successively transferred by the operation of a transfer means 5, to a transfer material P fed from a paper feed section (not shown) to the part between the electrophotographic photosensitive member 1 and the transfer means 5 in the manner synchronized with the rotation of the electrophotographic photosensitive member 1. The transfer material P onto which the toner images have been transferred is separated from the surface of the electrophotographic photosensitive member, is led through an image fixing means 8, where the toner images are fixed, and is then put out of the apparatus as a duplicate (a copy). The surface of the electrophotographic photosensitive member 1 from which images have been transferred is brought to removal of the toner remaining after the transfer, through a cleaning means 6. Thus, its surface is cleaned. The electrophotographic photosensitive member is further subjected to charge elimination by pre-exposure light 7 emitted from a pre-exposure means (not shown), and then repeatedly used for the formation of images. Incidentally, where the primary charging means 2 is a contact charging means making use of a charging roller or the like, the pre-exposure is not necessarily required.

In the present invention, the apparatus may be constituted of a combination of plural components integrally joined as a process cartridge from among the constituents such as the above electrophotographic photosensitive member 1, primary charging means 2, developing means 4 and cleaning means 6 so that the process cartridge is detachably mountable to the main body of an electrophotographic apparatus such as a copying machine or a laser beam printer. For example, at least one of the primary charging means 2, the developing means 4 and the cleaning means 6 may integrally be supported in a cartridge together with the electrophotographic photosensitive member 1 to form a process cartridge 100 that is detachably mountable to the main body of the apparatus through a guide means such as rails 110 provided in the main body of the apparatus.

In the case when the electrophotographic apparatus is a copying machine or a printer, the exposure light L is light reflected from, or transmitted through, an original, or light emitted by the scanning of a laser beam, the driving of an LED array or the driving of a liquid-crystal shutter array according to signals obtained by reading an original through a sensor and converting the information into signals.

The electrophotographic photosensitive member of the present invention may be not only applied in electrophotographic copying machines, but also widely applicable in the fields where electrophotography is applied, e.g., laser beam printers, CRT printers, LED printers, liquid-crystal printers, and laser platemaking.

EXAMPLES

The present invention is described below in greater detail by giving Examples and Comparative Examples. The term "part(s)" occurring in the following refers to "part(s) by mass" in all occurrences unless particularly noted.

Example 1-1

1 part of polyamide resin (6-60-64-12 nylon quadripolymer) and 3 parts of 8-nylon resin (methoxymethylated nylon; methoxylation percentage: about 30%) were dissolved in a mixed solvent of 50 parts of methanol and 40 parts of butanol to prepare an intermediate-layer coating fluid. This coating fluid was applied by dip coating on an aluminum cylinder of 30 mm in diameter, having been processed by honing, and the wet coating formed was dried at 100° C. for 20 minutes to form an intermediate layer with a layer thickness of 0.5 μm.

3 parts of hydroxygallium phthalocyanine crystals having strong peaks at 7.40 and 28.20 of Bragg angles (2θ plus-minus 0.2°) in CuKα characteristic X-ray diffraction, 1.0 part of polyvinyl butyral (trade name: S-LEC BM2, available from Sekisui Chemical Co., Ltd.) and 35 parts of cyclohexanone were subjected to dispersion for 24 hours by means of a sand mill making use of glass beads of 1 mm in diameter, and thereafter 60 parts of ethyl acetate was added to prepare a charge generation layer coating fluid. This coating fluid was applied by dip coating on the intermediate layer, followed by drying at 105° C. for 10 minutes to form a charge generation layer with a layer thickness of 0.12 μm.

Next, 1.25 parts of fluorine-atom-containing resin (trade name: GF-300, available from Toagosei Chemical Industry Co., Ltd.) as a dispersant was dissolved in a mixture of 37.5 parts of 1,1,2,2,3,3,4-heptafluorocyclopentane (trade name: ZEOROLA H, available from Nippon Zeon Co., Ltd.) and 37.5 parts of 1-propanol, and thereafter 12.5 parts of tetrafluoroethylene resin powder (trade name: LUBRON L-2, available from Daikin Industries, Ltd.) was added as a lubricant, followed by uniform dispersion by carrying out treatment three times under a pressure of 600 kgf/cm$^2$ by means of a high-pressure dispersion machine (trade name: MICROFLUIDIZER M-110EH, manufactured by Microfluidics Inc., USA). The dispersion obtained was subjected to pressure filtration with a polytetrafluoroethylene (PTFE) membrane filter of 10 μm in pore size to prepare a lubricant dispersion. Next, 36 parts of Exemplary Compound No. 17 as shown in Table 1, the charge transporting compound having chain polymerizable functional groups, 16.2 parts of the lubricant dispersion, 24 parts of 1,1,2,2,3,3,4-heptafluorocyclopentane and 24 parts of 1-propanol were mixed and stirred, followed by pressure filtration with a membrane filter of 5 μm in pore size, made of PTFE, to prepare a charge transport layer coating fluid.

This charge transport layer coating fluid was applied by dip-coating on the charge generation layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 25° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $3\times10^5$ Gy/sec (absorbed dose within effective electron ray irradiation width/time for which arbitrary one point on sample surface exists within effective electron ray irradiation width), an accelerating voltage of 150 kV and an absorbed dose (total absorbed dose the sample has received in the step of irradiation with electron rays) of $3\times10^5$ Gy. The time from the start to completion of the irradiation with electron rays was 1.5 seconds. The irradiation with electron rays was carried out under the above conditions to cure the compound, to form a charge transport layer with a layer thickness of 18 μm, which was further subjected to heat treatment at 150° C. for 1 hour to obtain an electrophotographic photosensitive member.

The electrophotographic photosensitive member thus obtained was evaluated in an environment of a low-temperature and low-humidity environment (15° C./10% RH), using a copying machine GP40, manufactured by CANON INC. In regard to potential characteristics of the electrophotographic photosensitive member, the developing unit was detached from the main body of the copying machine, and instead a potential measuring probe was fastened to the position of development to make measurement. In that measurement, the transfer unit was kept in non-contact with the electrophotographic photosensitive member, and no paper was fed (paper non-feed). Initial-stage electrophotographic photosensitive member characteristics [dark-area potential Vd; sensitivity: setting dark-area potential to −650 V, the amount of light necessary for optically attenuating it to 170 V (light-area potential Vl); residual potential Vsl: the potential at the time the light was applied in an amount of light that was 3 times the amount of light necessary for the light-area potential Vl] were measured. Further, a 200,000-sheet paper feed running test was conducted to observe whether or not any image defects came about, and to measure the abrasion wear of the electrophotographic photosensitive member and the level of variations of light-area potential between that at the initial stage and that immediately after running, ΔVl. In measuring the abrasion wear, an eddy current layer thickness meter (manufactured by Karl Fischer GmbH) was used. The paper feed running test was conducted in an intermittent mode in which the machine was stopped once for each sheet of print.

Further, the mobility of electric charges in the charge transport layer of an electrophotographic photosensitive member produced in the same way was measured by the xerographic TOF (time-of-flight) method making use of a drum tester CYNTHIA (manufactured by Gen-Tec, Inc.). Here, electric-charge mobility at an electric-field intensity of $5\times10^5$ V/cm was measured.

The results of these are shown in Table 3.

Examples 1-2 to 1-18

Electrophotographic photosensitive members were produced in the same manner as in Example 1-1 except that Exemplary Compound No. 17, the charge transporting compound having chain polymerizable functional groups, which was used in preparing the charge transport layer coating fluid in Example 1-1 was changed for Exemplary Compounds No. 1, No. 3, No. 4, No. 5, No. 7, No. 8, No. 9, No. 12, No. 18, No. 19, No. 26, No. 27, No. 29, No. 30, No. 31, No. 33 and No. 34, respectively. Evaluation was made in the same way. The results thereof are shown in Table 3.

Example 1-19

An electrophotographic photosensitive member was produced in the same manner as in Example 1-1 except that 36 parts of Exemplary Compound No. 17, the charge transporting compound having chain polymerizable functional groups, which was used in preparing the charge transport layer coating fluid in Example 1-1 was changed for 18 parts of Exemplary Compound No. 17 and 18 parts of Exemplary Compound No. 36. Evaluation was made in the same way. The results thereof are shown in Table 3.

Example 1-20

An electrophotographic photosensitive member was produced in the same manner as in Example 1-1 except that 36 parts of Exemplary Compound No. 17, the charge transporting compound having chain polymerizable functional groups, which was used in preparing the charge transport layer coating fluid in Example 1-1 was changed for 27 parts of Exemplary Compound No. 17 and 9 parts of a compound A-1 shown below (trade name: VISCOAT #540, available from Osaka Organic Chemical Industry Ltd.). Evaluation was made in the same way. The results thereof are shown in Table 3.

Comparative Example 1-1

An electrophotographic photosensitive member was produced in the same manner as in Example 1-1 except that Exemplary Compound No. 17, the charge transporting compound having chain polymerizable functional groups, which was used in preparing the charge transport layer coating fluid in Example 1-1 was changed for a charge transporting compound (H-1) shown below, having chain polymerizable functional groups. Evaluation was made in the same way. The results thereof are shown in Table 4.

(H-1)

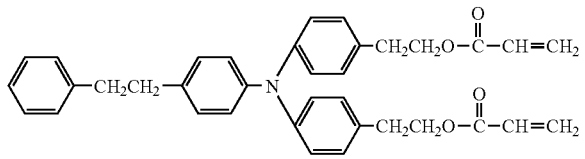

Comparative Examples 1-2 to 1-9

Electrophotographic photosensitive members were produced in the same manner as in Comparative Example 1-1 except that the charge transporting compound (H-1) having chain polymerizable functional groups which was used in preparing the charge transport layer coating fluid in Comparative Example 1-1 was changed for charge transporting compounds (H-2) to (H-9) shown below, respectively, having chain polymerizable functional groups. Evaluation was made in the same way. The results thereof are shown in Table 4.

(A-1)

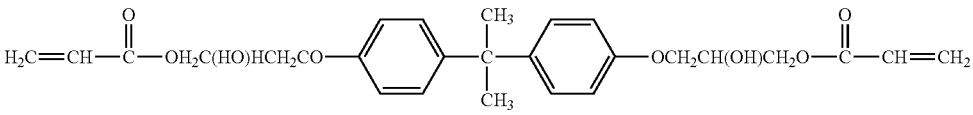

(H-2)
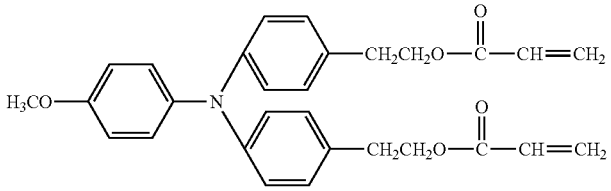
(H-3)
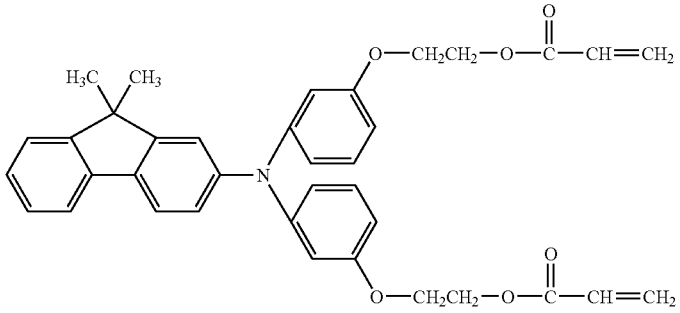
(H-4)
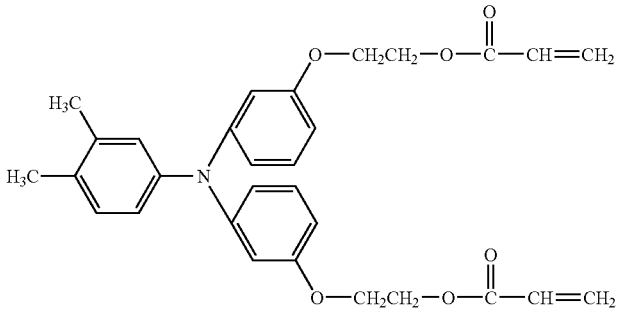
(H-5)
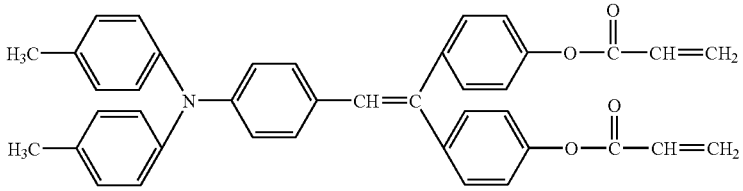
(H-6)
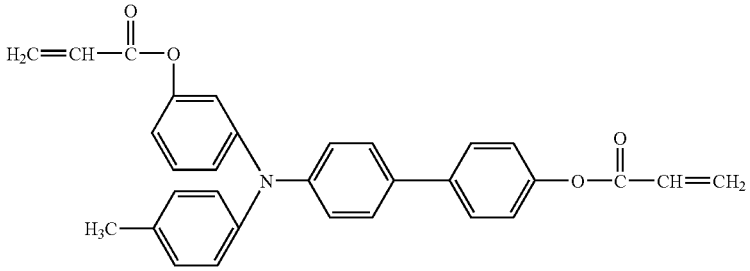

-continued (H-7)

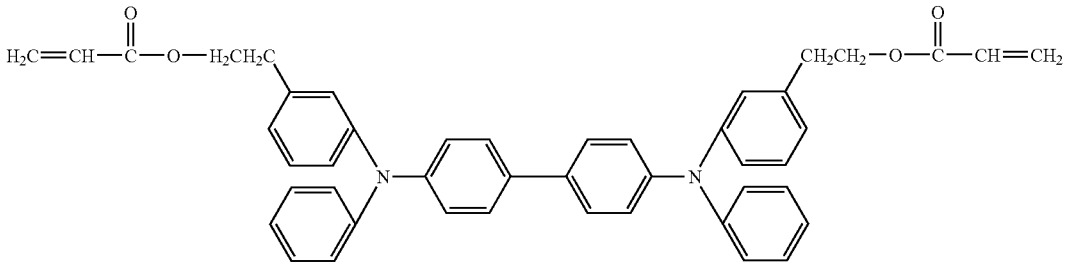

(H-8)

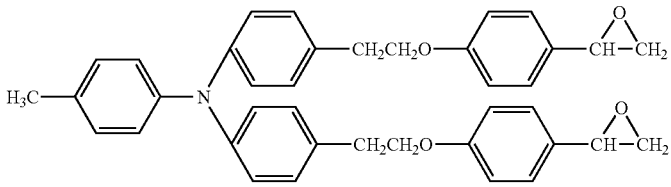

(H-9)

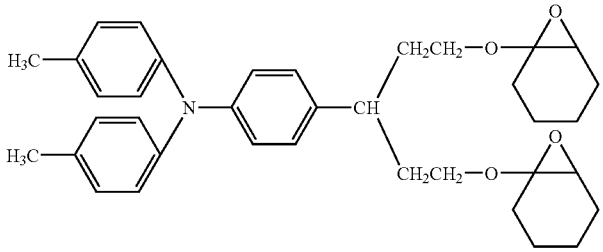

Comparative Example 1-10

An electrophotographic photosensitive member was produced in the same manner as in Comparative Example 1-1 except that 36 parts of the charge transporting compound (H-1) having chain polymerizable functional groups which was used in preparing the charge transport layer coating fluid in Comparative Example 1-1 was changed for 18 parts of a charge transporting compound (H-10) shown below, having chain polymerizable functional groups, and 18 parts of the compound (A-1) shown above. Evaluation was made in the same way. The results thereof are shown in Table 4.

(H-10)

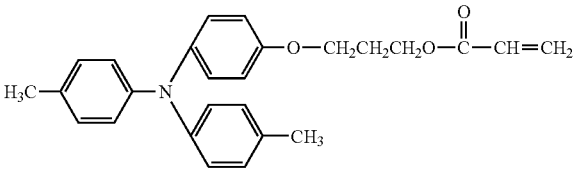

Comparative Example 1-11

An electrophotographic photosensitive member was produced in the same manner as in Comparative Example 1-10 except that the proportion of 18 parts of the compound (H-10) and 18 parts of the compound (A-1) was changed to 27 parts of the compound (H-10) and 9 parts of the compound (A-1). Evaluation was made in the same way. The results thereof are shown in Table 4.

TABLE 3

| | | | | | After 200,000 = sheet running | | | |
|---|---|---|---|---|---|---|---|---|
| Example: | Compound No. | Vd (−V) | Sensitivity (μJ/cm$^2$) | Vsl (−V) | Abrasion wear (μm) | ΔVl (−V) | Mobility (cm$^2$/V · sec) | Image defects |
| 1-1 | 17 | 650 | 0.28 | 65 | 2.4 | 15 | $2.5 \times 10^{-5}$ | None. |
| 1-2 | 1 | 650 | 0.32 | 68 | 1.7 | 25 | $1.3 \times 10^{-5}$ | None. |
| 1-3 | 3 | 650 | 0.31 | 70 | 1.8 | 18 | $1.1 \times 10^{-5}$ | None. |

TABLE 3-continued

| Example: | Compound No. | Vd (−V) | Sensitivity (μJ/cm²) | Vsl (−V) | After 200,000 = sheet running: Abrasion wear (μm) | After 200,000 = sheet running: ΔVl (−V) | After 200,000 = sheet running: Mobility (cm²/V · sec) | Image defects |
|---|---|---|---|---|---|---|---|---|
| 1-4 | 4 | 650 | 0.31 | 72 | 2.0 | 20 | $1.8 \times 10^{-5}$ | None. |
| 1-5 | 5 | 650 | 0.30 | 68 | 2.2 | 10 | $2.8 \times 10^{-5}$ | None. |
| 1-6 | 7 | 650 | 0.35 | 82 | 3.0 | 35 | $0.38 \times 10^{-5}$ | None. |
| 1-7 | 8 | 650 | 0.34 | 80 | 3.4 | 40 | $0.45 \times 10^{-5}$ | None. |
| 1-8 | 9 | 650 | 0.30 | 68 | 1.8 | 15 | $4.5 \times 10^{-5}$ | None. |
| 1-9 | 12 | 650 | 0.34 | 84 | 4.0 | 42 | $0.35 \times 10^{-5}$ | None. |
| 1-10 | 18 | 650 | 0.29 | 65 | 2.3 | 15 | $2.9 \times 10^{-5}$ | None. |
| 1-11 | 19 | 650 | 0.34 | 82 | 3.6 | 38 | $0.62 \times 10^{-5}$ | None. |
| 1-12 | 26 | 650 | 0.35 | 85 | 3.0 | 40 | $0.72 \times 10^{-5}$ | None. |
| 1-13 | 27 | 650 | 0.29 | 63 | 2.2 | 25 | $5.8 \times 10^{-5}$ | None. |
| 1-14 | 29 | 650 | 0.28 | 64 | 2.2 | 20 | $4.6 \times 10^{-5}$ | None. |
| 1-15 | 30 | 650 | 0.28 | 58 | 2.0 | 15 | $6.5 \times 10^{-5}$ | None. |
| 1-16 | 31 | 650 | 0.33 | 80 | 4.7 | 37 | $0.75 \times 10^{-5}$ | None. |
| 1-17 | 33 | 650 | 0.33 | 78 | 5.8 | 35 | $0.80 \times 10^{-5}$ | None. |
| 1-18 | 34 | 650 | 0.29 | 65 | 2.6 | 18 | $2.8 \times 10^{-5}$ | None. |
| 1-19 | 17/36 | 650 | 0.28 | 70 | 1.9 | 20 | $1.8 \times 10^{-5}$ | None. |
| 1-20 | 17/A-1 | 650 | 0.34 | 85 | 2.2 | 38 | $0.64 \times 10^{-5}$ | None. |

TABLE 4

| Comparative Example: | Compound No. | Vd (−V) | Sensitivity (μJ/cm²) | Vsl (−V) | After 200,000 = sheet running: Abrasion wear (μm) | After 200,000 = sheet running: ΔVl (−V) | After 200,000 = sheet running: Mobility (cm²/V · sec) | Image defects |
|---|---|---|---|---|---|---|---|---|
| 1-1 | H-1 | 650 | 0.41 | 85 | 2.4 | 80 | $0.12 \times 10^{-5}$ | None. |
| 1-2 | H-2 | 650 | 0.39 | 85 | 1.9 | 85 | $0.20 \times 10^{-5}$ | None. |
| 1-3 | H-3 | 650 | 0.37 | 70 | 3.4 | 95 | $0.18 \times 10^{-5}$ | None. |
| 1-4 | H-4 | 650 | 0.50 | 105 | 2.4 | 125 | $0.09 \times 10^{-5}$ | None. |
| 1-5 | H-5 | 650 | 0.38 | 82 | 6.0 | 85 | $0.35 \times 10^{-5}$ | Scratches appears in images on 130,000th sheet, thereafter scratches grow and increase in number, and fog appears after 170,000th sheet. |
| 1-6 | H-6 | 650 | 0.46 | 115 | 2.4 | 120 | $0.11 \times 10^{-5}$ | None. |
| 1-7 | H-7 | 650 | 0.50 | 70 | 8.5 | 100 | $0.25 \times 10^{-5}$ | Scratches appear in images on 70,000th sheet, thereafter scratches grow and increase in number, and fog appears after 130,000th sheet. |
| 1-8 | H-8 | 650 | 0.59 | 75 | — | — | $0.01 \times 10^{-5}$ | Scratches appear in images on 35,000th sheet, thereafter scratches grow and increase in number, abrasion comes to 10 μm on 70,000th sheet, and thereafter fog appears wholly, where running is stopped. |
| 1-9 | H-9 | 650 | 0.54 | 105 | — | — | $0.03 \times 10^{-5}$ | Scratches appear in images on 25,000th sheet, thereafter scratches grow and increase in number, abrasion comes to 10 μm on 62,000th sheet, and thereafter fog appears wholly, where running is stopped. |
| 1-10 | H-10/ A-1 | 650 | 0.64 | 134 | 10.3 | 170 | $0.04 \times 10^{-5}$ | Scratches appear in images on 45,000th sheet, thereafter scratches grow and increase in number, and fog appears after 80,000th sheet. |
| 1-11 | H-10/ A-1 | 650 | 0.59 | 82 | 13.6 | 145 | $0.07 \times 10^{-5}$ | Scratches appear in images on 20,000th sheet, thereafter scratches grow and increase in number, and fog appears after 65,000th sheet. |

As is evident from Tables 3 and 4, it has been found that the electrophotographic photosensitive member in which the charge transporting compound having the chain polymerizable functional groups according to the present invention is used in the charge transport layer shows good electrophotographic photosensitive member characteristics at the initial stage, and also exhibits very superior running performance as having a small abrasion wear as a result of running, not causing any image defects due to scratches or the like and showing small potential variations during running. It has further been found that the charge transport layer formed by curing the charge transporting compound having chain polymerizable functional groups according to the present invention shows a very good mobility of electric charges.

Example 2-1

1 part of polyamide resin (6-60-64-12 nylon quadripolymer) and 3 parts of 8-nylon resin (methoxymethylated nylon; methoxylation percentage: about 30%) were dissolved in a mixed solvent of 50 parts of methanol and 40 parts of butanol to prepare an intermediate-layer coating fluid. This coating fluid was applied by dip coating on an aluminum cylinder of 30 mm in diameter, having been processed by honing, and the wet coating formed was dried at 100° C. for 20 minutes to form an intermediate layer with a layer thickness of 0.6 μm.

2.5 parts of hydroxygallium phthalocyanine crystals having strong peaks at 7.4° and 28.2° of Bragg angles (2θ plus-minus 0.2°) in CuKα characteristic X-ray diffraction, 1.0 part of polyvinyl butyral (trade name: S-LEC BM2, available from Sekisui Chemical Co., Ltd.) and 35 parts of cyclohexanone were subjected to dispersion for 24 hours by means of a sand mill making use of glass beads of 1 mm in diameter, and thereafter 60 parts of ethyl acetate was added to prepare a charge generation layer coating fluid. This coating fluid was applied by dip coating on the intermediate layer, followed by drying at 105° C. for 10 minutes to form a charge generation layer with a layer thickness of 0.14 μm.

Next, 1.25 parts of fluorine-atom-containing resin (trade name: GF-300, available from Toagosei Chemical Industry Co., Ltd.) as a dispersant was dissolved in a mixture of 37.5 parts of 1,1,2,2,3,3,4-heptafluorocyclopentane (trade name: ZEOROLA H, available from Nippon Zeon Co., Ltd.) and 37.5 parts of 1-propanol, and thereafter 10 parts of tetrafluoroethylene resin powder (trade name: LUBRON L-2, available from Daikin Industries, Ltd.) was added as a lubricant, followed by uniform dispersion by carrying out treatment three times under a pressure of 600 kgf/cm$^2$ by means of a high-pressure dispersion machine (trade name: MICROFLUIDIZER M-110EH, manufactured by Microfluidics Inc., USA). The dispersion obtained was subjected to pressure filtration with a polytetrafluoroethylene (PTFE) membrane filter of 10 μm in pore size to prepare a lubricant dispersion. Next, 36 parts of Exemplary Compound No. 41 as shown in Table 2, the charge transporting compound having chain polymerizable functional groups, 16.2 parts of the lubricant dispersion, 24 parts of 1,1,2,2,3,3,4-heptafluorocyclopentane and 24 parts of 1-propanol were mixed and stirred, followed by pressure filtration with a membrane filter of 5 μm in pore size, made of PTFE, to prepare a charge transport layer coating fluid.

This charge transport layer coating fluid was applied by dip-coating on the charge generation layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 25° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $1.5\times10^5$ Gy/sec (absorbed dose within effective electron ray irradiation width/time for which arbitrary one point on sample surface exists within effective electron ray irradiation width), an accelerating voltage of 100 kV and an absorbed dose (total absorbed dose the sample has received in the step of irradiation with electron rays) of $1.5\times10^5$ Gy. The time from the start to completion of the irradiation with electron rays was 1.5 seconds. The irradiation with electron rays was carried out under the above conditions to cure the compound, to form a charge transport layer with a layer thickness of 20 μm, which was further subjected to heat treatment at 150° C. for 1 hour to obtain an electrophotographic photosensitive member.

The electrophotographic photosensitive member thus obtained was evaluated in an environment of a normal-temperature and low-humidity environment (23° C./10% RH), using a copying machine GP40, manufactured by CANON INC. In regard to potential characteristics of the electrophotographic photosensitive member, the developing unit was detached from the main body of the copying machine, and instead a potential measuring probe was fastened to the position of development to make measurement. In that measurement, the transfer unit was kept in non-contact with the electrophotographic photosensitive member, and no paper was fed (paper non-feed). Initial-stage electrophotographic photosensitive member characteristics [dark-area potential Vd; sensitivity: setting dark-area potential to −650 V, the amount of light necessary for optically attenuating it to 170 V (light-area potential Vl); residual potential Vsl: the potential at the time the light was applied in an amount of light that was 3 times the amount of light necessary for the light-area potential Vl] were measured. Further, a 200,000-sheet paper feed running test was conducted to observe whether or not any image defects came about, and to measure the abrasion wear of the electrophotographic photosensitive member and the level of variations of light-area potential between that at the initial stage and that immediately after running, ΔVl. In measuring the abrasion wear, an eddy current layer thickness meter (manufactured by Karl Fischer GmbH) was used. The paper feed running test was conducted in an intermittent mode in which the machine was stopped once for each sheet of print.

Further, the mobility of electric charges in the charge transport layer of an electrophotographic photosensitive member produced in the same way was measured by the xerographic TOF (time-of-flight) method making use of a drum tester CYNTHIA (manufactured by Gen-Tec, Inc.). Here, electric-charge mobility at an electric-field intensity of $5\times10^5$ V/cm was measured.

The results of these are shown in Table 5.

Examples 2-2 to 2-32

Electrophotographic photosensitive members were produced in the same manner as in Example 2-1 except that Exemplary Compound No. 41, the charge transporting compound having chain polymerizable functional groups, which was used in preparing the charge transport layer coating fluid in Example 2-1 was changed for Exemplary Compounds No. 42, No. 43, No. 44, No. 45, No. 46, No. 47, No. 48, No. 49, No. 50, No. 57, No. 58, No. 59, No. 60, No. 61, No. 64, No. 65, No. 66, No. 72, No. 73, No. 74, No. 75, No. 77, No. 78, No. 80, No. 81, No. 82, No. 83, No. 84, No. 85, No. 87 and No. 89, respectively. Evaluation was made in the same way. The results thereof are shown in Table 5.

Example 2-33

An electrophotographic photosensitive member was produced in the same manner as in Example 2-1 except that 36 parts of Exemplary Compound No. 41, the charge transporting compound having chain polymerizable functional groups, which was used in preparing the charge transport layer coating fluid in Example 2-1 was changed for 18 parts of Exemplary Compound No. 41 and 18 parts of Exemplary Compound No. 72. Evaluation was made in the same way. The results thereof are shown in Table 5.

Example 2-34

An electrophotographic photosensitive member was produced in the same manner as in Example 2-1 except that 36 parts of Exemplary Compound No. 41, the charge transporting compound having chain polymerizable functional groups, which was used in preparing the charge transport layer coating fluid in Example 2-1 was changed for 27 parts of Exemplary Compound No. 41 and 9 parts of a compound A-1 shown below (trade name: VISCOAT #540, available from Osaka Organic Chemical Industry Ltd.). Evaluation was made in the same way. The results thereof are shown in Table 5.

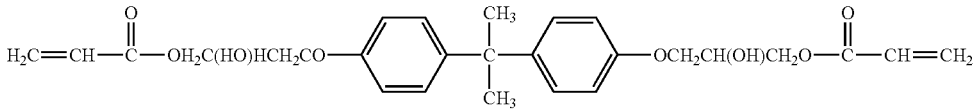

(A-1)

TABLE 5

| Example: | Compound No. | Vd (−V) | Sensitivity (μJ/cm²) | Vsl (−V) | After 200,000 = sheet running: Abrasion wear (μm) | After 200,000 = sheet running: ΔVl (−V) | Mobility (cm²/V · sec) | Image defects |
|---|---|---|---|---|---|---|---|---|
| 2-1 | 41 | 650 | 0.31 | 65 | 2.4 | 20 | $1.8 \times 10^{-5}$ | None. |
| 2-2 | 42 | 650 | 0.30 | 60 | 2.3 | 20 | $2.8 \times 10^{-5}$ | None. |
| 2-3 | 43 | 650 | 0.29 | 58 | 2.5 | 15 | $3.0 \times 10^{-5}$ | None. |
| 2-4 | 44 | 650 | 0.29 | 55 | 2.7 | 20 | $3.0 \times 10^{-5}$ | None. |
| 2-5 | 45 | 650 | 0.37 | 85 | 2.7 | 40 | $0.60 \times 10^{-5}$ | None. |
| 2-6 | 46 | 650 | 0.35 | 80 | 2.9 | 30 | $0.92 \times 10^{-5}$ | None. |
| 2-7 | 47 | 650 | 0.35 | 80 | 2.7 | 35 | $0.70 \times 10^{-5}$ | None. |
| 2-8 | 48 | 650 | 0.30 | 65 | 2.5 | 18 | $1.8 \times 10^{-5}$ | None. |
| 2-9 | 49 | 650 | 0.35 | 85 | 5.5 | 35 | $0.80 \times 10^{-5}$ | None. |
| 2-10 | 50 | 650 | 0.34 | 75 | 4.4 | 30 | $0.95 \times 10^{-5}$ | None. |
| 2-11 | 57 | 650 | 0.29 | 55 | 2.3 | 15 | $4.0 \times 10^{-5}$ | None. |
| 2-12 | 58 | 650 | 0.36 | 85 | 2.8 | 45 | $0.64 \times 10^{-5}$ | None. |
| 2-13 | 59 | 650 | 0.37 | 88 | 2.7 | 40 | $0.92 \times 10^{-5}$ | None. |
| 2-14 | 60 | 650 | 0.31 | 68 | 2.5 | 28 | $1.5 \times 10^{-5}$ | None. |
| 2-15 | 61 | 650 | 0.29 | 60 | 2.2 | 25 | $3.2 \times 10^{-5}$ | None. |
| 2-16 | 64 | 650 | 0.34 | 72 | 3.0 | 42 | $1.0 \times 10^{-5}$ | None. |
| 1-17 | 65 | 650 | 0.38 | 88 | 4.0 | 48 | $0.55 \times 10^{-5}$ | None. |
| 2-18 | 66 | 650 | 0.38 | 85 | 2.5 | 45 | $0.65 \times 10^{-5}$ | None. |
| 2-19 | 72 | 650 | 0.28 | 55 | 2.0 | 15 | $4.0 \times 10^{-5}$ | None. |
| 2-20 | 73 | 650 | 0.28 | 55 | 2.2 | 15 | $3.8 \times 10^{-5}$ | None. |
| 2-21 | 74 | 650 | 0.34 | 75 | 6.0 | 40 | $0.82 \times 10^{-5}$ | None. |
| 2-22 | 75 | 650 | 0.33 | 75 | 5.8 | 45 | $1.0 \times 10^{-5}$ | None. |
| 2-23 | 77 | 650 | 0.33 | 70 | 3.5 | 50 | $0.77 \times 10^{-5}$ | None. |
| 2-24 | 78 | 650 | 0.38 | 80 | 3.8 | 55 | $0.55 \times 10^{-5}$ | None. |
| 2-25 | 80 | 650 | 0.32 | 55 | 2.3 | 20 | $2.4 \times 10^{-5}$ | None. |
| 2-26 | 81 | 650 | 0.35 | 70 | 3.0 | 45 | $0.85 \times 10^{-5}$ | None. |
| 2-27 | 82 | 650 | 0.38 | 85 | 3.5 | 70 | $0.60 \times 10^{-5}$ | None. |
| 2-28 | 83 | 650 | 0.29 | 55 | 2.1 | 18 | $3.2 \times 10^{-5}$ | None. |
| 2-29 | 84 | 650 | 0.37 | 80 | 3.8 | 50 | $0.58 \times 10^{-5}$ | None. |
| 2-30 | 85 | 650 | 0.38 | 85 | 3.5 | 80 | $0.45 \times 10^{-5}$ | None. |
| 2-31 | 87 | 650 | 0.28 | 58 | 2.4 | 25 | $3.0 \times 10^{-5}$ | None. |
| 2-32 | 89 | 650 | 0.32 | 60 | 2.4 | 30 | $1.5 \times 10^{-5}$ | None. |
| 2-33 | 41/72 | 650 | 0.31 | 60 | 2.2 | 20 | $2.3 \times 10^{-5}$ | None. |
| 2-34 | 41/A-1 | 650 | 0.38 | 85 | 2.7 | 40 | $0.45 \times 10^{-5}$ | None. |

Comparative Example 2-1

An electrophotographic photosensitive member was produced in the same manner as in Example 2-1 except that Exemplary Compound No. 41, the charge transporting compound having chain polymerizable functional groups, which was used in preparing the charge transport layer coating fluid in Example 2-1 was changed for a charge transporting compound (H-13) shown below, having chain polymerizable functional groups. Evaluation was made in the same way. The results thereof are shown in Table 6.

(H-13)

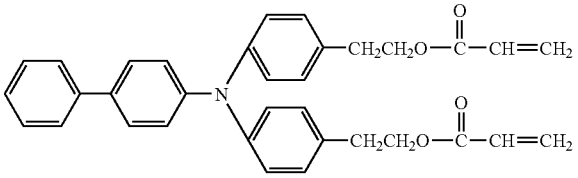

Comparative Examples 2-2 to 2-9

Electrophotographic photosensitive members were produced in the same manner as in Comparative Example 2-1 except that the charge transporting compound (H-13) having chain polymerizable functional groups which was used in preparing the charge transport layer coating fluid in Comparative Example 2-1 was changed for charge transporting compounds (H-14) to (H-21) shown below, having chain polymerizable functional groups. Evaluation was made in the same way. The results thereof are shown in Table 6.

(H-14)

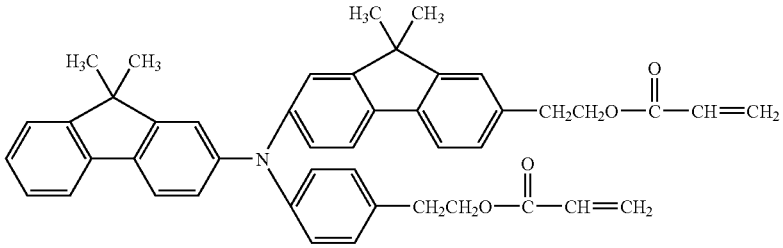

(H-15)

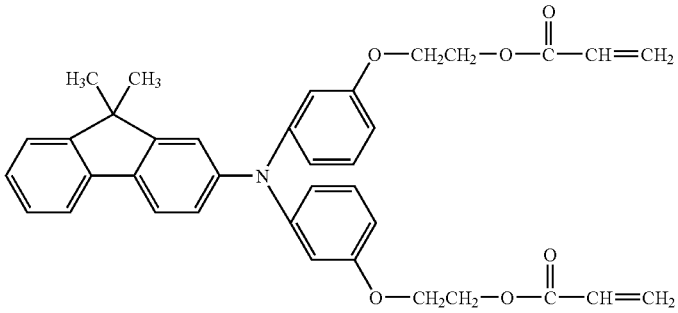

(H-16)

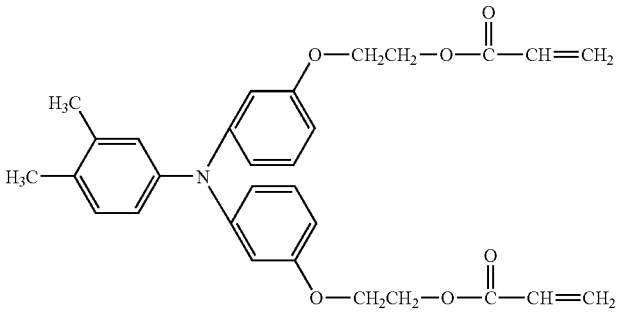

(H-17)

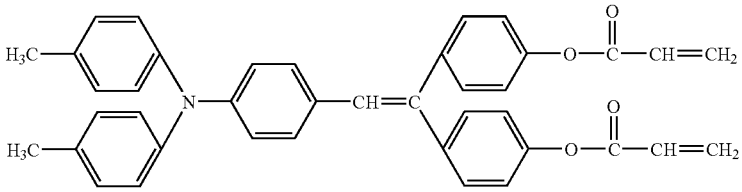

-continued (H-18)

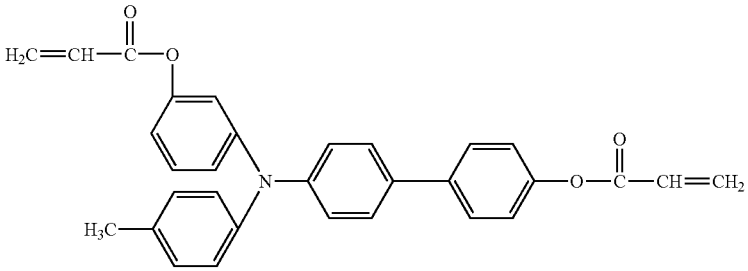

(H-19)

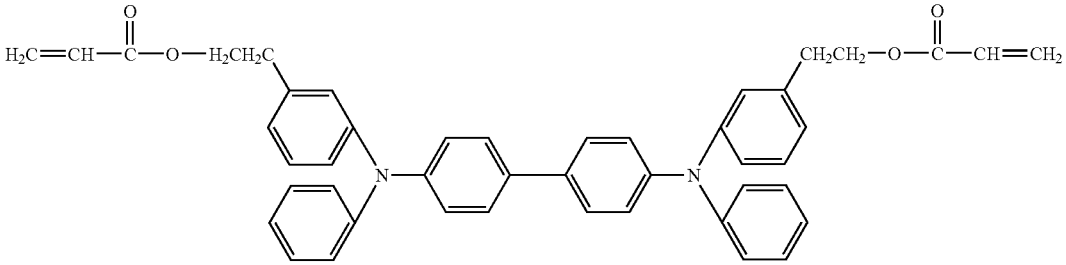

(H-20)

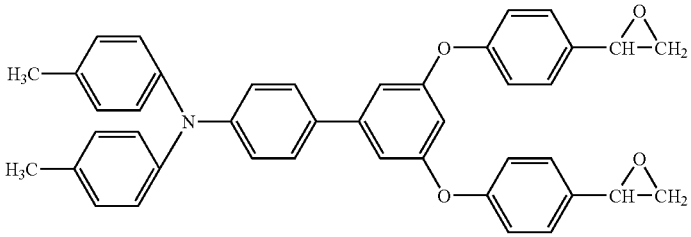

(H-21)

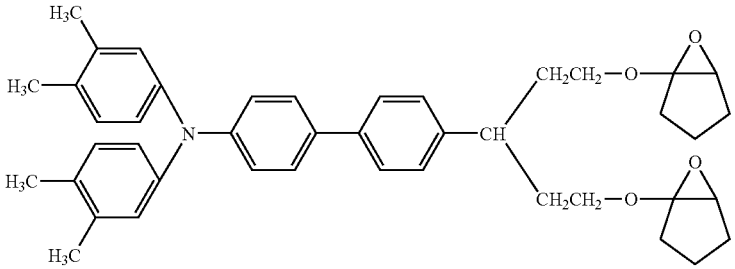

Comparative Example 2-10

An electrophotographic photosensitive member was produced in the same manner as in Comparative Example 2-1 except that 36 parts of the charge transporting compound (H-13) having chain polymerizable functional groups which was used in preparing the charge transport layer coating fluid in Comparative Example 2-1 was changed for 18 parts of a charge transporting compound (H-22) shown below, having chain polymerizable functional groups, and 18 parts of the compound (A-1) shown above. Evaluation was made in the same way. The results thereof are shown in Table 6.

(H-22)

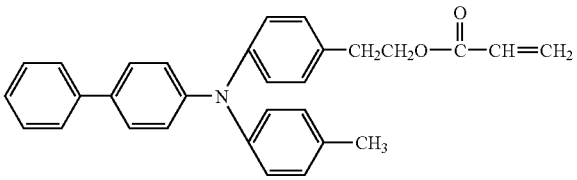

Comparative Example 2-11

An electrophotographic photosensitive member was produced in the same manner as in Comparative Example 2-10 except that the proportion of 18 parts of the compound (H-22) and 18: parts of the compound (A-1) was changed to 27 parts of the compound (H-22) and 9 parts of the compound (A-1). Evaluation was made in the same way. The results thereof are shown in Table 6.

TABLE 6

| Comparative Example: | Compound No. | Vd (−V) | Sensitivity (μJ/cm$^2$) | Vsl (−V) | After 200,000 = sheet running: Abrasion wear (μm) | After 200,000 = sheet running: ΔVl (−V) | Mobility (cm$^2$/V · sec) | Image defects |
|---|---|---|---|---|---|---|---|---|
| 2-1 | H-13 | 650 | 0.43 | 95 | 2.6 | 100 | $0.10 \times 10^{-5}$ | None. |
| 2-2 | H-14 | 650 | 0.42 | 85 | 3.0 | 108 | $0.15 \times 10^{-5}$ | None. |
| 2-3 | H-15 | 650 | 0.39 | 65 | 3.4 | 105 | $0.18 \times 10^{-5}$ | None. |
| 2-4 | H-16 | 650 | 0.51 | 100 | 2.5 | 130 | $0.09 \times 10^{-5}$ | None. |
| 2-5 | H-17 | 650 | 0.40 | 80 | 6.1 | 85 | $0.35 \times 10^{-5}$ | Scratches appear in images on 140,000th sheet, thereafter scratches grow and increase in number, and fog appears after 180,000th sheet. |
| 2-6 | H-18 | 650 | 0.48 | 110 | 2.6 | 130 | $0.11 \times 10^{-5}$ | None. |
| 2-7 | H-19 | 650 | 0.53 | 65 | 8.5 | 110 | $0.25 \times 10^{-5}$ | Scratches appear in images on 80,000th sheet, thereafter scratches grow and increase in number, and fog appears after 140,000th sheet. |
| 2-8 | H-20 | 650 | 0.54 | 105 | — | — | $0.08 \times 10^{-5}$ | Scratches appear in images on 25,000th sheet, thereafter scratches grow and increase in number, abrasion comes to 13 μm on 70,000th sheet, and thereafter fog appears wholly, where running is stopped. |
| 2-9 | H-21 | 650 | 0.63 | 115 | — | — | $0.09 \times 10^{-5}$ | Scratches appear in images on 20,000th sheet, thereafter scratches grow and increase in number, abrasion comes to 13 μm on 55,000th sheet, and thereafter fog appears wholly, where running is stopped. |
| 2-10 | H-22/ A-1 | 650 | 0.67 | 125 | 11.2 | 180 | $0.03 \times 10^{-5}$ | Scratches appear in images on 55,000th sheet, thereafter scratches grow and increase in number, and fog appears after 90,000th sheet. |
| 2-11 | H-22/ A-1 | 650 | 0.63 | 92 | 12.9 | 165 | $0.06 \times 10^{-5}$ | Scratches appear in images on 30,000th sheet, thereafter scratches grow and increase in number, and fog appears after 65,000th sheet. |

As is evident from Tables 5 and 6, it has been found that the electrophotographic photosensitive member in which the charge transporting compound having the chain polymerizable functional groups according to the present invention is used in the charge transport layer shows good electrophotographic photosensitive member characteristics at the initial stage, and also exhibits very superior running performance as having a small abrasion wear as a result of running, not causing any image defects due to scratches or the like and showing small potential variations during running. It has further been found that the charge transport layer formed by curing the charge transporting compound having chain polymerizable functional groups according to the present invention shows a very good mobility of electric charges.

Example 1-21

The procedure of Example 1-1 was repeated to form the intermediate layer and the charge generation layer. Next, as charge transporting materials 4.0 parts of a compound (D-1) and 0.5 part of a compound (D-2) which were as shown below, and 5.5 parts of bisphenol-Z polycarbonate (viscosity average molecular weight: 45,000) were dissolved in 38 parts of monochlorobenzene to prepare a charge transport layer coating fluid. This coating fluid was applied by dip-coating on the charge generation layer, followed by drying at 100° C. for 60 minutes to form a charge transport layer with a layer thickness of 12 μm.

(D-1)

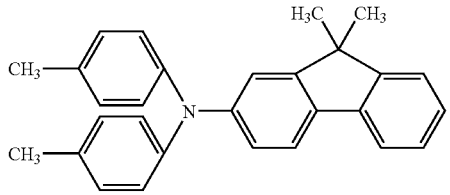

(D-2)

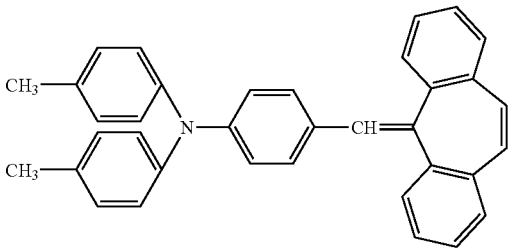

Next, 1.25 parts of fluorine-atom-containing resin (trade name: GF-300, available from Toagosei Chemical Industry Co., Ltd.) as a dispersant was dissolved in a mixture of 37.5 parts of 1,1,2,2,3,3,4-heptafluorocyclopentane (trade name: ZEOROLA H, available from Nippon Zeon Co., Ltd.) and 37.5 parts of 1-propanol, and thereafter 25 parts of tetrafluoroethylene resin powder (trade name: LUBRON L-2, available from Daikin Industries, Ltd.) was added as a lubricant, followed by uniform dispersion by carrying out treatment three times under a pressure of 600 kgf/cm$^2$ by means of a high-pressure dispersion machine (trade name: MICROFLUIDIZER M-110EH, manufactured by Microfluidics Inc. USA). The dispersion obtained was subjected to pressure filtration with a polytetrafluoroethylene (PTFE) membrane filter of 10 μm in pore size to prepare a lubricant dispersion. Next, 36 parts of Exemplary Compound No. 3 as shown in Table 1, the charge transporting compound having chain polymerizable functional groups, 16.2 parts of the lubricant dispersion, 24 parts of 1,1,2,2,3,3,4-heptafluorocyclopentane and 24 parts of 1-propanol were mixed and stirred, followed by pressure filtration with a membrane filter of 5 μm in pore size, made of PTFE, to prepare a protective layer coating fluid.

This protective layer coating fluid was applied by dip-coating on the charge transport layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 25° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $2.5\times10^5$ Gy/sec (absorbed dose within effective electron ray irradiation width/time for which arbitrary one point on sample surface exists within effective electron ray irradiation width), an accelerating voltage of 150 Kv and an absorbed dose (total absorbed dose the sample has received in the step of irradiation with electron rays) of $1.5\times10^5$ Gy. The time from the start to completion of the irradiation with electron rays was 1.5 seconds. The irradiation with electron rays was carried out under the above conditions to cure the compound, to form a protective layer with a layer thickness of 5 μm, which was further subjected to heat treatment at 150° C. for 1 hour to obtain an electrophotographic photosensitive member.

The electrophotographic photosensitive member (drum) thus obtained was fitted to an altered machine of LASER JET 4300n, manufactured by Hewlett-Packard Co. (so altered that the DC component and amount of light of charging were changeable). Under conditions of normal temperature and normal humidity (23° C./50% RH), the charging was so set that the initial-stage dark-area potential Vd came to be −650 V by changing the DC component and amount of light of charging, and this electrophotographic photosensitive member was irradiated with laser light of 780 nm in wavelength to measure the amount of light necessary for attenuating the potential of −650 V to −170 V (light-area potential Vl) to regard it as sensitivity. Further, the potential where the light was applied in an amount of 20 μJ/cm$^2$ was regarded as residual potential Vr, and its initial-stage characteristics were measured and evaluated. To measure the potential, a probe was fitted to the position of the developing assembly.

Next, a continuous 10,000-sheet paper feed running test was conducted, and the levels of variations in dark-area potential and light-area potential between those at the initial stage and those immediately after running, ΔVd and ΔVl, respectively, and abrasion wear were measured. Here, the potentials at the initial-stage were set as in the foregoing, i.e., dark-area potential: −650 V and light-area potential: −170 V. The paper feed running was performed using as a running test pattern an image in which lines of about 2 mm in width were lengthwise and breadthwise printed at intervals of 7 mm.

Further, together with the above running test, evaluation was also made on ghosts at the initial stage and after running. To make evaluation on the ghosts, as a printed image, an image sample was printed in which square solid black image areas of 25 mm for each side were arranged at the part of one round of the electrophotographic photosensitive member and a whole-area halftone image (an image with a dot density of one dot and one space) was formed at the part of second and subsequent rounds of the electrophotographic photosensitive member. Whether or not the phenomenon of ghosts occurred was examined from this image sample. As image samples, prints were sampled for each of development volumes F5 (center value) and F9 (low density) of the printer. As evaluation criteria, a case in which no ghost was visually seen at all in all modes was evaluated as Rank 1, a case in which ghosts were thinly seen in the F9 mode as Rank 2, a case in which ghosts were thinly seen in all modes as Rank 3, and a case in which ghosts were clearly seen in all modes as Rank 4.

The results of these are shown in Table 7.

Examples 1-22 to 1-31

Electrophotographic photosensitive members were produced in the same manner as in Example 1-21 except that Exemplary Compound No. 3, the charge transporting compound having chain polymerizable functional groups, which was used in preparing the charge transport layer coating fluid in Example 1-21 was changed for Exemplary Compounds No. 8, No. 9, No. 10, No. 11, No. 12, No. 17, No. 26, No. 29, No. 31 and No. 34, respectively. Evaluation was made in the same way. The results thereof are shown in Table 7.

Example 1-32

An electrophotographic photosensitive member was produced in the same manner as in Example 1-21 except that 36 parts of Exemplary Compound No. 3, the charge transporting compound having chain polymerizable functional groups, which was used in preparing the protective layer coating fluid in Example 1-21 was changed for 24 parts of Exemplary Compound No. 3 and 12 parts of a compound A-2 shown below (trade name: KAYARAD TMPTA, available from Nippon Kayaku Co., Ltd.). Evaluation was made in the same way. The results thereof are shown in Table 7.

(A-2)

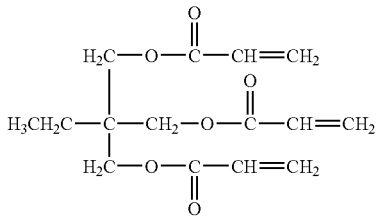

Comparative Example 1-12

An electrophotographic photosensitive member was produced in the same manner as in Example 1-21 except that Exemplary Compound No. 3, the charge transporting compound having chain polymerizable functional groups, which was used in preparing the protective layer coating fluid in Example 1-21 was changed for the charge transporting compound (H-4) shown previously, having chain polymerizable functional groups. Evaluation was made in the same way. The results thereof are shown in Table 8.

Comparative Examples 1-13 to 1-18

Electrophotographic photosensitive members were produced in the same manner as in Comparative Example 1-12 except that the charge transporting compound (H-4) having chain polymerizable functional groups which was used in preparing the protective layer coating fluid in Comparative Example 1-12 was changed for the charge transporting compounds (H-1), (H-2), (H-5) and (H-7) shown previously, having chain polymerizable functional groups, and charge transporting compounds (H-11) and (H-12) shown below, having chain polymerizable functional groups. Evaluation was made in the same way. The results thereof are shown in Table 8.

(H-11)

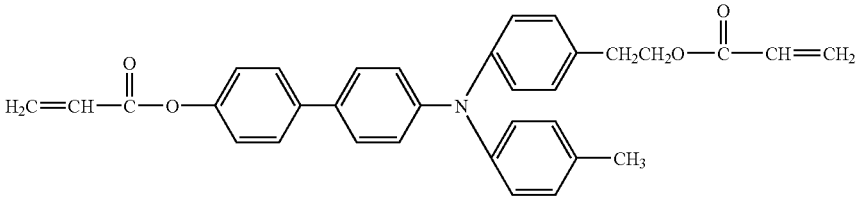

(H-12)

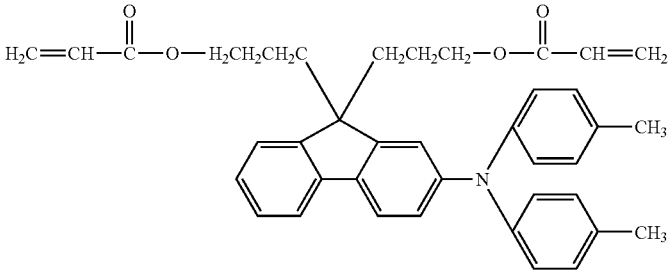

Comparative Example 1-19

An electrophotographic photosensitive member was produced in the same manner as in Comparative Example 1-12 except that 36 parts of the charge transporting compound (H-4) having chain polymerizable functional groups which was used in preparing the protective layer coating fluid in Comparative Example 1-12 was changed for 18 parts of the charge transporting compound (H-10) shown previously, having chain polymerizable functional groups, and 18 parts of the compound (A-2) shown previously. Evaluation was made in the same way. The results thereof are shown in Table 8.

Example 2-35

The procedure of Example 2-1 was repeated to form the intermediate layer and the charge generation layer. Next, as charge transporting materials 4.5 parts of a compound (D-1) and 0.5 part of a compound (D-2) which were as shown below, and 5.5 parts of bisphenol-Z polycarbonate (viscosity average molecular weight: 45,000) were dissolved in 38 parts of monochlorobenzene to prepare a charge transport layer coating fluid. This coating fluid was applied by dip-coating on the charge generation layer, followed by drying at 100° C. for 60 minutes to form a charge transport layer with a layer thickness of 10 μm.

TABLE 7

| | | Potential characteristics and images at initial stage | | | Potential characteristics and images after 10,000-sheet running | | | |
|---|---|---|---|---|---|---|---|---|
| Example: | Compound No. | Sensitivity (μJ/cm$^2$) | Vr (−V) | Ghost rank | ΔVd (−V) | ΔVl (−V) | Ghost rank | Abrasion wear (μm) |
| 1-21 | 3 | 0.28 | 60 | 1 | 5 | 10 | 1 | 0.1 or less |
| 1-22 | 8 | 0.31 | 70 | 1 | 5 | 20 | 2 | 0.23 |
| 1-23 | 9 | 0.28 | 55 | 1 | 5 | 5 | 1 | 0.1 or less |
| 1-24 | 10 | 0.28 | 57 | 1 | 3 | 5 | 1 | 0.12 |
| 1-25 | 11 | 0.32 | 60 | 1 | 5 | 25 | 2 | 0.35 |
| 1-26 | 12 | 0.32 | 75 | 1 | 10 | 35 | 2 | 0.28 |
| 1-27 | 17 | 0.27 | 52 | 1 | 3 | 5 | 1 | 0.1 or less |
| 1-28 | 26 | 0.34 | 78 | 1 | 12 | 38 | 2 | 0.18 |
| 1-29 | 29 | 0.26 | 50 | 1 | 5 | 5 | 1 | 0.12 |
| 1-30 | 31 | 0.30 | 68 | 1 | 10 | 20 | 2 | 0.30 |
| 1-31 | 34 | 0.28 | 50 | 1 | 5 | 5 | 1 | 0.12 |
| 1-32 | 3/A-2 | 0.35 | 82 | 1 | 15 | 35 | 2 | 0.11 |

TABLE 8

| | | Potential characteristics and images at initial stage | | | Potential characteristics and images after 10,000-sheet running | | | |
|---|---|---|---|---|---|---|---|---|
| Comparative Example: | Compound No. | Sensitivity (μJ/cm$^2$) | Vr (−V) | Ghost rank | ΔVd (−V) | ΔVl (−V) | Ghost rank | Abrasion wear (μm) |
| 1-12 | H-4 | 0.38 | 75 | 1 | 10 | 95 | 3 | 0.15 |
| 1-13 | H-1 | 0.35 | 78 | 2 | 15 | 65 | 3 | 0.12 |
| 1-14 | H-2 | 0.32 | 65 | 1 | 10 | 70 | 4 | 0.1 or less |
| 1-15 | H-5 | 0.30 | 70 | 2 | 10 | 75 | 4 | 0.21 |
| 1-16 | H-7 | 0.38 | 65 | 1 | 5 | 65 | 3 | 0.62 |
| 1-17 | H-11 | 0.40 | 85 | 2 | 20 | 100 | 4 | 0.34 |
| 1-18 | H-12 | 0.30 | 65 | 1 | 10 | 55 | 3 | 0.29 |
| 1-19 | H-10/A-2 | 0.48 | 80 | 3 | 15 | 105 | 4 | 0.31 |

As is evident from Tables 7 and 8, it has been found that the electrophotographic photosensitive member in which the charge transporting compound having the chain polymerizable functional groups according to the present invention is used in the protective layer shows good electrophotographic photosensitive member characteristics at the initial stage of course, and also exhibits very superior running performance as having a small abrasion wear as a result of running, showing small potential variations during running, and showing good results on the ghosts both at the initial stage and after running.

(D-1)

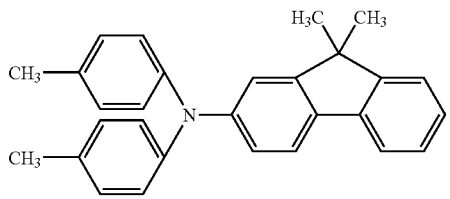

-continued (D-2)

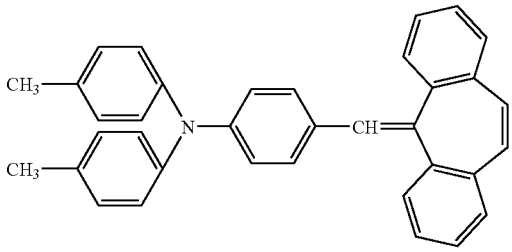

Next, 1.25 parts of fluorine-atom-containing resin (trade name: GF-300, available from Toagosei Chemical Industry Co., Ltd.) as a dispersant was dissolved in a mixture of 37.5 parts of 1,1,2,2,3,3,4-heptafluorocyclopentane (trade name: ZEOROLA H, available from Nippon Zeon Co., Ltd.) and 37.5 parts of 1-propanol, and thereafter 25 parts of tetrafluoroethylene resin powder (trade name: LUBRON L-2, available from Daikin Industries, Ltd.) was added as a lubricant, followed by uniform dispersion by carrying out treatment three times under a pressure of 600 kgf/cm$^2$ by means of a high-pressure dispersion machine (trade name: MICROFLUIDIZER M-110EH, manufactured by Microfluidics Inc., USA). The dispersion obtained was subjected to pressure filtration with a PTFE membrane filter of 10 μm in pore size to prepare a lubricant dispersion. Next, 36 parts of Exemplary Compound No. 41 as shown in Table 2, the charge transporting compound having chain polymerizable functional groups, 16.2 parts of the lubricant dispersion, 24 parts of 1,1,2,2,3,3,4-heptafluorocyclopentane and 24 parts of 1-propanol were mixed and stirred, followed by pressure filtration with a membrane filter of 5 μm in pore size, made of PTFE, to prepare a protective layer coating fluid.

This protective layer coating fluid was applied by dip-coating on the charge transport layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 25° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $2.5\times10^5$ Gy/sec (absorbed dose within effective electron ray irradiation width/time for which arbitrary one point on sample surface exists within effective electron ray irradiation width), an accelerating voltage of 150 kV and an absorbed dose (total absorbed dose the sample has received in the step of irradiation with electron rays) of $2.5\times10^5$ Gy. The time from the start to completion of the irradiation with electron rays was 1.5 seconds. The irradiation with electron rays was carried out under the above conditions to cure the compound, to form a protective layer with a layer thickness of 5 μm, which was further subjected to heat treatment at 150° C. for 1 hour to obtain an electrophotographic photosensitive member.

The electrophotographic photosensitive member (drum) thus obtained was fitted to an altered machine of LASER JET 4300n, manufactured by Hewlett-Packard Co. (so altered that the DC component and amount of light of charging were changeable). Under conditions of normal temperature and normal humidity (23° C./50% RH), the charging was so set that the initial-stage dark-area potential Vd came to be −650 V by changing the DC component and amount of light of charging, and this electrophotographic photosensitive member was irradiated with laser light of 780 nm in wavelength to measure the amount of light necessary for attenuating the potential of −650 V to −170 V (light-area potential Vl) to regard it as sensitivity. Further, the potential where the light was applied in an amount of 20 μJ/cm$^2$ was regarded as residual potential Vr, and its initial-stage characteristics were measured and evaluated. To measure the potential, a probe was fitted to the position of the developing assembly.

Next, a continuous 10,000-sheet paper feed running test was conducted, and the levels of variations in dark-area potential and light-area potential between those at the initial stage and those immediately after running, ΔVd and ΔVl, respectively, and abrasion wear were measured. Here, the potentials at the initial-stage were set as in the foregoing, i.e., dark-area potential −650 V and light-area potential: −170 V. The paper feed running was performed using as a running test pattern an image in which lines of about 2 mm in width were lengthwise and breadthwise printed at intervals of 7 mm.

Further, together with the above running test, evaluation was also made on ghosts at the initial stage and after running. To make evaluation on the ghosts, as a printed image, an image sample was printed in which square solid black image areas of 25 mm for each side were arranged at the part of one round of the electrophotographic photosensitive member and a whole-area halftone image (an image with a dot density of one dot and one space) was formed at the part of second and subsequent rounds of the electrophotographic photosensitive member. Whether or not the phenomenon of ghosts occurred was examined from this image sample. As image samples, prints were sampled for each of development volumes F5 (center value) and F9 (low density) of the printer. As evaluation criteria, a case in which no ghost was visually seen at all in all modes was evaluated as Rank 1, a case in which ghosts were thinly seen in the F9 mode as Rank 2, a case in which ghosts were thinly seen in all modes as Rank 3, and a case in which ghosts were clearly seen in all modes as Rank 4.

The results of these are shown in Table 9.

Examples 2-36 to 2-54

Electrophotographic photosensitive members were produced in the same manner as in Example 2-35 except that Exemplary Compound No. 41, the charge transporting compound having chain polymerizable functional groups, which was used in preparing the charge transport layer coating fluid in Example 2-35 was changed for Exemplary Compounds No. 43, No. 45, No. 50, No. 51, No. 53, No. 63, No. 68, No. 70, No. 72, No. 74, No. 83, No. 84, No. 88, No. 91, No. 92, No. 93, No. 94, No. 95 and No. 96, respectively. Evaluation was made in the same way. The results thereof are shown in Table 9.

Example 2-55

An electrophotographic photosensitive member was produced in the same manner as in Example 2-35 except that 36 parts of Exemplary Compound No. 41, the charge transporting compound having chain polymerizable functional groups, which was used in preparing the protective layer coating fluid in Example 2-35 was changed for 24 parts of Exemplary Compound No. 43 and 12 parts of a compound A-2 shown below (trade name: KAYARAD TMPTA, available from Nippon Kayaku Co., Ltd.). Evaluation was made in the same way. The results thereof are shown in Table 9.

(A-2)

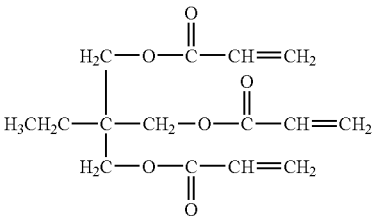

Example 2-56

An electrophotographic photosensitive member was produced in the same manner as in Example 2-35 except that 36 parts of Exemplary Compound No. 41, the charge transporting compound having chain polymerizable functional groups, which was used in preparing the protective layer coating fluid in Example 2-35 was changed for 24 parts of Exemplary Compound No. 41 and 12 parts of the compound H-22 shown previously, having chain polymerizable functional groups. Evaluation was made in the same way. The results thereof are shown in Table 9.

Comparative Example 2-12

An electrophotographic photosensitive member was produced in the same manner as in Example 2-35 except that Exemplary Compound No. 41, the charge transporting compound having chain polymerizable functional groups, which was used in preparing the protective layer coating fluid in Example 2-35 was changed for the charge transporting compound (H-15) shown previously. Evaluation was made in the same way. The results thereof are shown in Table 10.

Comparative Examples 2-13 to 2-18

Electrophotographic photosensitive members were produced in the same manner as in Comparative Example 2-12 except that the charge transporting compound (H-15) having chain polymerizable functional groups which was used in preparing the protective layer coating fluid in Comparative Example 2-12 was changed for the charge transporting compounds (H-13), (H-14), (H-17) and (H-20) shown previously, having chain polymerizable functional groups, and charge transporting compounds (H-23) and (H-24) shown below, having chain polymerizable functional groups. Evaluation was made in the same way. The results thereof are shown in Table 10.

(H-23)

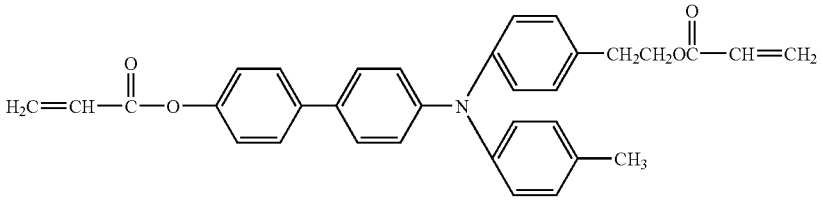

(H-24)

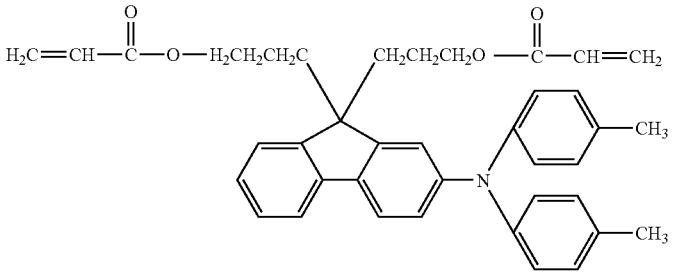

Comparative Example 2-19

An electrophotographic photosensitive member was produced in the same manner as in Comparative Example 2-13 except that 36 parts of the charge transporting compound (H-13) having chain polymerizable functional groups which was used in preparing the protective layer coating fluid in Comparative Example 2-13 was changed for 24 parts of the charge transporting compound (H-22) shown previously, having chain polymerizable functional groups, and 12 parts of the compound (A-2) shown previously. Evaluation was made in the same way. The results thereof are shown in Table 8.

Comparative Example 2-20

An electrophotographic photosensitive member was produced in the same manner as in Example 2-56 except that 24 parts of Exemplary Compound No. 41, the charge transporting compound having chain polymerizable functional groups, which was used in preparing the protective layer coating fluid in Example 2-56 was changed for 24 parts of the charge transporting compound (H-13) shown previously. Evaluation was made in the same way. The results thereof are shown in Table 10.

TABLE 9

| | | Potential characteristics and images at initial stage | | | Potential characteristics and images after 10,000-sheet running | | | |
|---|---|---|---|---|---|---|---|---|
| Example: | Compound No. | Sensitivity ($\mu J/cm^2$) | Vr (−V) | Ghost rank | ΔVd (−V) | ΔVl (−V) | Ghost rank | Abrasion wear (μm) |
| 2-35 | 41 | 0.31 | 55 | 1 | 10 | 5 | 1 | 0.1 or less |
| 2-36 | 43 | 0.30 | 50 | 1 | 5 | 10 | 1 | 0.1 or less |
| 2-37 | 45 | 0.38 | 68 | 1 | 15 | 25 | 2 | 0.19 |
| 2-38 | 50 | 0.37 | 65 | 1 | 15 | 30 | 2 | 0.35 |
| 2-39 | 51 | 0.31 | 55 | 1 | 10 | 10 | 1 | 0.1 or less |
| 2-40 | 53 | 0.37 | 70 | 1 | 10 | 25 | 2 | 0.18 |
| 2-41 | 63 | 0.33 | 65 | 1 | 10 | 15 | 1 | 0.1 or less |
| 2-42 | 68 | 0.29 | 50 | 1 | 5 | 10 | 1 | 0.1 or less |
| 2-43 | 70 | 0.36 | 65 | 1 | 10 | 30 | 2 | 0.42 |
| 2-44 | 72 | 0.29 | 50 | 1 | 5 | 5 | 1 | 0.1 or less |
| 2-45 | 74 | 0.38 | 75 | 1 | 15 | 30 | 2 | 0.45 |
| 2-46 | 83 | 0.32 | 60 | 1 | 10 | 10 | 1 | 0.1 or less |
| 2-47 | 84 | 0.39 | 80 | 1 | 10 | 35 | 2 | 0.22 |
| 2-48 | 88 | 0.31 | 58 | 1 | 10 | 10 | 1 | 0.12 |
| 2-49 | 91 | 0.29 | 50 | 1 | 5 | 5 | 1 | 0.1 or less |
| 2-50 | 92 | 0.30 | 55 | 1 | 10 | 10 | 1 | 0.12 |
| 2-51 | 93 | 0.38 | 65 | 1 | 15 | 25 | 2 | 0.19 |
| 2-52 | 94 | 0.30 | 60 | 1 | 10 | 10 | 1 | 0.12 |
| 2-53 | 95 | 0.39 | 75 | 1 | 15 | 35 | 2 | 0.29 |
| 2-54 | 96 | 0.38 | 75 | 1 | 10 | 35 | 2 | 0.24 |
| 2-55 | 43/A-2 | 0.40 | 85 | 2 | 10 | 45 | 2 | 0.18 |
| 2-56 | 41/H-22 | 0.35 | 70 | 1 | 10 | 35 | 2 | 0.27 |

TABLE 10

| | | Potential characteristics and images at initial stage | | | Potential characteristics and images after 10,000-sheet running | | | |
|---|---|---|---|---|---|---|---|---|
| Comparative Example: | Compound No. | Sensitivity ($\mu J/cm^2$) | Vr (−V) | Ghost rank | ΔVd (−V) | ΔVl (−V) | Ghost rank | Abrasion wear (μm) |
| 2-12 | H-15 | 0.39 | 75 | 1 | 15 | 95 | 3 | 0.19 |
| 2-13 | H-13 | 0.34 | 80 | 2 | 15 | 65 | 3 | 0.12 |
| 2-14 | H-14 | 0.32 | 65 | 1 | 10 | 75 | 4 | 0.1 or less |
| 2-15 | H-17 | 0.31 | 75 | 2 | 10 | 75 | 4 | 0.25 |
| 2-16 | H-20 | 0.37 | 70 | 1 | 5 | 68 | 3 | 2.5 |
| 2-17 | H-23 | 0.40 | 85 | 2 | 20 | 105 | 4 | 0.35 |
| 2-18 | H-24 | 0.31 | 65 | 1 | 10 | 55 | 3 | 0.29 |
| 2-19 | H-22/A-2 | 0.48 | 80 | 3 | 15 | 110 | 4 | 0.34 |
| 2-20 | H-22/H-13 | 0.40 | 80 | 2 | 15 | 75 | 4 | 0.33 |

As is evident from Tables 9 and 10, it has been found that the electrophotographic photosensitive member in V which the charge transporting compound having the chain polymerizable functional groups according to the present invention is used in the protective layer shows good electrophotographic photosensitive member characteristics at the initial stage of course, and also exhibits very superior running performance as having a small abrasion wear as a result of running, showing small potential variations during running, and showing good results on the ghosts both at the initial stage and after running.

Example 1-33

First, 50 parts of conductive titanium oxide powder coated with tin oxide containing 10% of antimony oxide, 25 parts of phenolic resin, 20 parts of methyl "Cellosolve", 5 parts of methanol and 0.002 part of a silicone compound (polydimethylsiloxane-polyoxyalkylene copolymer; average molecular weight: 3,000) were put to dispersion for 2 hours by means of a sand mill making use of glass beads of 1 mm in diameter, to prepare a coating fluid. This coating fluid was applied by dip coating on an aluminum cylinder of 30 mm in diameter, followed by drying at 150° C. for 30 minutes to form a conductive layer with a layer thickness of 15 μm.

Next, 5 parts of N-methoxymethylated nylon was dissolved in 95 parts of methanol to prepare an intermediate layer coating fluid. This coating fluid was applied by dip coating on the above conductive layer, followed by drying at 100° C. for 20 minutes to form an intermediate layer with a layer thickness of 0.5 μm.

Next, 3 parts of an azo pigment represented by the following structural formula (P-1) and 2 parts of polyvinyl butyral (trade name: S-LEC BX-1; available from Sekisui Chemical Co., Ltd.) were added to 80 parts of cyclohexanone, and these were put to dispersion for 15 hours by means of a sand mill together with glass beads. To the dispersion formed, 80 parts of tetrahydrofuran was added to prepare a charge generation layer coating fluid. This coating fluid was applied by dip coating on the intermediate layer, followed by drying at 105° C. for 10 minutes to form a charge generation layer with a layer thickness of 0.15 μm.

(P-1)

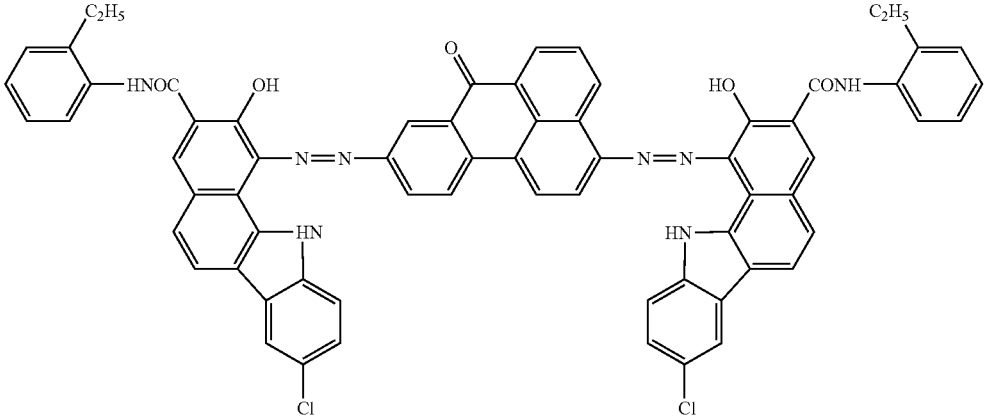

Next, as a charge transporting material 4.5 parts of the compound (D-1) shown previously and 5.5 parts of bisphenol-Z polycarbonate (viscosity average molecular weight: 45,000) were dissolved in 38 parts of monochlorobenzene to prepare a charge transport layer coating fluid. This coating fluid was applied by dip-coating on the charge generation layer, followed by drying at 100° C. for 60 minutes to form a charge transport layer with a layer thickness of 15 μm.

Next, 36 parts of Exemplary Compound No. 17 as shown in Table 1, the charge transporting compound having chain polymerizable functional groups, was dissolved in a mixed solvent of 24 parts of 1-propanol and 24 parts of 1,1,2,2,3,3,4-heptafluorocyclopentane, followed by pressure filtration with a membrane filter of 0.2 μm in pore size, made of PTFE, to prepare a protective layer coating fluid.

This protective layer coating fluid was applied by dip-coating on the charge transport layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 25° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $5\times10^5$ Gy/sec (absorbed dose within effective electron ray irradiation width/time for which arbitrary one point on sample surface exists within effective electron ray irradiation width) an accelerating voltage of 150 kV and an absorbed dose (total absorbed dose the sample has received in the step of irradiation with electron rays) of $5\times10^5$ Gy. The time from the start to completion of the irradiation with electron rays was 1.5 seconds. The irradiation with electron rays was carried out under the above conditions to cure the compound, to form a protective layer with a layer thickness of 5 μm, which was further subjected to heat treatment at 150° C. for 1 hour to obtain an electrophotographic photosensitive member.

The electrophotographic photosensitive member obtained was set to a drum electrophotographic photosensitive member test machine (CYNTHIA 59, manufactured by GenTech, Inc.), by means of which electrophotographic characteristics were measured in a low-temperature and low-humidity environment (15° C./10% RH).

As a measuring method, the drum electrophotographic photosensitive member was negatively charged by corona discharging while being rotated at 60 rpm in a dark place, and primary electric current was so controlled that potential $V_0$ at the position of a potential probe came to be −700 V. Here, a halogen lamp was used as a light source, and the drum electrophotographic photosensitive member was irradiated with what was made into monochrome light (775 nm) with a filter. The amount of exposure until the surface potential decreased to ½ of the $V_0$ was determined, and its halved amount of exposure $E_{1/2}$ was regarded as sensitivity. Further, a pre-exposure step was inserted in which an energy of 15 μJ/cm$^2$ was applied using a light emitting diode of 700 nm in wavelength to effect charge elimination after the charging and exposure, and the potential after this charge elimination was regarded as residual potential Vr.

Further, the above process was repeated 1,000 times, and immediately thereafter the potential was likewise measured to evaluate repeatability (repeat stability). Also, the above 60 rpm was changed to 210 rpm, and the potential was likewise measured.

The results of these are shown in Table 11.

Examples 1-34 to 1-37

Electrophotographic photosensitive members were produced in the same manner as in Example 1-33 except that Exemplary Compound No. 17, the charge transporting compound having chain polymerizable functional groups, which was used in preparing the charge transport layer coating fluid in Example 1-33 was changed for Exemplary Compounds No. 3, No. 26, No. 27 and No. 31, respectively. Evaluation was made in the same way. The results thereof are shown in Table 11.

TABLE 11

| | | 60 rpm | | | | 210 rpm | |
|---|---|---|---|---|---|---|---|
| | | Initial stage | | After 1,000 rotations | | After 1,000 rotations | |
| Example: | Compound No. | Sensitivity (μJ/cm$^2$) | Vr (−V) | Sensitivity (μJ/cm$^2$) | Vr (−V) | Sensitivity (μJ/cm$^2$) | Vr (−V) |
| 1-33 | 17 | 0.48 | 35 | 0.48 | 35 | 0.49 | 40 |
| 1-34 | 3 | 0.49 | 40 | 0.49 | 40 | 0.49 | 46 |
| 1-35 | 26 | 0.52 | 45 | 0.53 | 50 | 0.55 | 62 |
| 1-36 | 27 | 0.40 | 30 | 0.40 | 32 | 0.40 | 34 |
| 1-37 | 31 | 0.51 | 45 | 0.53 | 52 | 0.55 | 66 |

Comparative Examples 1-20 to 1-23

Electrophotographic photosensitive members were produced in the same manner as in Example 1-33 except that Exemplary Compound No. 17, the charge transporting compound having chain polymerizable functional groups, which was used in preparing the protective layer coating fluid in Example 1-33 was changed for the charge transporting compounds (H-1), (H-2), (H-5) and (H-12) shown previously, having chain polymerizable functional groups. Evaluation was made in the same way. The results thereof are shown in Table 12.

TABLE 12

| | | 60 rpm | | | | 210 rpm | |
|---|---|---|---|---|---|---|---|
| | | Initial stage | | After 1,000 rotations | | After 1,000 rotations | |
| Comparative Example: | Compound No. | Sensitivity (μJ/cm$^2$) | Vr (−V) | Sensitivity (μJ/cm$^2$) | Vr (−V) | Sensitivity (μJ/cm$^2$) | Vr (−V) |
| 1-20 | H-1 | 0.58 | 60 | 0.60 | 75 | 0.63 | 105 |
| 1-21 | H-2 | 0.52 | 55 | 0.58 | 68 | 0.64 | 100 |

TABLE 12-continued

| | | 60 rpm | | | | 210 rpm | |
|---|---|---|---|---|---|---|---|
| | | Initial stage | | After 1,000 rotations | | After 1,000 rotations | |
| Comparative Example: | Compound No. | Sensitivity ($\mu J/cm^2$) | Vr (−V) | Sensitivity ($\mu J/cm^2$) | Vr (−V) | Sensitivity ($\mu J/cm^2$) | Vr (−V) |
| 1-22 | H-5 | 0.56 | 62 | 0.62 | 75 | 0.67 | 90 |
| 1-23 | H-12 | 0.50 | 50 | 0.52 | 60 | 0.56 | 85 |

As is evident from Tables 11 and 12, it has been found that the electrophotographic photosensitive member in which the charge transporting compound having the chain polymerizable functional groups according to the present invention is used in the protective layer shows very stable and superior performance even when the process speed is changed.

Example 2-57

First, 50 parts of conductive titanium oxide powder coated with tin oxide containing 10% of antimony oxide, 25 parts of phenolic resin, 20 parts of methyl "Cellosolve", 5 parts of methanol and 0.002 part of a silicone compound (polydimethylsiloxane-polyoxyalkylene copolymer; average molecular weight: 3,000) were put to dispersion for 2 hours by means of a sand mill making use of glass beads of 1 mm in diameter, to prepare a coating fluid. This coating fluid was applied by dip coating on an aluminum cylinder of 30 mm in diameter, followed by drying at 150° C. for 30 minutes to form a conductive layer with a layer thickness of 15 μm.

Next, 5 parts of N-methoxymethylated nylon was dissolved in 95 parts of methanol to prepare an intermediate layer coating fluid. This coating fluid was applied by dip coating on the above conductive layer, followed by drying at 100° C. for 20 minutes to form an intermediate layer with a layer thickness of 0.5 μm.

Next, 3 parts of an azo pigment represented by the following structural formula (P-1) and 2 parts of polyvinyl butyral (trade name: S-LEC BX-1; available from Sekisui Chemical Co., Ltd.) were added to 80 parts of cyclohexanone, and these were put to dispersion for 15 hours by means of a sand mill together with glass beads. To the dispersion formed, 80 parts of tetrahydrofuran was added to prepare a charge generation layer coating fluid. This coating fluid was applied by dip coating on the intermediate layer, followed by drying at 105° C. for 10 minutes to form a charge generation layer with a layer thickness of 0.15 μm.

(P-1)

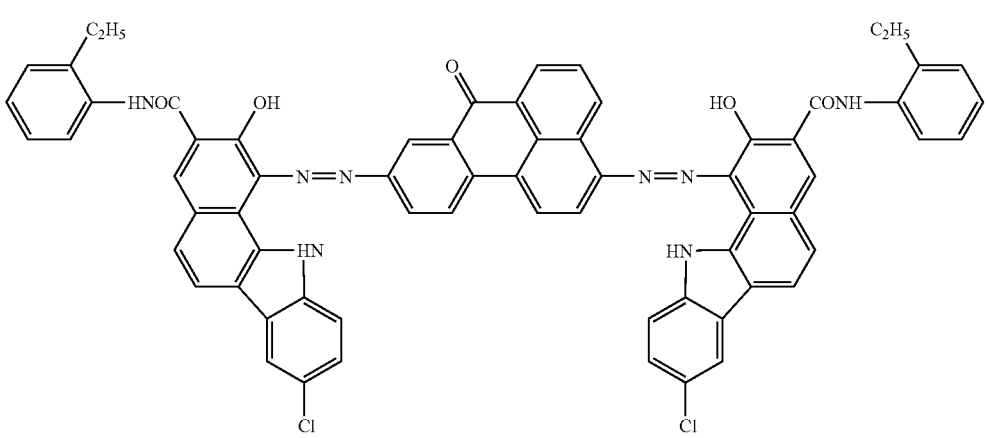

Next, as a charge transporting material 4.5 parts of the compound (D-1) shown previously and 5.5 parts of bisphenol-Z polycarbonate (viscosity average molecular weight: 45,000) were dissolved in 38 parts of monochlorobenzene to prepare a charge transport layer coating fluid. This coating fluid was applied by dip-coating on the charge generation layer, followed by drying at 100° C. for 60 minutes to form a charge transport layer with a layer thickness of 15 μm.

Next, 36 parts of Exemplary Compound No. 43 as shown in Table 2, the charge transporting compound having chain polymerizable functional groups, was dissolved in a mixed solvent of 24 parts of 1-propanol and 24 parts of 1,1,2,2,3,3,4-heptafluorocyclopentane, followed by pressure filtration with a membrane filter of 0.2 μm in pore size, made of PTFE, to prepare a protective layer coating fluid.

This protective layer coating fluid was applied by dip-coating on the charge transport layer, followed by drying at 40° C. for 10 minutes, and thereafter the layer formed was irradiated with electron rays by using the electron ray irradiator shown in FIG. 1. On its belt conveyor, a sample was transported to the lower part of the electron ray irradiation window, where the transport was stopped at the irradiation part and the sample was irradiated while being rotated (drum temperature at the start of irradiation was about 30° C.). After the irradiation was completed, the sample was again transported and then carried outside. Here, effective electron ray irradiation width at the part irradiated with electron rays (the width corresponding to 1/e or more of the peak position in electron ray density distribution on the sample surface) was 4 cm. The irradiation with electron rays were under conditions of an absorbed dose of $2.0\times10^5$ Gy/sec (absorbed dose within effective electron ray irradiation width/time for which arbitrary one point on sample surface exists within effective electron ray irradiation width), an accelerating voltage of 1.50 kV and an absorbed dose (total absorbed dose the sample has received in the step of irradiation with electron rays) of $2.0\times10^5$ Gy. The time from the start to completion of the irradiation with electron rays was 1.5 seconds. The irradiation with electron rays was carried out under the above conditions to cure the compound, to form a protective layer with a layer thickness of 5 μm, which was further subjected to heat treatment at 150° C. for 1 hour to obtain an electrophotographic photosensitive member.

The electrophotographic photosensitive member obtained was set to a drum electrophotographic photosensitive member test machine (CYNTHIA 59, manufactured by GenTech, Inc.), by means of which electrophotographic characteristics were measured in a low-temperature and low-humidity environment (15° C./10% RH).

As a measuring method, the drum electrophotographic photosensitive member was negatively charged by corona discharging while being rotated at 60 rpm in a dark place, and primary electric current was so controlled that potential $V_0$ at the position of a potential probe came to be −700 V. Here, a halogen lamp was used as a light source, and the drum electrophotographic photosensitive member was irradiated with what was made into monochrome light (775 nm) with a filter. The amount of exposure until the surface potential decreased to ½ of the $V_0$ was determined, and its halved amount of exposure $E_{1/2}$ was regarded as sensitivity. Further, a pre-exposure step in which an energy of 15 μJ/cm$^2$ was applied using a light emitting diode of 700 nm in wavelength was inserted to effect charge elimination after the charging and exposure, and the potential after this charge elimination was regarded as residual potential Vr.

Further, the above process was repeated 1,000 times, and immediately thereafter the potential was likewise measured to evaluate repeatability (repeat stability). Also, the above 60 rpm was changed to 210 rpm, and the potential was likewise measured.

The results of these are shown in Table 13.

Examples 2-58 to 2-61

Electrophotographic photosensitive members were produced in the same manner as in Example 2-57 except that Exemplary Compound No. 43, the charge transporting compound having chain polymerizable functional groups, which was used in preparing the charge transport layer coating fluid in Example 2-57 was changed for Exemplary Compounds No. 44, No. 45, No. 91 and No. 93, respectively. Evaluation was made in the same way. The results thereof are shown in Table 13.

TABLE 13

| | | 60 rpm | | | | 210 rpm | |
|---|---|---|---|---|---|---|---|
| | | Initial stage | | After 1,000 rotations | | After 1,000 rotations | |
| Example: | Compound No. | Sensitivity (μJ/cm$^2$) | Vr (−V) | Sensitivity (μJ/cm$^2$) | Vr (−V) | Sensitivity (μJ/cm$^2$) | Vr (−V) |
| 2-57 | 43 | 0.42 | 35 | 0.42 | 38 | 0.42 | 42 |
| 2-58 | 44 | 0.41 | 35 | 0.42 | 35 | 0.42 | 40 |
| 2-59 | 45 | 0.47 | 45 | 0.51 | 50 | 0.53 | 63 |
| 2-60 | 91 | 0.41 | 30 | 0.41 | 32 | 0.41 | 35 |
| 2-61 | 93 | 0.48 | 45 | 0.48 | 45 | 0.55 | 65 |

Comparative Examples 2-21 to 2-24

Electrophotographic photosensitive members were produced in the same manner as in Example 2-57 except that Exemplary Compound No. 43, the charge transporting compound having chain polymerizable functional groups, which was used in preparing the protective layer coating fluid in Example 2-57 was changed for the charge transporting compounds (H-13), (H-14), (H-23) and (H-24) shown previously, having chain polymerizable functional groups. Evaluation was made in the same way. The results thereof are shown in Table 14.

TABLE 14

| | | 60 rpm | | | | 210 rpm | |
|---|---|---|---|---|---|---|---|
| | | Initial stage | | After 1,000 rotations | | After 1,000 rotations | |
| Comparative Example: | Compound No. | Sensitivity ($\mu J/cm^2$) | Vr (−V) | Sensitivity ($\mu J/cm^2$) | Vr (−V) | Sensitivity ($\mu J/cm^2$) | Vr (−V) |
| 2-21 | H-13 | 0.58 | 60 | 0.60 | 75 | 0.63 | 105 |
| 2-22 | H-14 | 0.52 | 55 | 0.58 | 68 | 0.64 | 100 |
| 2-23 | H-23 | 0.53 | 60 | 0.57 | 70 | 0.62 | 115 |
| 2-24 | H-24 | 0.50 | 50 | 0.52 | 60 | 0.56 | 85 |

As is evident from Tables 13 and 14, it has been found that the electrophotographic photosensitive member in which the charge transporting compound having the chain polymerizable functional groups according to the present invention is used in the protective layer shows very stable and superior performance even when the process speed is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-162730, filed Jun. 2, 2005, and 2005-162732, filed Jun. 2, 2005, which are hereby incorporated by reference herein in their entirety.

What is claimed is:

1. An electrophotographic photosensitive member which comprises: a conductive support and a photosensitive layer provided on the conductive support, wherein an outermost surface layer of the electrophotographic photosensitive member contains a charge transporting compound having chain polymerizable functional groups, said charge transporting compound represented by the following general formula (9), (10) or (13); the charge transporting compound having been polymerized or cross-linked and cured (9)

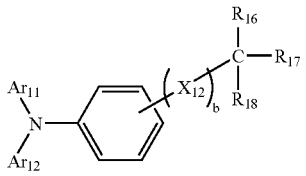

(10)

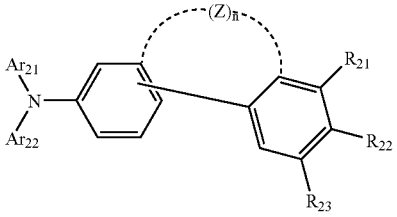

-continued (13)

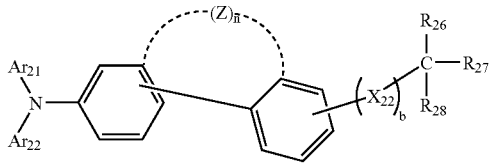

in the general formula (9), $Ar_{11}$ and $Ar_{12}$ each represent an aryl group which may have a substituent, which substituent is selected from an alkyl group, an alkoxyl group and an aryl group; $Ar_{11}$ and $Ar_{12}$ may be the same or different; $X_{12}$ represents a divalent alkylene group which may have a substituent, an oxygen atom or —O-$Z_{12}$- ($Z_{12}$ is a divalent alkylene group);

b is an integer of 0 or 1; $R_{16}$ to $R_{18}$ each represent an aryl group which may have a substituent, an alkyl group which may have a substituent, an aralkyl group which may have a substituent, an aryloxyl group which may have a substituent, a hydrogen atom, or a group represented by the following general formula (8); and $R_{16}$ to $R_{18}$ may be the same or different and the substituent of $R_{16}$ to $R_{18}$ each is selected from an alkyl group, an aralkyl group, an aryl group, a halogen atom and a group represented by the following general formula (8), provided that any of $R_{16}$ to $R_{18}$ has at least two of the chain polymerizable functional groups represented by the following general formulas (2) to (6)

$$-(X_{11})_a-P_{11} \quad (8)$$

wherein, $X_{11}$ represents a divalent organic residual group which may have a substituent, which substituent is selected from an alkyl group, an aralkyl group, an aryl group and a halogen atom; a represents an integer of 0 or 1; and $P_{11}$ represents any one of the chain polymerizable functional groups represented by the following general formulas (2) to (6);

in the general formula (10), $Ar_{21}$ and $Ar_{22}$ each represent an aryl group which may have a substituent, and $Ar_{21}$ and $Ar_{22}$ may be the same or different; the substituent of $Ar_{21}$ and $Ar_{22}$ each is selected from an alkyl group, an alkoxyl group, an aryloxyl group, an aralkyl group, an aryl group and a halogen atom; Z represents —CH═CH—, —$CH_2$—$CH_2$— or a group represented by the following general formula (11); n represents an integer of 0 or 1; $R_{21}$ to $R_{23}$ each represent a hydrogen atom, an alkyl group, an alkoxyl group or a group represented by the following general formula (12); $R_{21}$ to $R_{23}$ may be the same or different, provided that at least two of $R_{21}$ to $R_{23}$ are each a group represented by the following general formula (12)

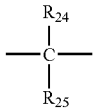

(11)

wherein $R_{24}$ and $R_{25}$ each represent an alkyl group which may have a substituent, an aralkyl group which may have a substituent, an aryl group which may have a substituent, or a hydrogen atom, and $R_{24}$ and $R_{25}$ may be the same or different; and the substituents are each selected from an alkyl group, an aralkyl group, an aryl group and a halogen atom (12)

wherein $X_{21}$ represents a divalent organic residual group which may have a substituent, which substituent is selected from an alkyl group, an aralkyl group, an aryl group and a halogen atom; a represents an integer of 0 or 1; and $P_{21}$ represents any one of the chain polymerizable functional groups represented by the following general formulas (2) to (6);

in the general formula (13), $Ar_{21}$ and $Ar_{22}$ are each as defined in the general formula (10); Z represents —CH═CH—, —$CH_2$—$CH_2$— or a group represented by the above general formula (11);

n represents an integer of 0 or 1; $X_{22}$ represents a divalent organic residual group; b is an integer of 0 or 1; $R_{26}$ to $R_{28}$ each represent an aryl group which may have a substituent, an alkyl group which may have a substituent, an aralkyl group which may have a substituent, an aryloxyl group which may have a substituent, a hydrogen atom or a group represented by the above general formula (12); $R_{26}$ to $R_{28}$ may be the same or different; the substituents of $R_{26}$ to $R_{28}$ are each selected from an alkyl group, an aralkyl group, an aryl group, a halogen atom and a group represented by the above general formula (12); provided that any of $R_{26}$ to $R_{28}$ has at least two of the chain polymerizable functional groups represented by the following general formulas (2) to (6)

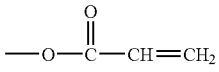

(2)

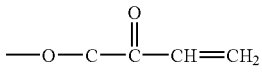

(3)

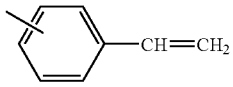

(4)

-continued

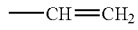

(5)

(6)

2. The electrophotographic photosensitive member according to claim 1, wherein the charge transporting compound having chain polymerizable functional groups is a compound represented by the general formula (9), and $R_{16}$ and $R_{17}$ in the general formula (9) are each a group represented by the general formula (8).

3. The electrophotographic photosensitive member according to claim 2, wherein, in the general formula (8), a is 1 and $X_{11}$ is an alkylene group.

4. The electrophotographic photosensitive member according to claim 2, wherein $Ar_{11}$ and $Ar_{12}$ of the charge transporting compound having chain polymerizable functional groups which is represented by the general formula (9) are each a phenyl group which may have a substituent, a biphenyl group which may have a substituent or a fluorenyl group which may have a substituent; $Ar_{11}$ and $Ar_{12}$ may be the same or different; and the substituents of $Ar_{11}$ and $Ar_{12}$ are each an alkyl group or an alkoxyl group.

5. The electrophotographic photosensitive member according to claim 4, wherein said chain polymerizable functional groups the charge transporting compound having chain polymerizable functional groups which is represented by the general formula (9) has are each a group represented by the general formula (2) or (3).

6. The electrophotographic photosensitive member according to claim 1, wherein the charge transporting compound having chain polymerizable functional groups is a compound represented by the general formula (10), and, in the general formula (12), a is 1 and $X_{21}$ is an oxygen atom, a divalent alkylene group or —O-$Z_{21}$- ($Z_{21}$ is a divalent alkylene group).

7. The electrophotographic photosensitive member according to claim 1, wherein the charge transporting compound having chain polymerizable functional groups is a compound represented by the general formula (13), and, in the general formula (13), b is 1 and $X_{22}$ is a divalent alkylene group which may have a substituent, an oxygen atom or —O-$Z_{22}$- ($Z_{22}$ is a divalent alkylene group).

8. The electrophotographic photosensitive member according to claim 7, wherein $R_{26}$ and $R_{27}$ represented by the general formula (13) are each a group represented by the general formula (12).

9. The electrophotographic photosensitive member according to claim 8, wherein, in the general formula (12), a is 1 and $X_{21}$ is an alkylene group.

10. The electrophotographic photosensitive member according to claim 8, wherein $Ar_{21}$ and $Ar_{22}$ of the charge transporting compound having chain polymerizable functional groups which is represented by the general formula (13) may be the same or different, and are each a phenyl group which may have a substituent, a biphenyl group which may have a substituent or a fluorenyl group which may have a substituent; and the substituents of $Ar_{21}$ and $Ar_{22}$ are each an alkyl group or an alkoxyl group.

11. The electrophotographic photosensitive member according to claim 10, wherein said chain polymerizable functional groups the charge transporting compound having chain polymerizable functional groups which is represented by the general formula (13) has are each a group represented by the general formula (2) or (3).

12. The electrophotographic photosensitive member according to claim 1, wherein said outermost surface layer is cured by electron rays.

13. A process cartridge which comprises the electrophotographic photosensitive member according to claim 1, and at least one means selected from the group consisting of a charging means which charges the electrophotographic photosensitive member electrostatically, a developing means which develops with a toner an electrostatic latent image formed on the electrophotographic photosensitive member, and a cleaning means which collects the toner remaining on the electrophotographic photosensitive member after the step of transfer; the process cartridge being detachably mountable to the main body of an electrophotographic apparatus.

14. An electrophotographic apparatus which comprises the electrophotographic photosensitive member according to claim 1; a charging means which charges the electrophotographic photosensitive member electrostatically; an exposure means which performs exposure on the electrophotographic photosensitive member thus charged, to form an electrostatic latent image; a developing means which develops with a toner the electrostatic latent image formed on the electrophotographic photosensitive member, to form a toner image; and a transfer means which transfers to a transfer material the toner image formed on the electrophotographic photosensitive member.

15. The electrophotographic photosensitive member according to claim 6, wherein $Ar_{21}$ and $Ar_{22}$ of the charge transporting compound having chain polymerizable functional groups which is represented by the general formula (10) maybe the same or different, and are each a phenyl group which may have a substituent, a biphenyl group which may have a substituent or a fluorenyl group which may have a substituent; and the substituents of $Ar_{21}$ and $Ar_{22}$ are each an alkyl group or an alkoxyl group.

16. The electrophotographic photosensitive member according to claim 15, wherein said chain polymerizable functional groups the charge transporting compound having chain polymerizable functional groups which is represented by the general formula (10) has are each a group represented by the general formula (2) or (3).

* * * * *

UNITED STATES PATENT AND TRADEMARK OFFICE

CERTIFICATE OF CORRECTION

PATENT NO. : 7,364,824 B2
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

COLUMN 2

Line 4, “come to wear” should read --become worn--;
Line 5, “come” should read --become--;
Line 14, “comes to wear and comes” should read --becomes worn and becomes--;
Line 17, “comes” should read --becomes--; and
Line 27, “in repeated used.” should read --after repeated use.--.

COLUMN 3

Line 51, “a little an” should read --an insubstantial--.

COLUMN 4

Line 29, “come” should read --become--;
Line 33, “come” should read --become--;
Line 35, “come” should read --become--;
Line 46, “a usual” should read --of conventional--; and
Line 47, “can assume” should be deleted.

COLUMN 10

Line 22, “z” should read --Z--.

COLUMN 15

Table 1, “9 get,1813
10 get,1814
11 get,1815
12 get,1816”

UNITED STATES PATENT AND TRADEMARK OFFICE

CERTIFICATE OF CORRECTION

PATENT NO. : 7,364,824 B2
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

should read

-- 9

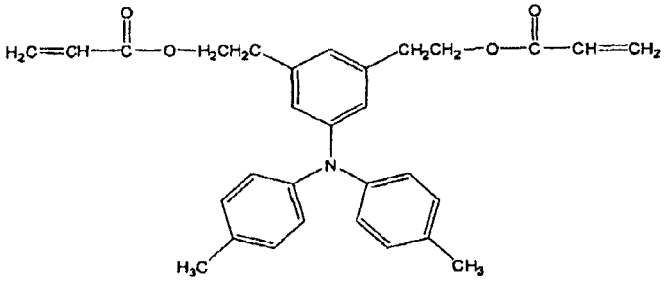

10

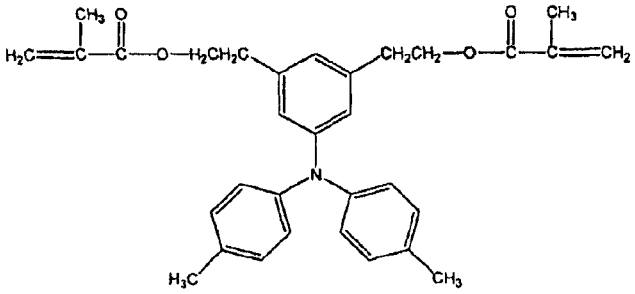

11

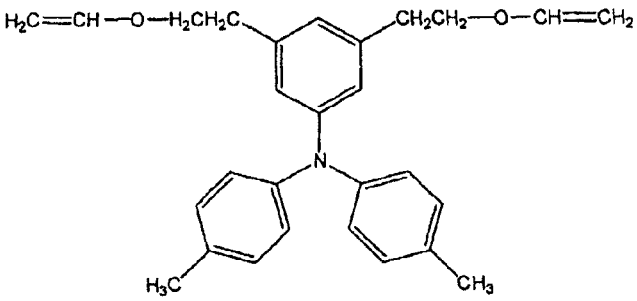

12

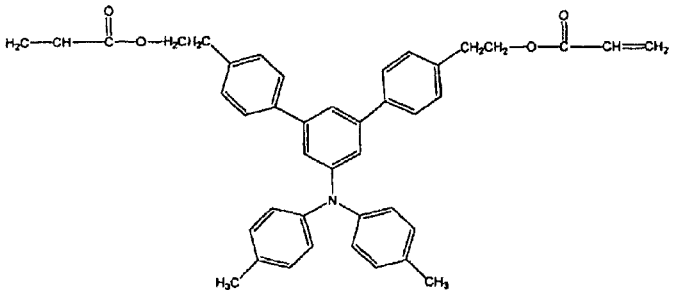

--.

UNITED STATES PATENT AND TRADEMARK OFFICE

CERTIFICATE OF CORRECTION

PATENT NO. : 7,364,824 B2
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

COLUMN 33

Table 2, "41 get,1817
42 get,1818
43 get,1819
44 get,1820
45 get,1821
46 "

should read

-- 41

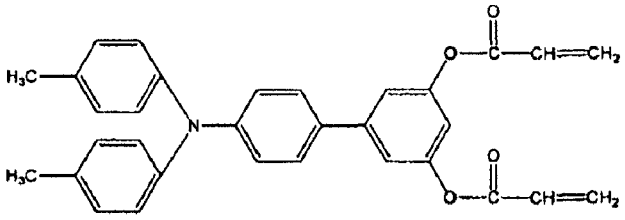

42

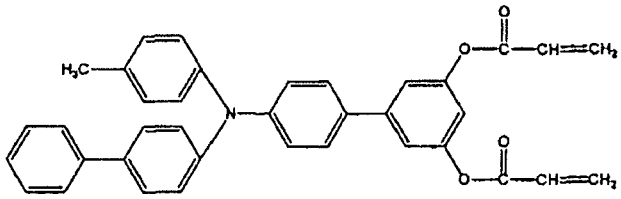

43

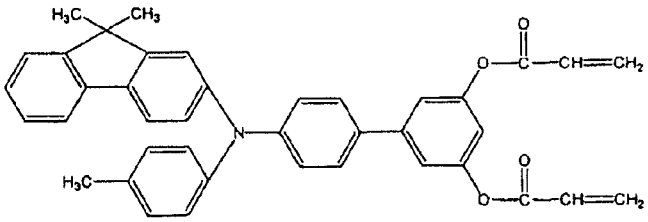

44

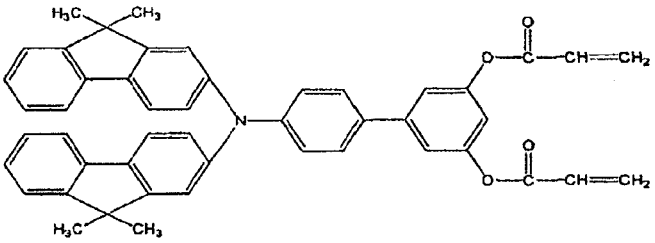

UNITED STATES PATENT AND TRADEMARK OFFICE

CERTIFICATE OF CORRECTION

PATENT NO. : 7,364,824 B2
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

45 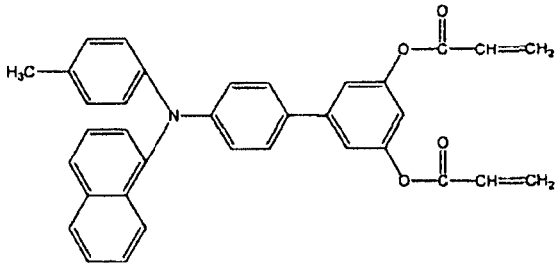 --.

COLUMN 55

Line 21, “show” should read --shown--.

COLUMN 60

Line 35, “p-ditolylamino” should read --p-ditolylamine--.

COLUMN 64

Line 52, “group(s)” should read --group(s).--.

COLUMN 67

Line 48, “loose” should read --lose--.

COLUMN 71

Line 37, “7.40 and 28.20” should read --7.4° and 28.2°--.

COLUMN 75

Compound (H-2)

“ 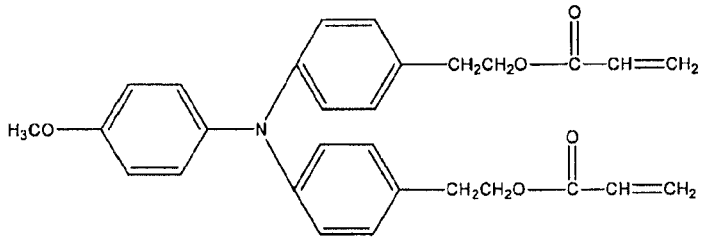 ”

UNITED STATES PATENT AND TRADEMARK OFFICE

CERTIFICATE OF CORRECTION

PATENT NO. : 7,364,824 B2
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

should read

--

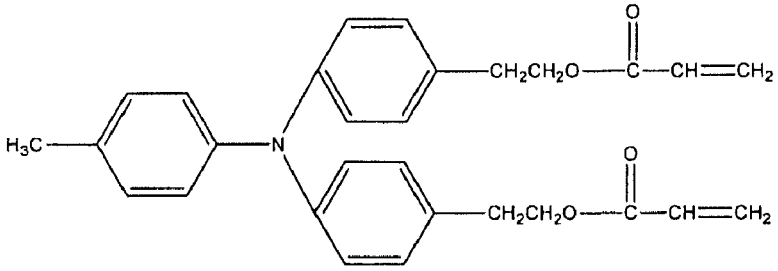

--.

COLUMN 103

Line 2, "V" should be deleted.

COLUMN 108

Formula (P-1)

(P-1)

"

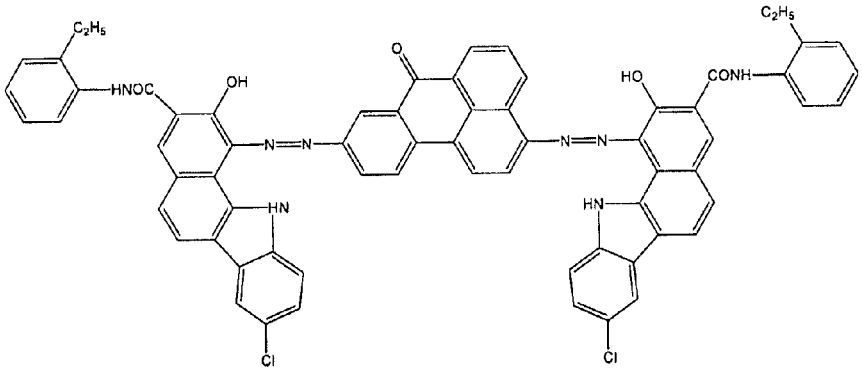

"

should read

UNITED STATES PATENT AND TRADEMARK OFFICE

CERTIFICATE OF CORRECTION

PATENT NO. : 7,364,824 B2 
APPLICATION NO. : 11/617347
DATED : April 29, 2008
INVENTOR(S) : Toshihiro Kikuchi et al.

It is certified that error appears in the above-identified patent and that said Letters Patent is hereby corrected as shown below:

-- (P-1) --.

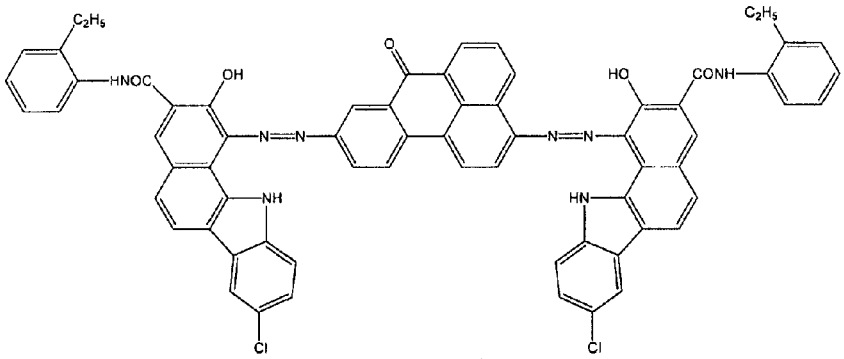

COLUMN 114

Line 27, “groups the” should read --groups of the--;
Line 29, “has” should be deleted;
Line 64, “groups the” should read --groups of the--; and
Line 66, “has” should be deleted.

COLUMN 116

Line 10, “maybe” should read --may be--;
Line 17, “groups the” should read --groups of the--; and
Line 19, “has” should be deleted.

Signed and Sealed this

Fourteenth Day of October, 2008

JON W. DUDAS
*Director of the United States Patent and Trademark Office*